US009173538B2

(12) United States Patent
Sandahl

(10) Patent No.: US 9,173,538 B2
(45) Date of Patent: Nov. 3, 2015

(54) CLEANING BRUSH WITH PULSING WATER

(75) Inventor: Jeffrey E. Sandahl, Buffalo, MN (US)

(73) Assignee: WAGNER SPRAY TECH CORPORATION, Plymouth, MN (US)

( * ) Notice: Subject to any disclaimer, the term of this patent is extended or adjusted under 35 U.S.C. 154(b) by 1115 days.

(21) Appl. No.: 12/529,842

(22) PCT Filed: Mar. 5, 2008

(86) PCT No.: PCT/US2008/055857

§ 371 (c)(1),
(2), (4) Date: Dec. 18, 2009

(87) PCT Pub. No.: WO2008/109638

PCT Pub. Date: Sep. 12, 2008

(65) Prior Publication Data

US 2010/0116289 A1 May 13, 2010

Related U.S. Application Data

(60) Provisional application No. 60/893,210, filed on Mar. 6, 2007.

(51) Int. Cl.
*A46B 11/00* (2006.01)
*B08B 7/00* (2006.01)
(Continued)

(52) U.S. Cl.
CPC ..... *A47L 11/38* (2013.01); *A46B 11/063* (2013.01); *A47L 11/4036* (2013.01);
(Continued)

(58) Field of Classification Search
CPC ..... A46B 11/063; A46B 2200/202; A47L 11/38; A47L 11/4036; A47L 11/4088; A47L 13/23; A47L 13/26; A47L 11/4075; E04G 23/002; B08B 3/026
USPC ..... 134/6, 34, 123; 15/21.1, 22.1, 22.2, 15/49.1, 50.1, 50.2, 106, 145, 159.1, 172
See application file for complete search history.

(56) References Cited

U.S. PATENT DOCUMENTS 3,447,753 A * 6/1969 Proctor et al. ..... 239/317
3,770,205 A * 11/1973 Proctor et al. ..... 239/317
(Continued)

FOREIGN PATENT DOCUMENTS

GB 376700 A 7/1932
WO WO 2006011029 A1 * 2/2006

OTHER PUBLICATIONS

International Search Report and Written Opinion issued in PCT/US2008/055857, dated Jul. 27, 2008, 15 pages.
(Continued)

*Primary Examiner* — Alexander Markoff
(74) *Attorney, Agent, or Firm* — Christopher J. Volkmann; Kelly, Holt & Christenson, PLLC

(57) ABSTRACT

A paint preparation tool (10) having a distal brush head (18) with a mode valve to switch between continuous spraying under low pressure and pulsed spraying under higher pressure' connected by a hollow tube to a proximal remote control element (14) capable of switching off liquid to the brush head (18), or supplying liquid cleaner solution to the brush head (18) at low pressure or supplying liquid under the higher pressure to the brush head (18) using a rotary spool valve in the control element to actuate the mode valve in the brush head (18). The brush head (18) has bristles for cleaning and a pair of rotating rotors to provide the pulsed spraying under higher pressure.

18 Claims, 76 Drawing Sheets

(51) Int. Cl.

| | |
|---|---|
| ***A47L 11/38*** | (2006.01) |
| ***A46B 11/06*** | (2006.01) |
| ***A47L 11/40*** | (2006.01) |
| ***A47L 13/23*** | (2006.01) |
| ***A47L 13/26*** | (2006.01) |
| ***B08B 3/02*** | (2006.01) |
| *E04G 23/00* | (2006.01) |

(52) U.S. Cl.
CPC ..... *A47L 11/4075* (2013.01); *A47L 11/4088* (2013.01); *A47L 13/23* (2013.01); *A47L 13/26* (2013.01); *B08B 3/026* (2013.01); *A46B 2200/202* (2013.01); *E04G 23/002* (2013.01)

(56) References Cited

U.S. PATENT DOCUMENTS

| | | | | |
|---|---|---|---|---|
| 3,832,069 | A | 8/1974 | Petsch | |
| 3,989,390 | A * | 11/1976 | Thorner | 401/42 |
| 4,335,481 | A | 6/1982 | Slayman | |
| 4,513,466 | A * | 4/1985 | Keddie et al. | 15/29 |
| 4,575,270 | A * | 3/1986 | Hammond | 401/40 |
| 4,661,052 | A * | 4/1987 | Ruhle | 417/552 |
| 5,619,766 | A * | 4/1997 | Zhadanov et al. | 15/29 |
| 6,595,440 | B2 * | 7/2003 | Moriarty et al. | 239/226 |
| 6,634,050 | B1 * | 10/2003 | Barboza | 15/29 |
| 7,124,962 | B1 | 10/2006 | Fryan et al. | |
| 2004/0086322 | A1 * | 5/2004 | DeLaine, Jr. | 401/289 |
| 2005/0211280 | A1 | 9/2005 | Liu | |
| 2007/0251550 | A1 * | 11/2007 | Erasmus et al. | 134/33 |

OTHER PUBLICATIONS

English Translation of the First Office Action for Counterpart Chinese Patent Application No. 200880007443.6, dated Feb. 23, 2011.

Second Chinese Office Action for corresponding Chinese Patent Application No. 200880007443.6, issued Mar. 27, 2012, 1 page.

* cited by examiner

Soak

Apply cleaner starting at the top of one section with the flow control set on the low flow rate soak setting.

Scrub!

After reaching the bottom of the section, cleanserhas had time to soak in. Start back at the top and scrub with bristles and pulsing jets.

PULSING BRUSH HEAD

NON - ROTATING / ARTICULATING BRUSH HEAD
- STATIONARY MULTICOLORED, MULTI HARDNESS BRISTLES, MULTILEVEL
- MISTING SPRAY FOR SOAP APPLICATION PHASE
- PULSATING WATER JETS FOR CLEANING PHASE

- WATER FLOWS IN AGANST PADDLES, ROTATING WHEEL
- AS PADDLE ROTATES, HOLES IN BASE OPEN & SHUT CAUSING A "PULSING" OF WATER OUTPUT

CLEANING BRUSH WITH PULSING WATER

FIELD OF THE INVENTION

This invention relates to the field of cleaning devices, particularly those devices used to clean exterior architectural surfaces prior to coating or recoating with paint or similar coating materials, such as, but not limited to, stain or other protective and decorative coatings.

BACKGROUND OF THE INVENTION

In the past, various efforts were made to provide cleaning devices for paint preparation tasks, such as sponges, brushes, and pressure washers. While such cleaning devices were generally accepted for preparation of surfaces to be painted or otherwise coated, there remained room for improved devices to ease the difficulty of such a process. Such an improved device has been achieved by the present invention.

SUMMARY OF THE INVENTION

The present invention in one form includes a cleaning brush with pulsing water. The device has a brush head with bristles for dislodging dirt and other debris from the surface to be cleaned. The device also has a first set of liquid exit ports interspersed with the bristles to rinse away dislodged materials. The device also may have a separate set of liquid exit ports for applying a fan-shaped stream of detergent or other liquid cleaning solution mixed with water, for chemically assisting the cleaning process. Liquid may be selectively directed to either the first or the second set of ports, as desired and selected by a user moving a control element remote from the brush head.

The remote control element is arranged to shift water delivery to the brush head between a first state having relatively low pressure, and a second state having relatively high pressure. The first state is used to apply the water and liquid cleaning solution through the second set of ports and the second state is used to deliver water through the first set of ports. The brush head has a valve that automatically senses which of the first and second states exist in the water delivered to the brush head. The valve switches the flow path of the liquid to the second set of ports in the first state, and to the first set of ports in the second state, without the need for any separate mechanical or electrical connection between the brush head and the remote control element. This freedom from the need of a separate connection allows a simple tubular extension with only a single lumen to be used between the remote control element and the brush head. The single lumen carries the liquid (either water or water and cleaning solution) in one of the two states from the remote control element to the brush head and the brush head applies the liquid to the surface to be cleaned.

DETAILED DESCRIPTION

Figure 1:
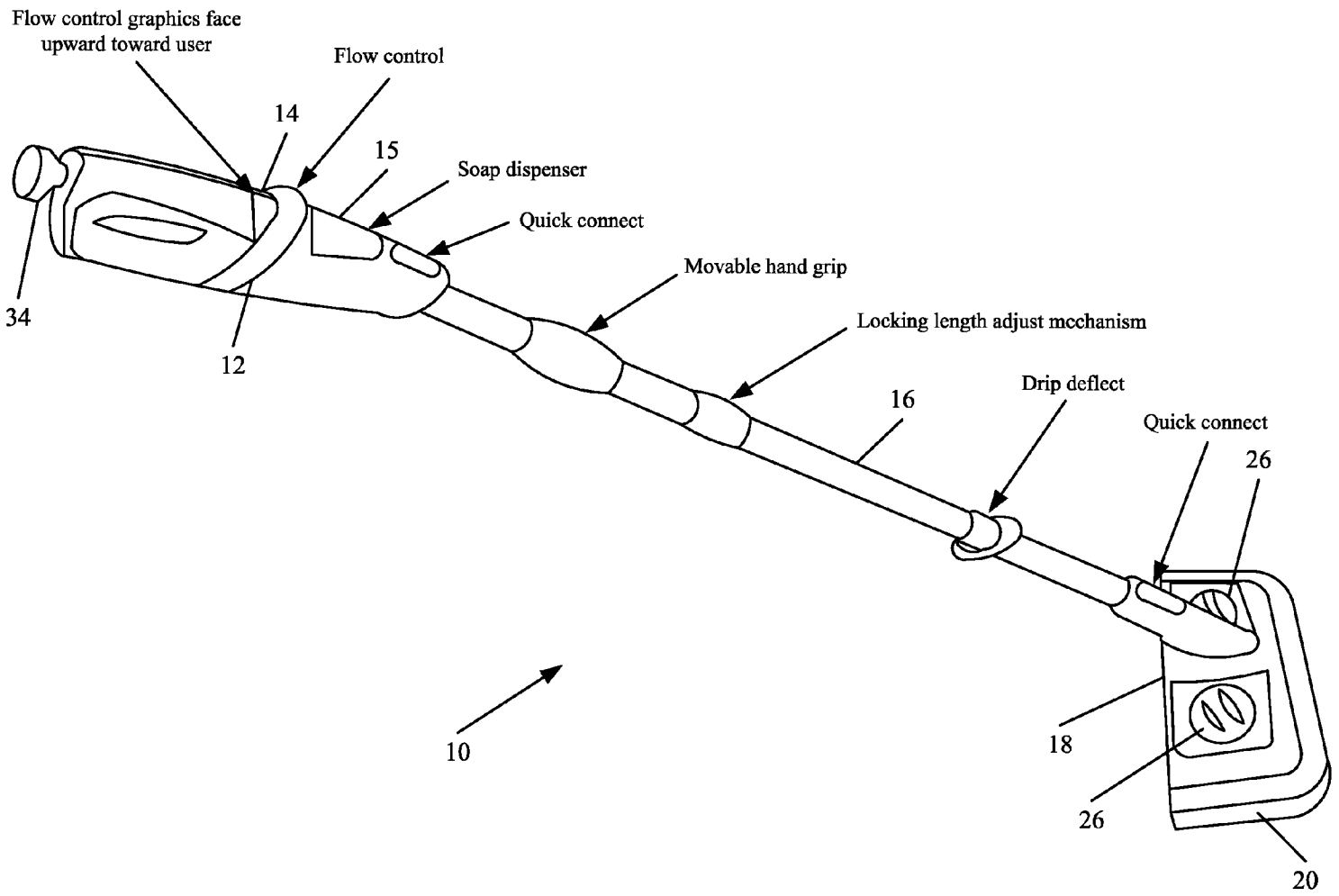
FIG. 1 shows a paint preparation tool for cleaning exterior surfaces prior to painting. The tool has an elongated tube connecting a proximal handle with a remote control operator to a distal brush head.

Referring now to the Figures, and most particularly to FIG. 1, a paint preparation tool 10 may be seen. Tool 10 has a proximal handle 12 with a remote control element 14 and a liquid cleaner reservoir 15. Tool 10 also has a single lumen extension tube 16 connected between the handle 12 and a brush head 18.

Figure 2:
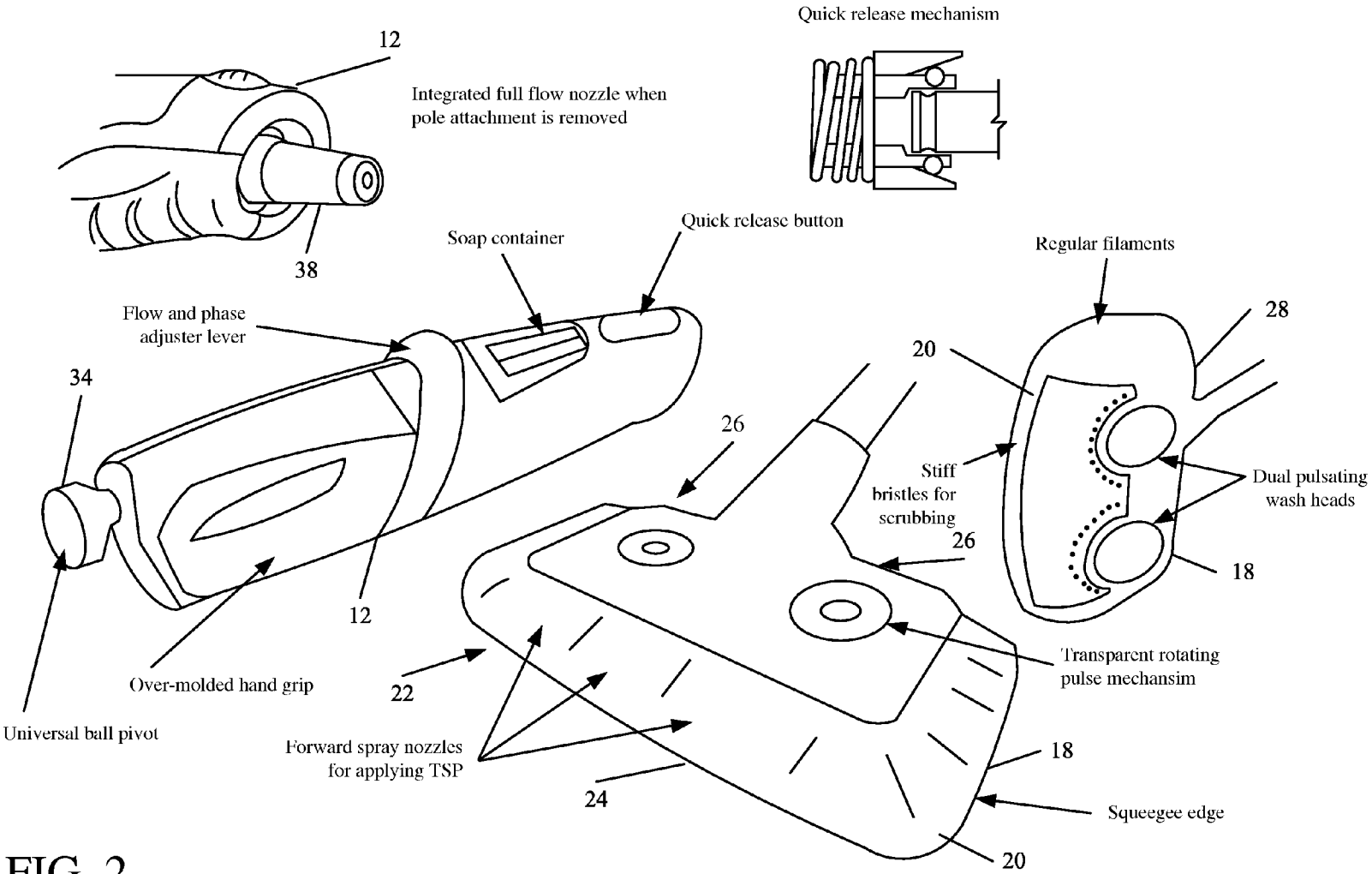
FIG. 2 shows various views of details of the proximal handle and the distal brush head.

Referring now also to FIG. 2, the handle may be detachable from the tube 16 to provide a rinse spray function. The head 18 may include bristles 20 for scrubbing and a set 22 of forwardly directed spray nozzles 24 for spraying cleaner. The head 18 may also have one or more pulsating wash heads 26 to deliver pulsating water through a baseplate 28 containing the bristles 20.

Figure 3:
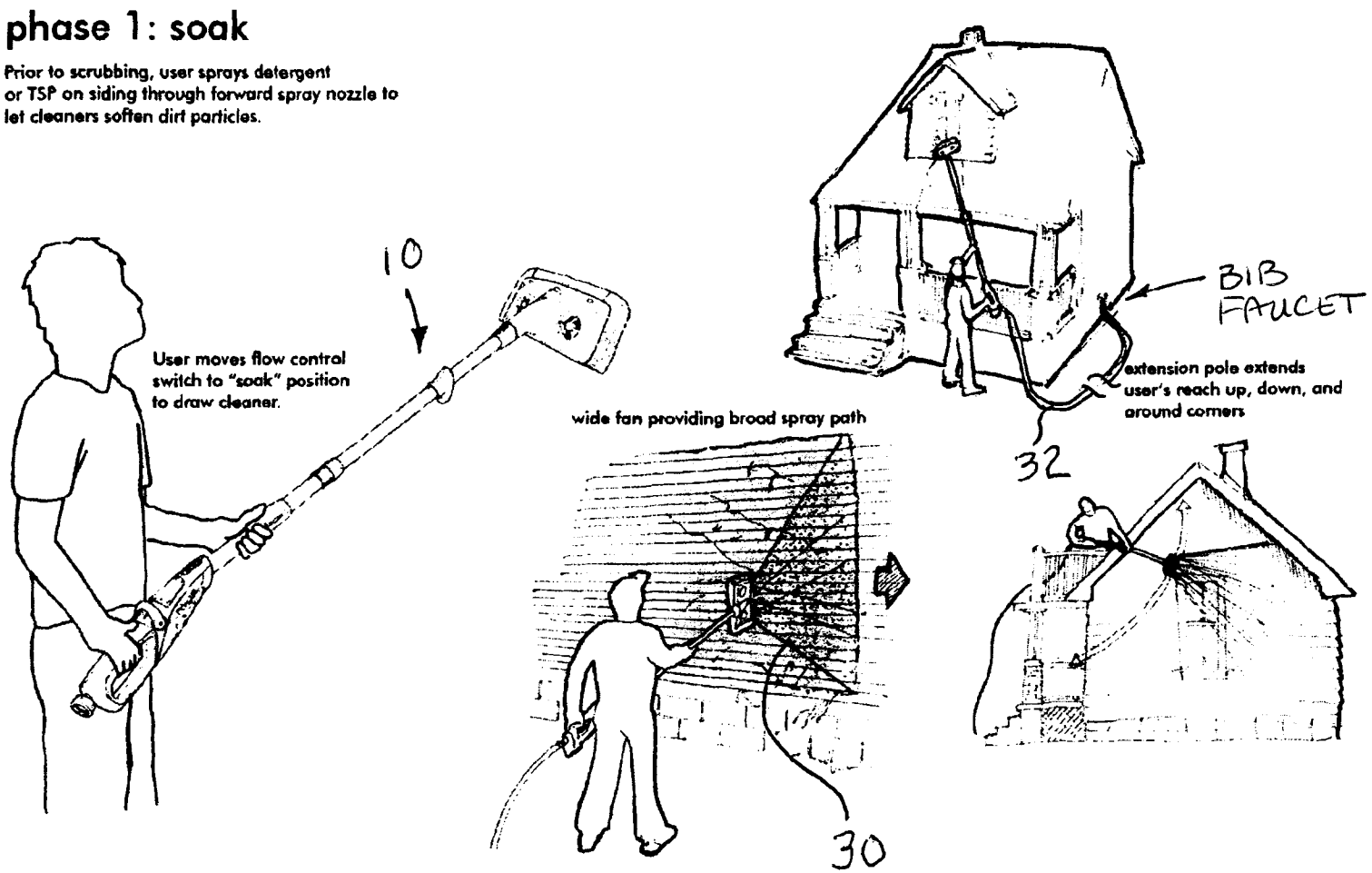
FIG. 3 shows various views of a "soak" mode of operation for the paint preparation tool of the present invention.

Referring now to FIG. 3, the tool 10 may be used in a first mode or Phase 1 to soak or wet the surface with liquid cleaner diluted with water. In this mode, a user may move the remote control element 14 to a SOAK position to draw liquid cleaner from the reservoir 15 and deliver it via a diluent water stream through nozzles 24 to a surface to be cleaned. The spray emitted from the first set 22 of nozzles or ports 24 may be in the form of a fan spray 30. Tube 16 may be extended or retracted for convenience of the user. Alternatively or additionally, alternate length tubes may be used to increase or decrease the "reach" of tool 10 for the convenience of the user. A conventional garden hose 32 may be used to supply water to the tool via a conventional garden hose fitting 34.

Figure 3A:
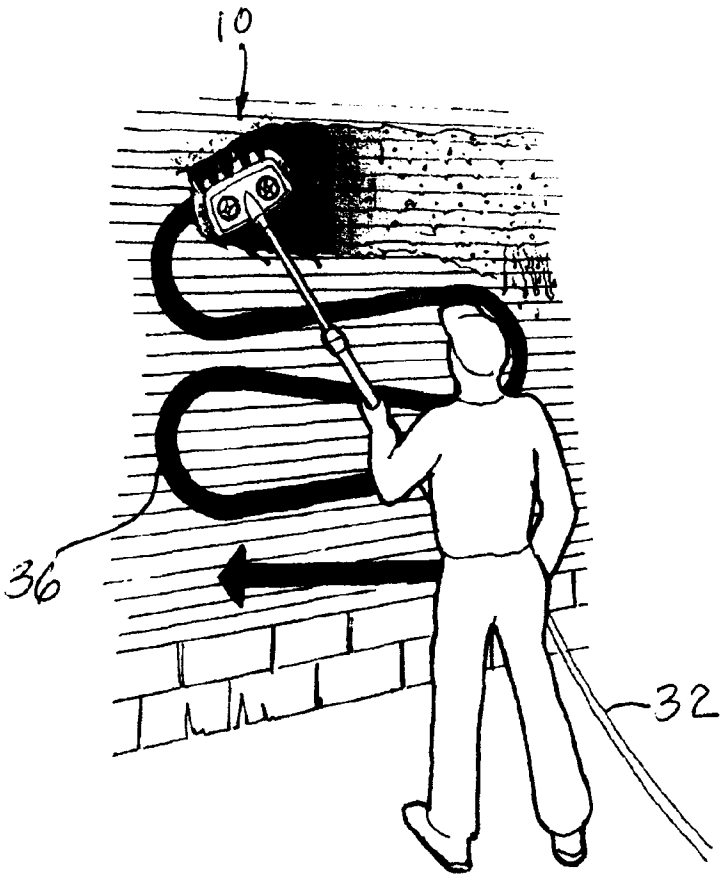
FIG. 3A shows details of the "soak" mode of operation of FIG. 3.
Figure 3A:
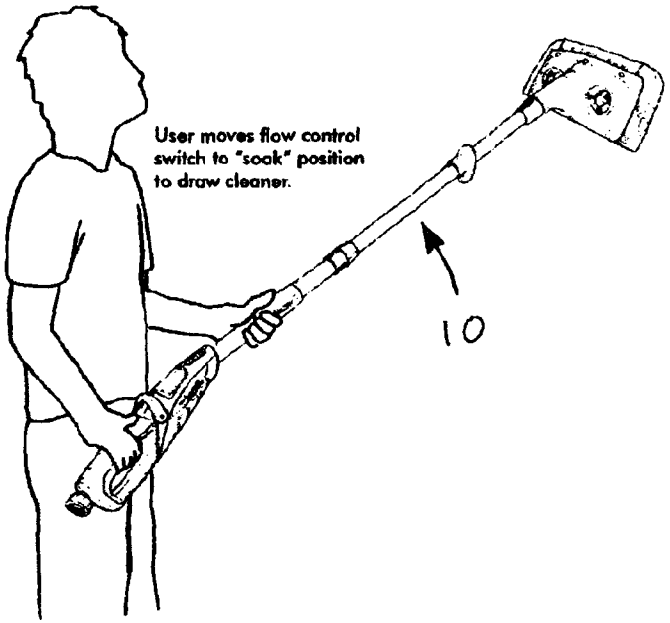

Referring now to FIG. 3A, during the SOAK phase a back and forth motion 36 may be used to apply the cleaner to the surface being prepared.

Figure 4:
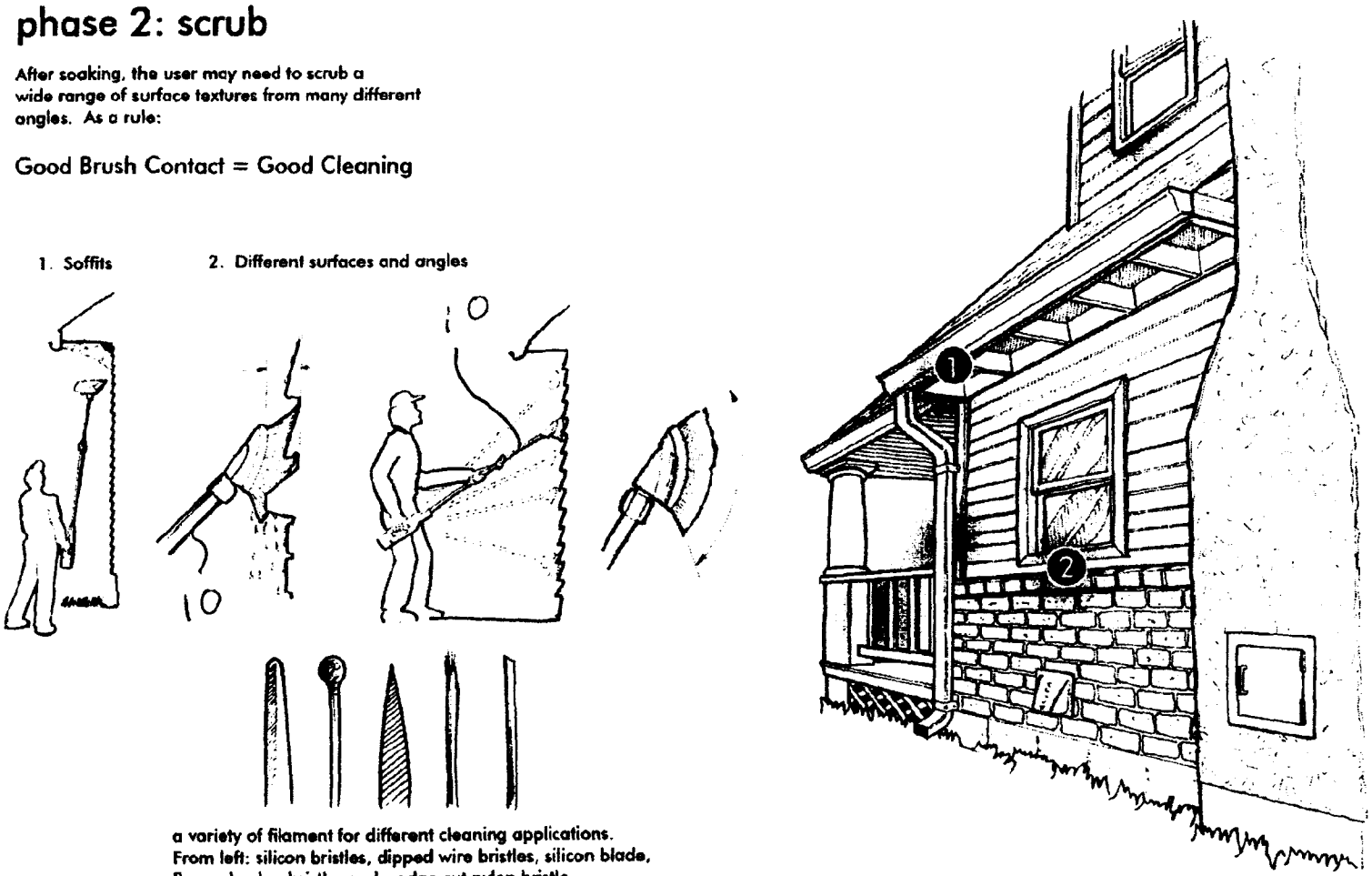
FIG. 4 shows various aspects of a "scrub" mode of operation for the paint preparation tool of the present invention.

Referring now to FIG. 4, a second mode or phase 2, SCRUB, may be used to scrub the surface to remove dirt. As illustrated, both soffits and vertical surfaces of varying surface textures and angles may be cleaned with tool 10. In this mode, the remote control element 14 is preferably moved to a SCRUB position, corresponding to delivering only water to the surface to be cleaned, with the water delivered through a second set of ports in between the tufts of bristles 20, as will be shown infra.

Figure 4A:
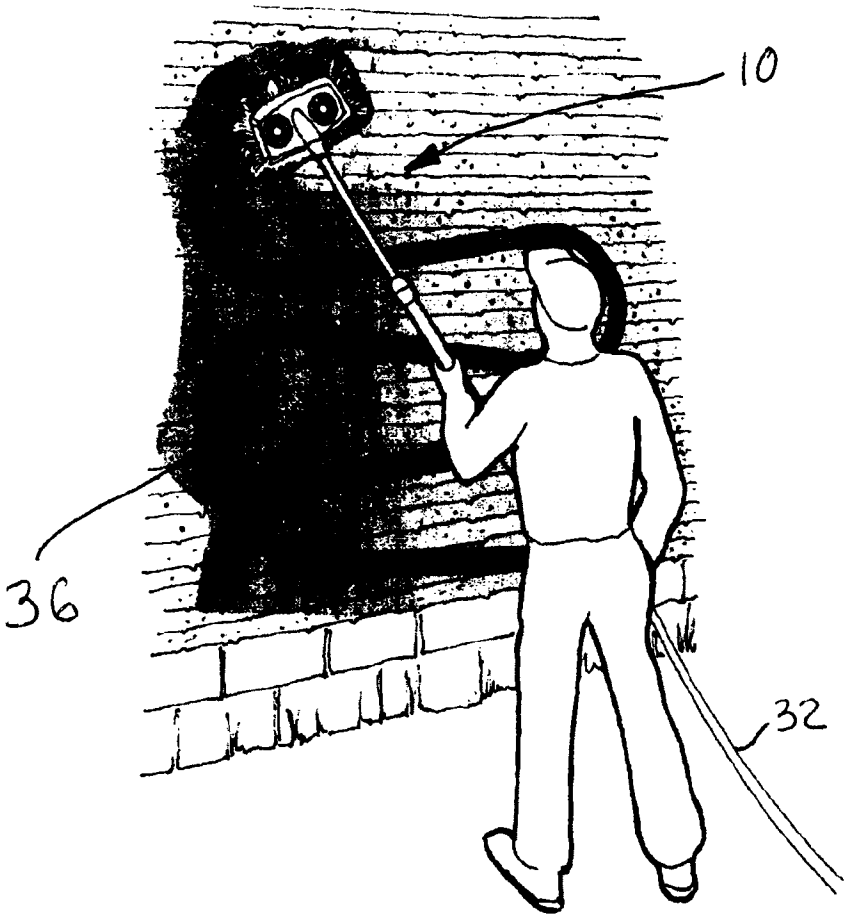
FIG. 4A shows details of the "scrub" mode of operation of FIG. 4.

Referring now to FIG. 4A, during the SCRUB phase, a back and forth motion the same or similar to motion 36 may be used. The bristles 20 and pulsing water jets are used in this phase.

Figure 5:
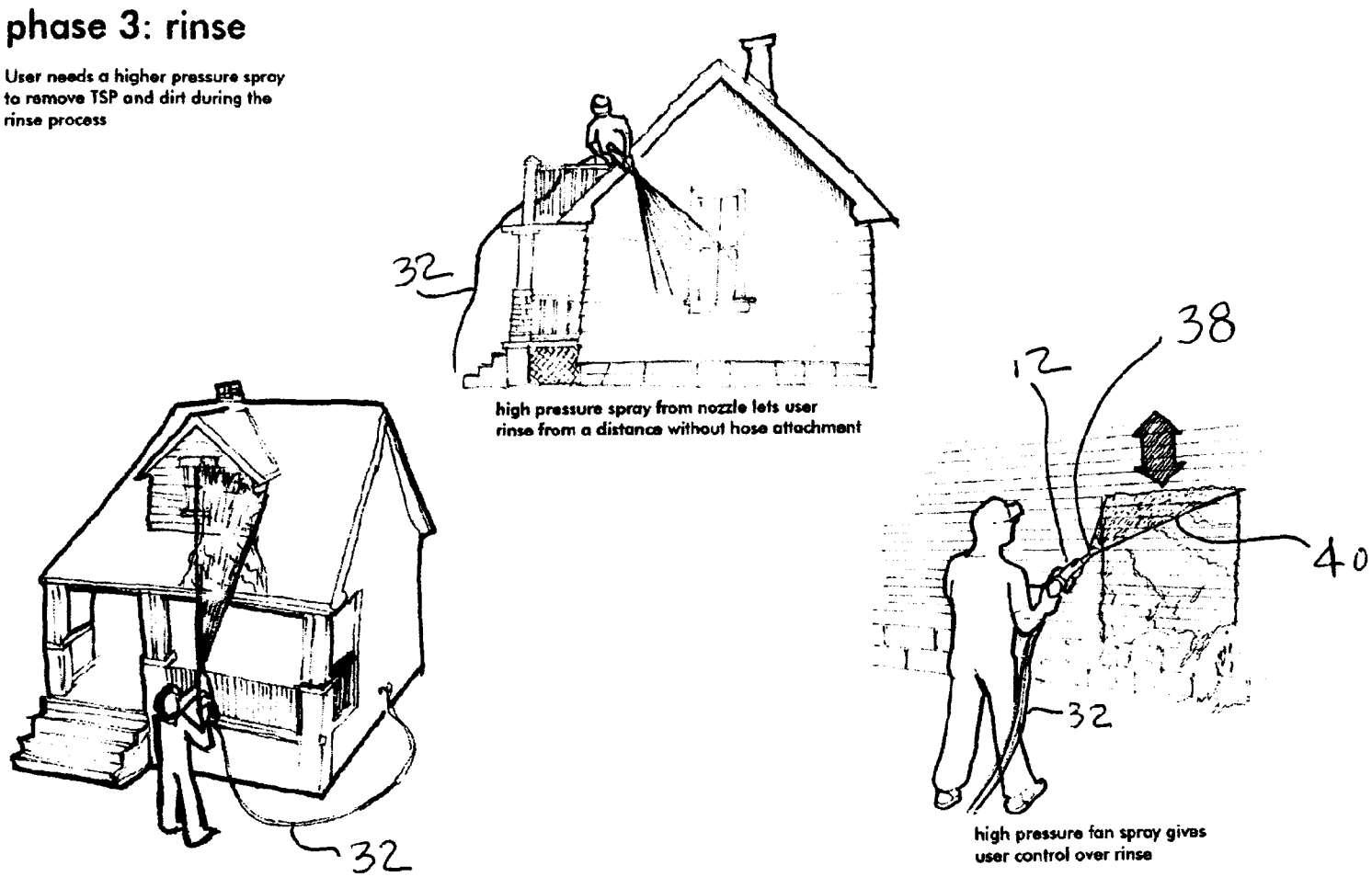
FIG. 5 shows various aspects of a "rinse" mode of operation.

In FIG. 5, a third mode or phase 3, RINSE, is to remove the cleaner and any dirt loosened by the SCRUB phase using a higher pressure spray by removing the pole 16 and brush head 18 from the handle 12 and using a built in nozzle 38 in the handle 12. The nozzle 38 may provide a fan shaped pattern 40, or it may provide a cone shaped pattern (not shown)

Figure 5A:
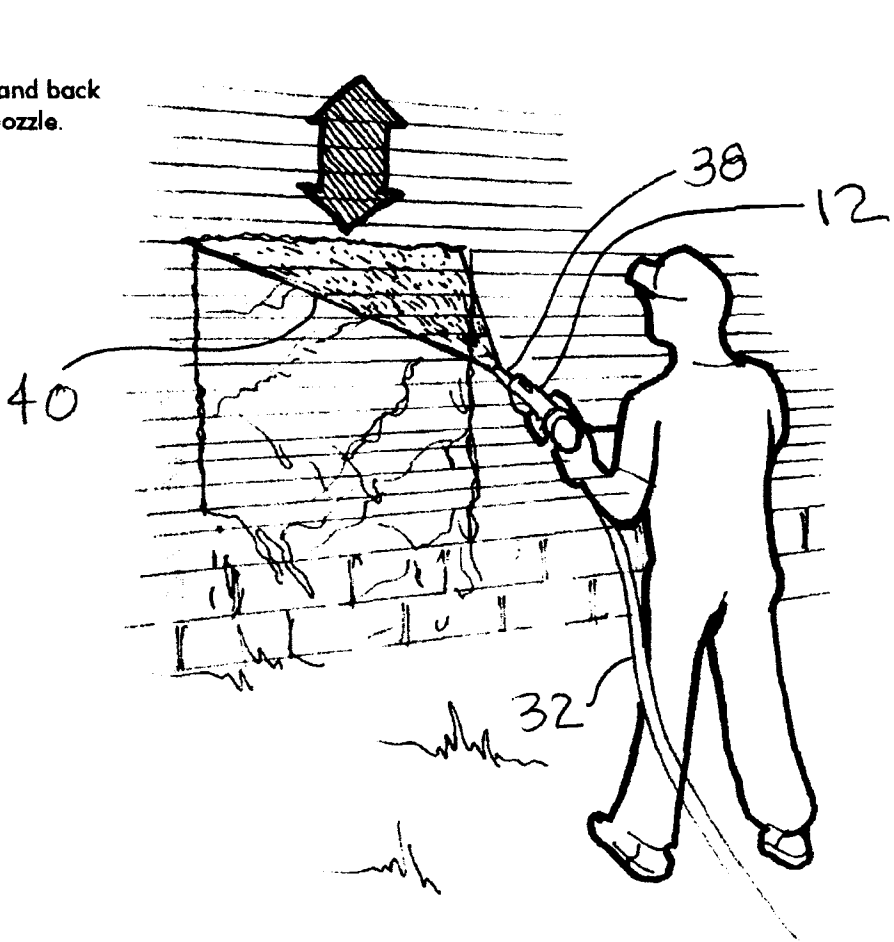
FIG. 5A shows an enlarged view of the "rinse" mode of operation of FIG. 5.

FIG. 5A illustrates the fan shaped spray pattern 40 when using the handle 21 and nozzle 38 alone.

Figure 6:
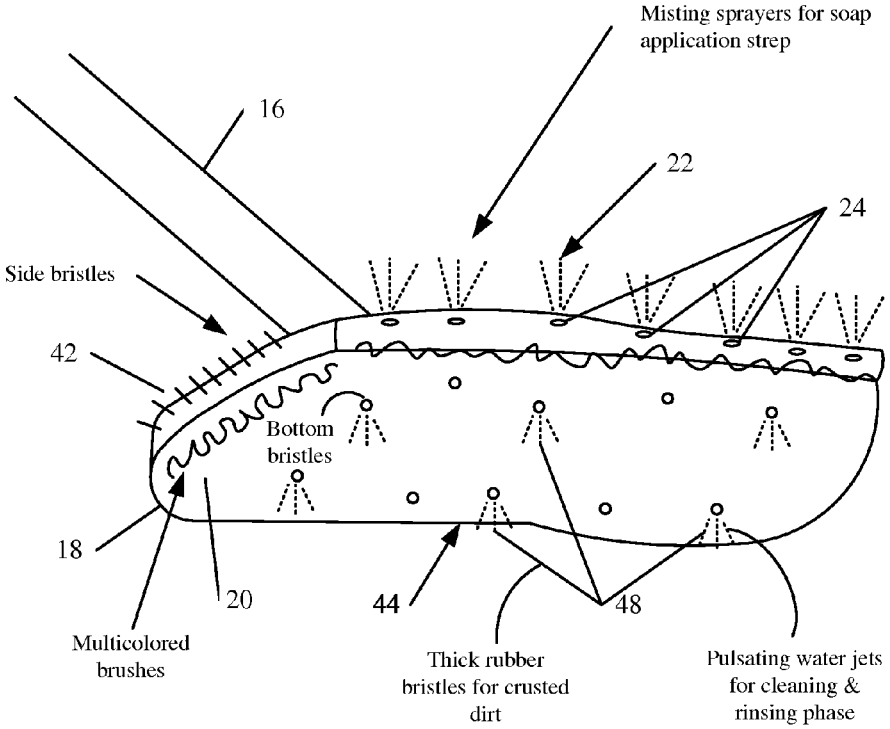
FIG. 6 shows various details of the brush head useful in the practice of the present invention.

FIG. 6 illustrates various features that may be present on the brush head 18, including side bristles 42, and bottom bristles 20. Also illustrated are the first set 22 of nozzles 24, and a second set 44 of nozzles 46 useful for cleaning in the SCRUB phase, with a plurality of pulsing water jets 48 being emitted from between the tufts of bottom bristles 20.

Figure 7:
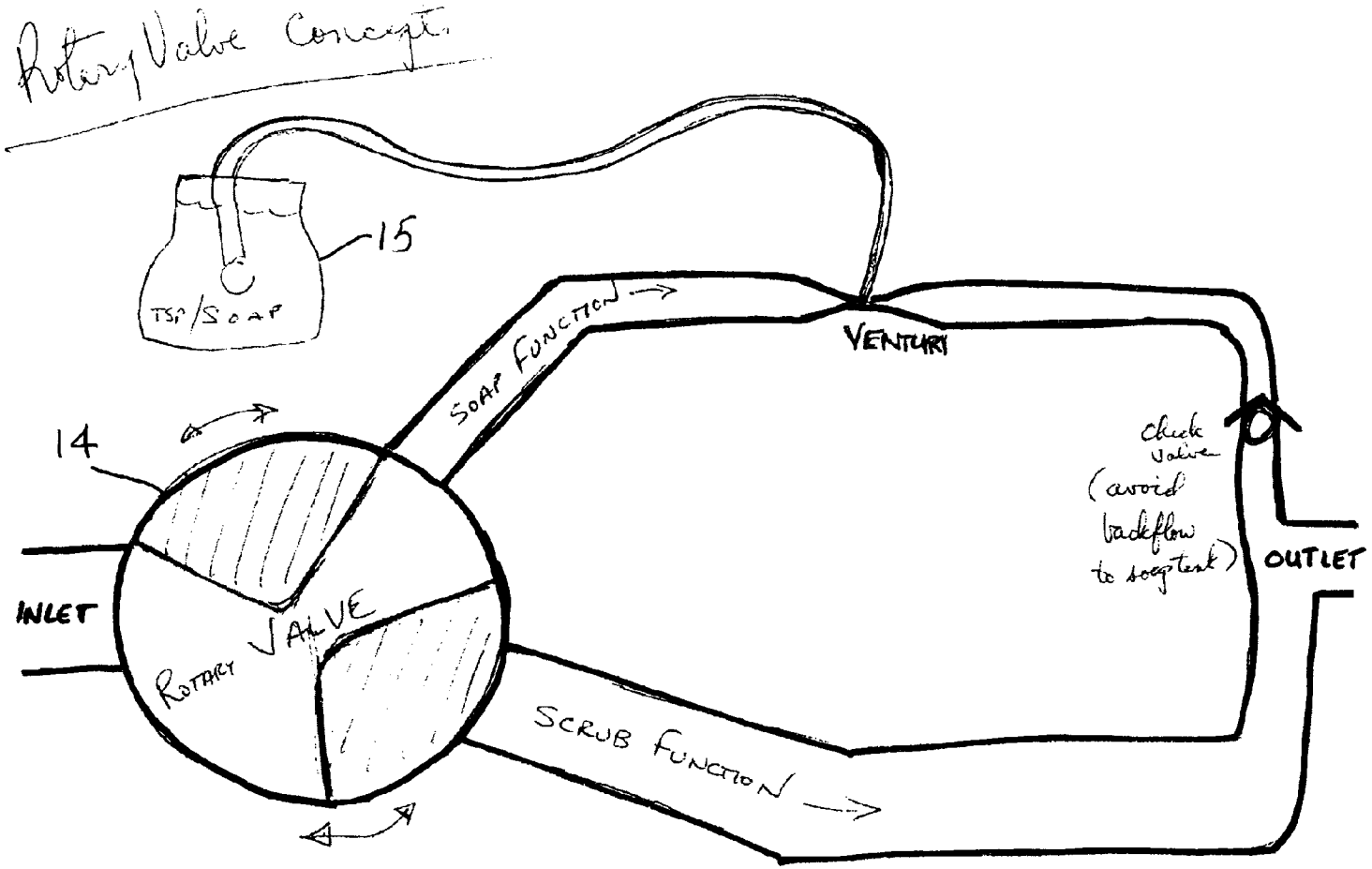
FIG. 7 shows a simplified hydraulic schematic of various flow paths for the present invention.

FIG. 7 is a simplified fluid schematic illustrating switchable paths for liquid cleaner and water. The inlet is at the garden hose fitting 34 and the outlet delivers water from the handle 12 to the brush head 18 or the nozzle 38.

Figure 8:
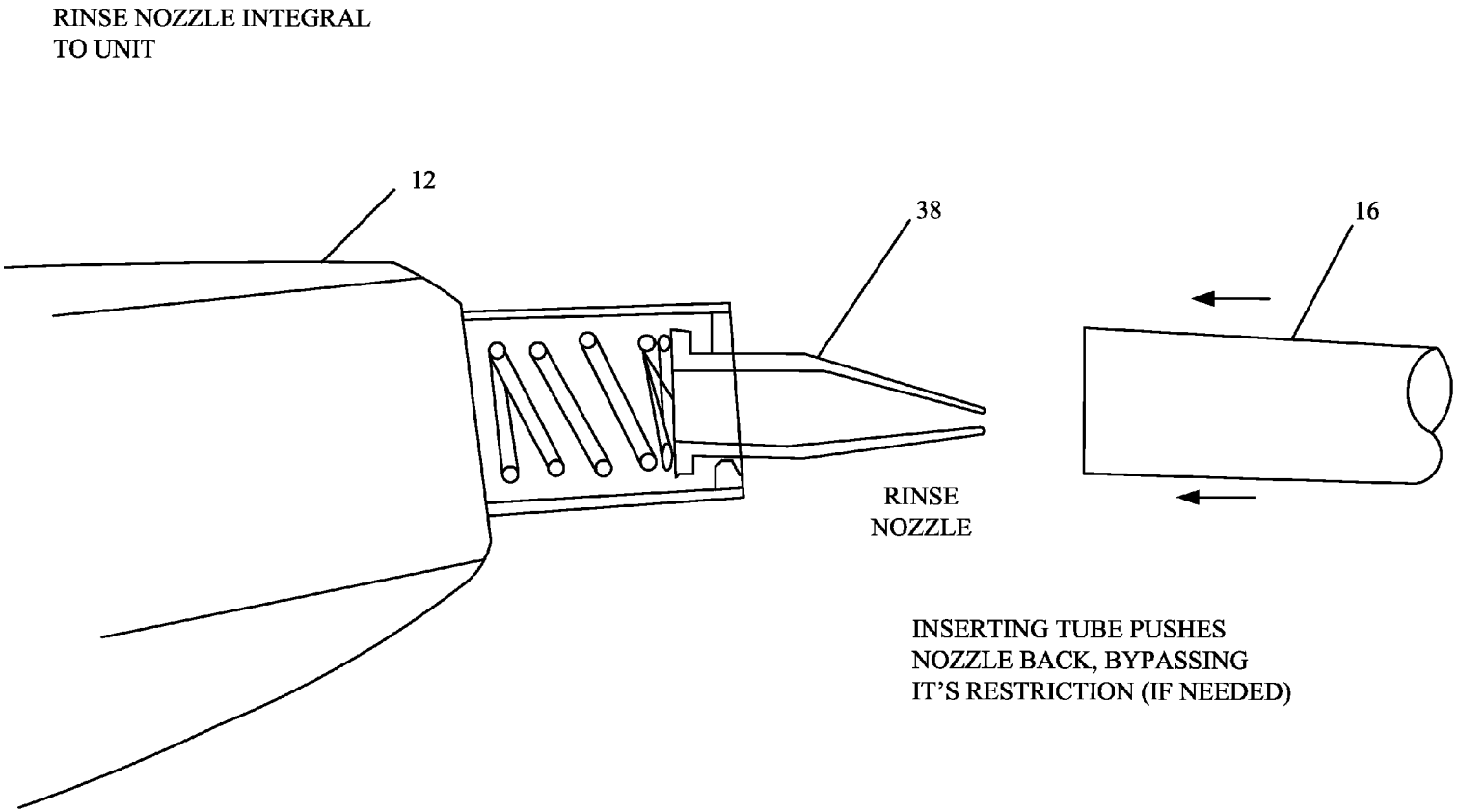
FIG. 8 shows a rinse nozzle useful in the practice of the present invention.

FIG. 8 illustrates one embodiment for the fan nozzle 38 for the RINSE mode.

Figure 9:
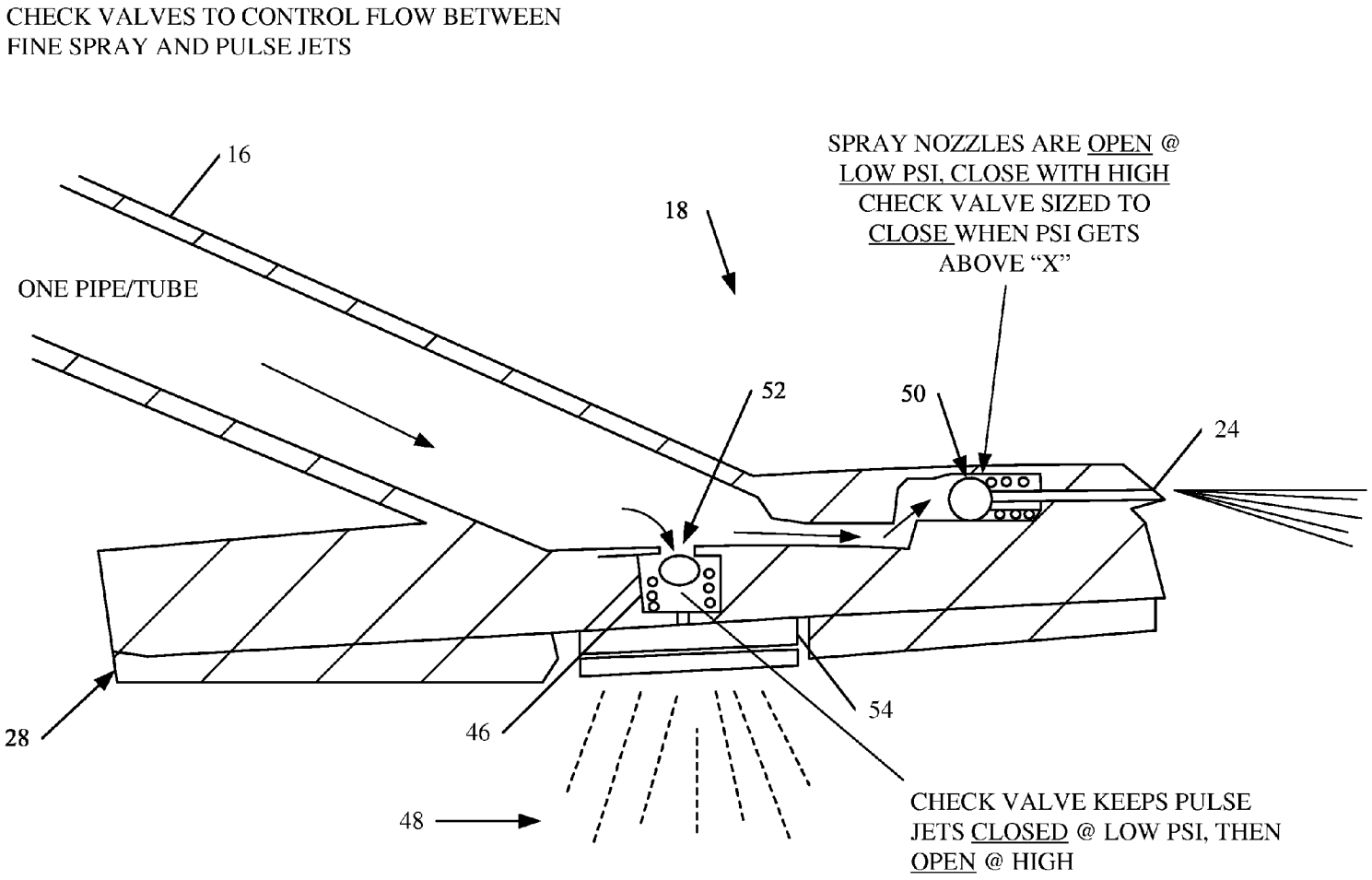
FIG. 9 shows a side elevation view of the brush head shown in a simplified section view to illustrate certain aspects of the present invention.

FIG. 9 is a simplified schematic side section view of the brush head 18 illustrating an arrangement of a two valve system: A first spring loaded valve 50 is OPEN at low pressure to allow the liquid cleaner (delivered at low pressure) to be sprayed out the front of the brush head. This valve 50 is CLOSED when operation is switched to "water only" (no cleaner), with the water delivered to the brush head at higher pressure. A second spring loaded valve 52 remains CLOSED at low pressure (because of the spring force) to prevent cleaner from being delivered through the pulse jet ports 44. The second valve 52 is OPEN under the higher pressure when water only is delivered to the brush head 18, allowing the water to flow to the pulse jet outlets 44. A rotary shutter 54 is driven by water passing through valve 52 to provide the pulsing action at the second set 44 of nozzles 46.

Figure 10:
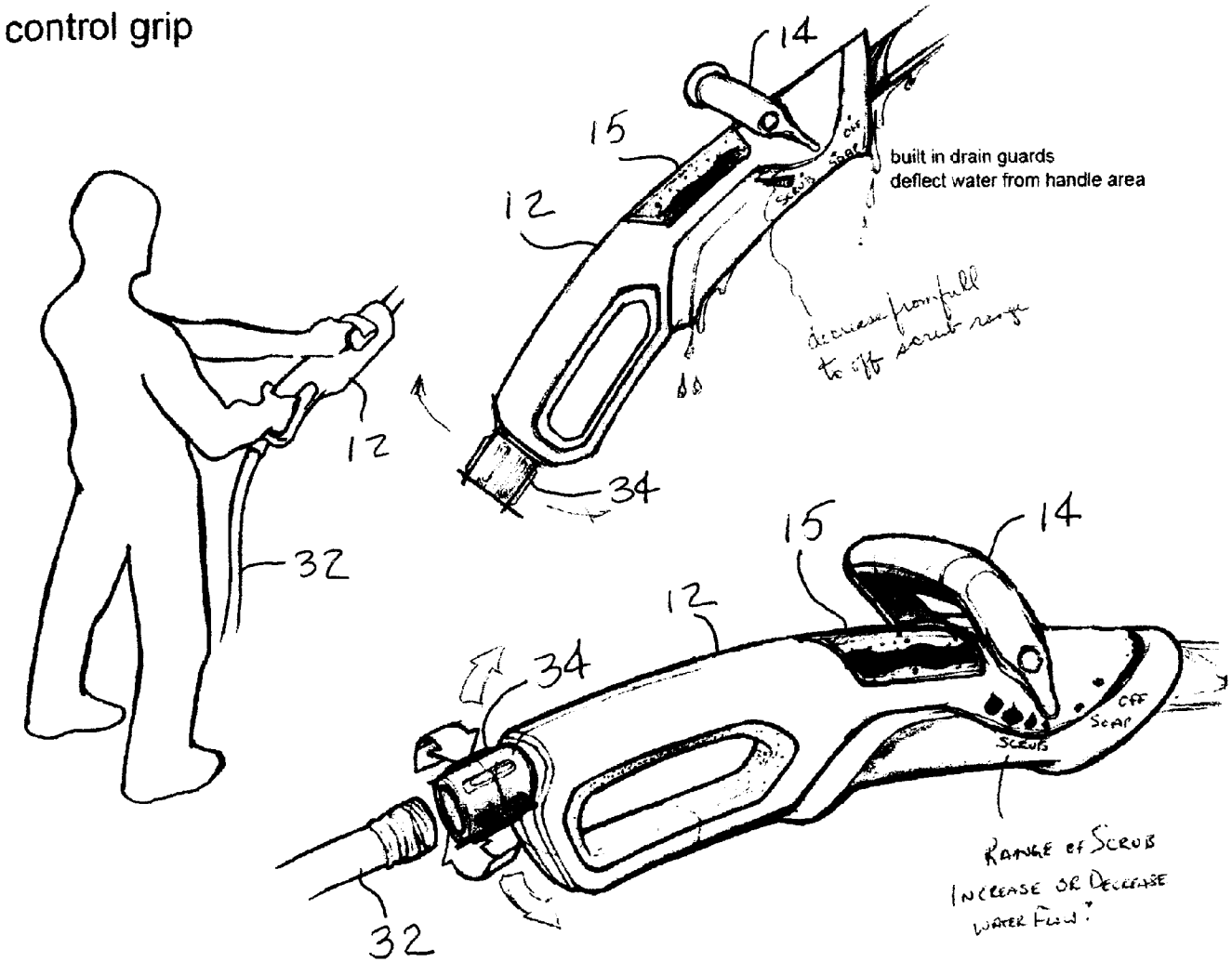
FIG. 10 shows certain aspects of the handle and a remote control element useful in the practice of the present invention.

FIG. 10 shows a selector and mode indicator for the remote control element 14 on the handle 12 and permits a user to switch between the low pressure liquid cleaner delivery and the higher pressure water-only delivery, and may include an OFF position, and also may include more than one "higher pressure" setting for water-only delivery.

Figure 11:
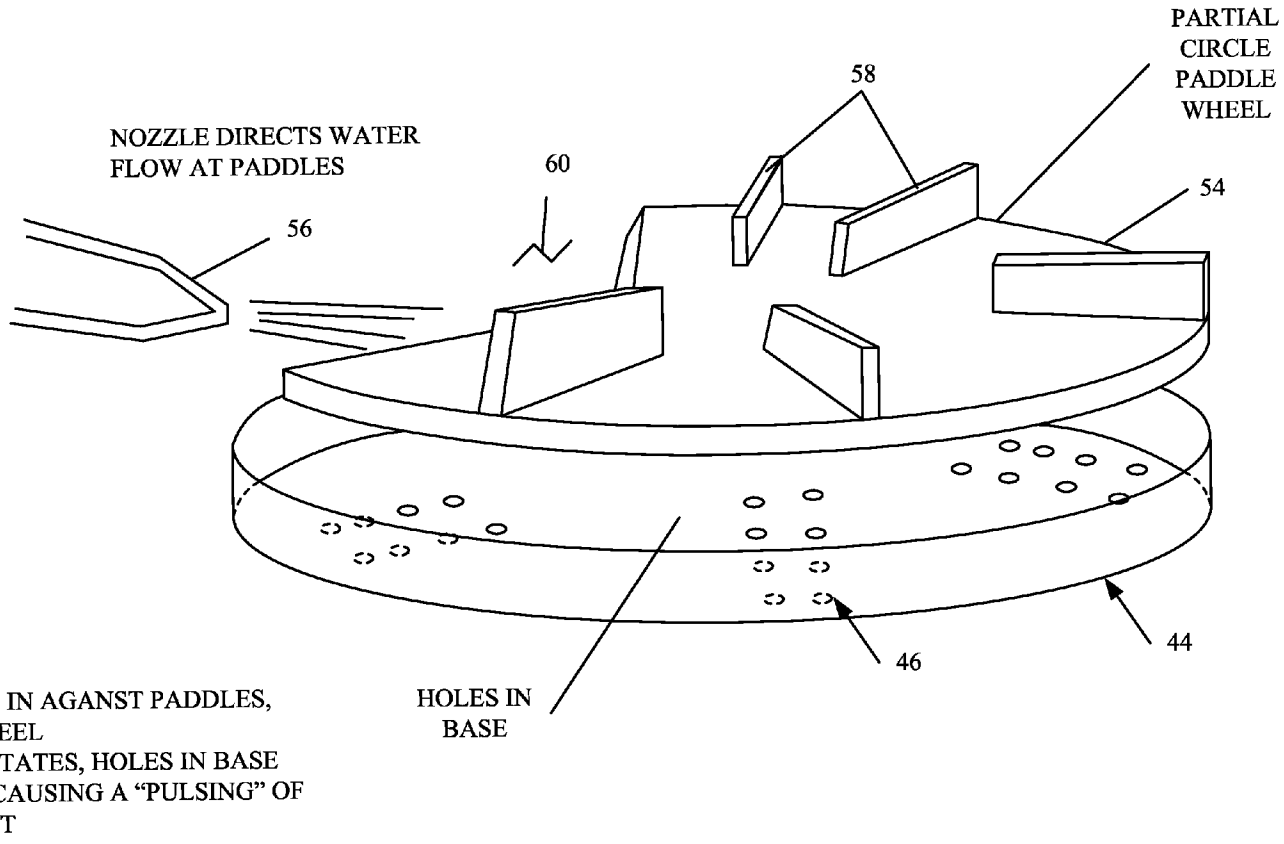
FIG. 11 shows a simplified free body diagram of a nozzle, paddle wheel, and a portion of a base with holes to allow passage of the water after impelling the paddle wheel.

FIG. 11 shows parts from a "pulse jet" mechanism including an internal nozzle 56 delivering water at one or more paddles 58 on a rotatable paddle wheel or shutter 54. Shutter 54 has a segment removed in region 60 which allows selective water flow through the mechanism when the removed segment 60 is aligned with fluid flow passages 46, and which blocks water flow through passages or ports 46 when the solid portion of the shutter 54 blocks the fluid flow path from the nozzle 56 to the ports 46.

Figure 12:
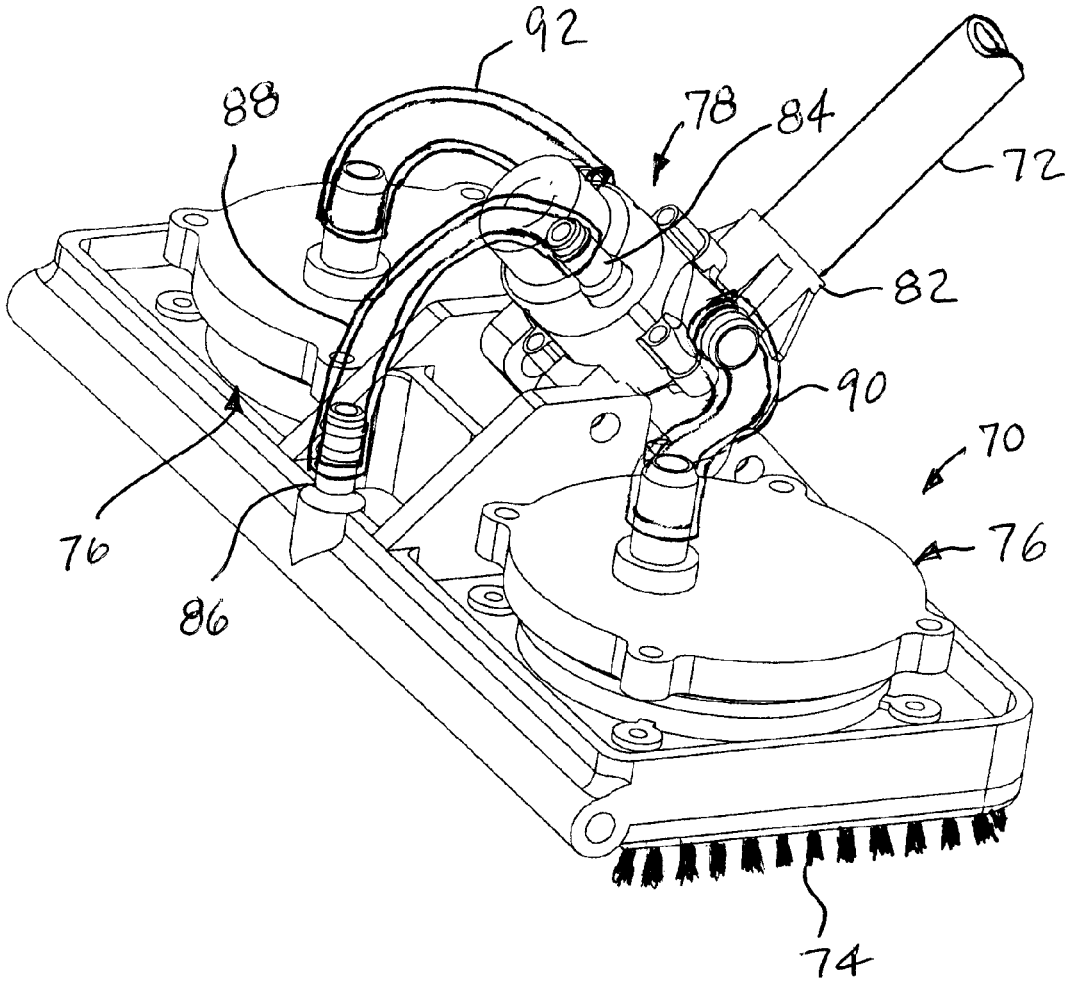
FIG. 12 is a perspective view of a prototype embodiment of the brush head portion of the present invention.
Figure 13:
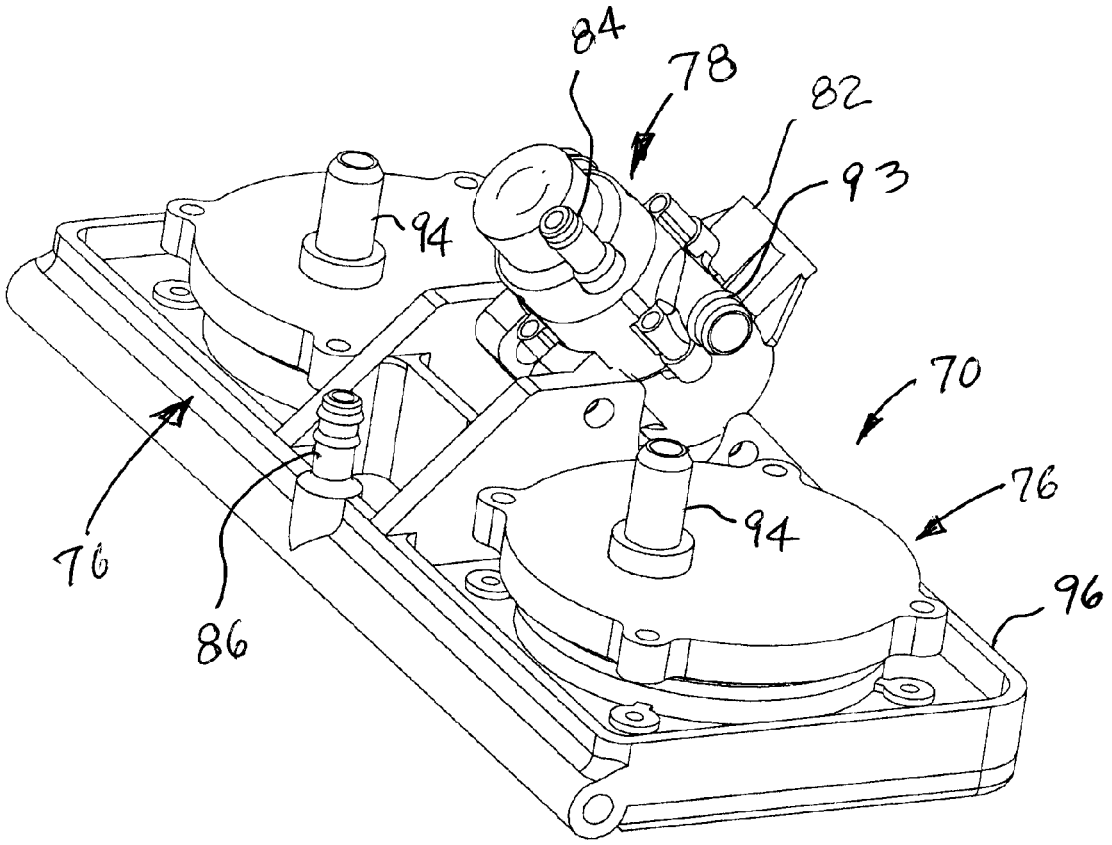
FIG. 13 is a view similar to that of FIG. 12, except with parts omitted for clarity.
Figure 13A:
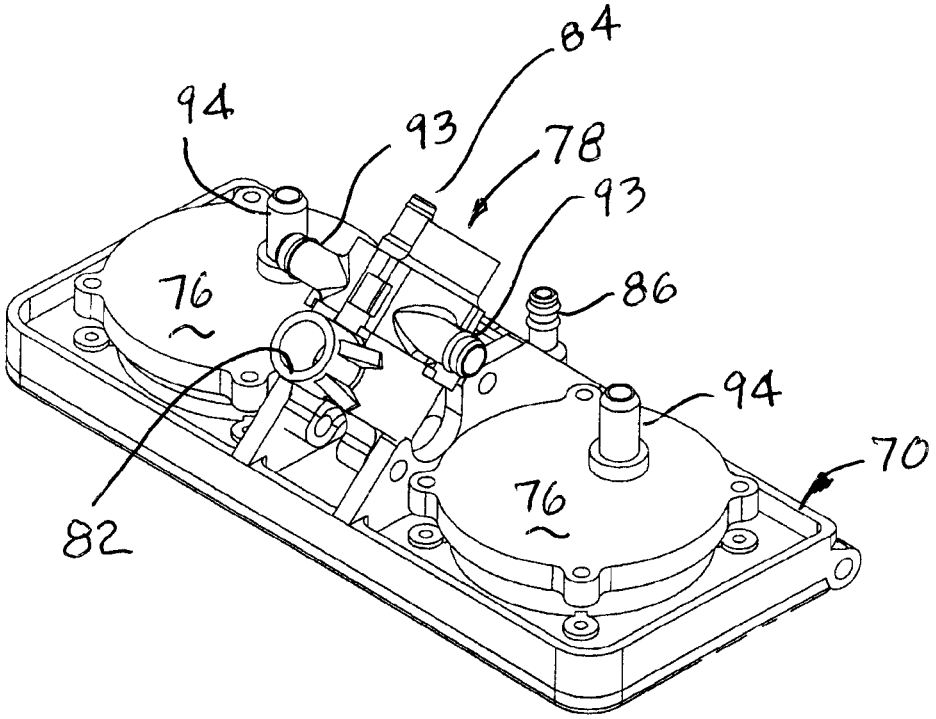
FIG. 13A is another perspective view of the assembly shown in FIG. 13.
Figure 13B:
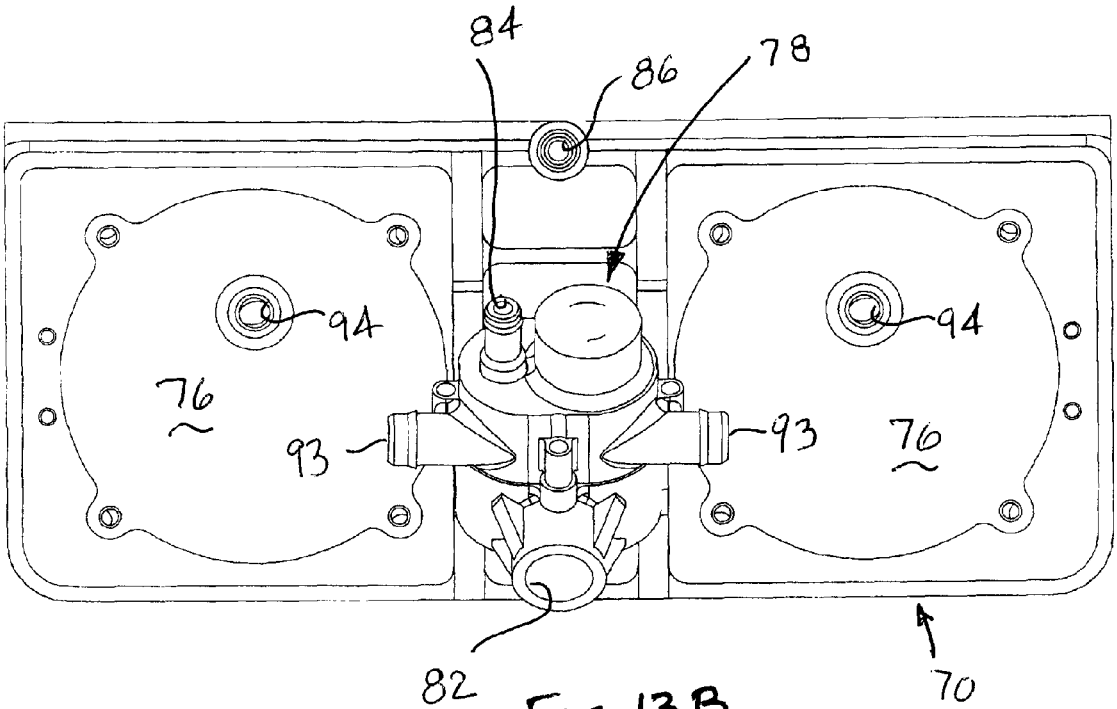
FIG. 13B is a top view of the assembly shown in FIG. 13.
Figure 13C:
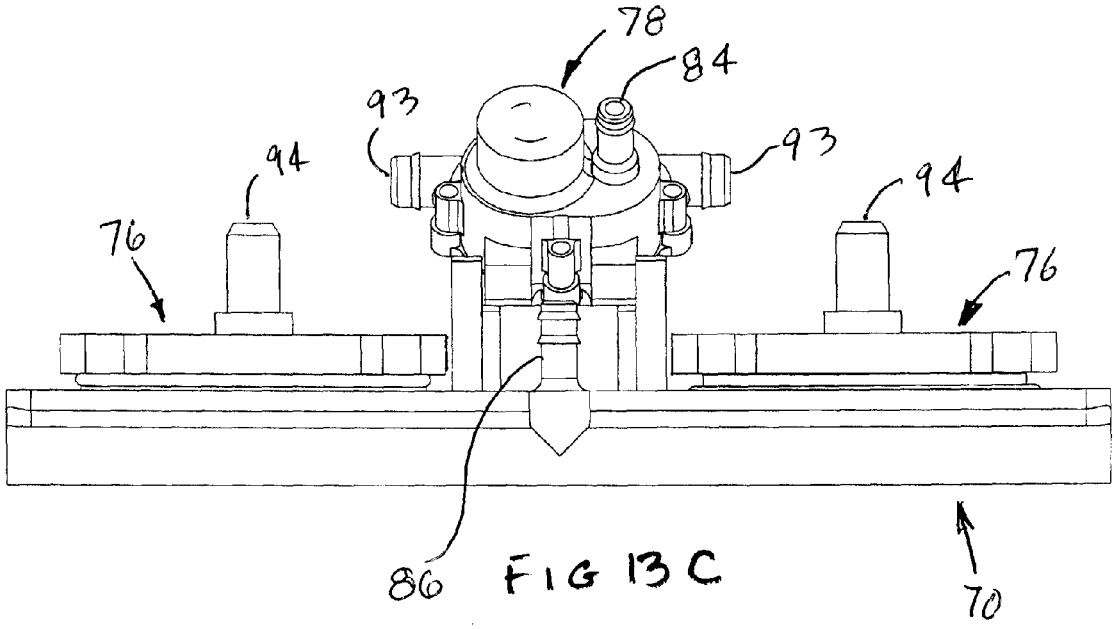
FIG. 13C is a front elevation view of the assembly shown in FIG. 13.
Figure 13D:
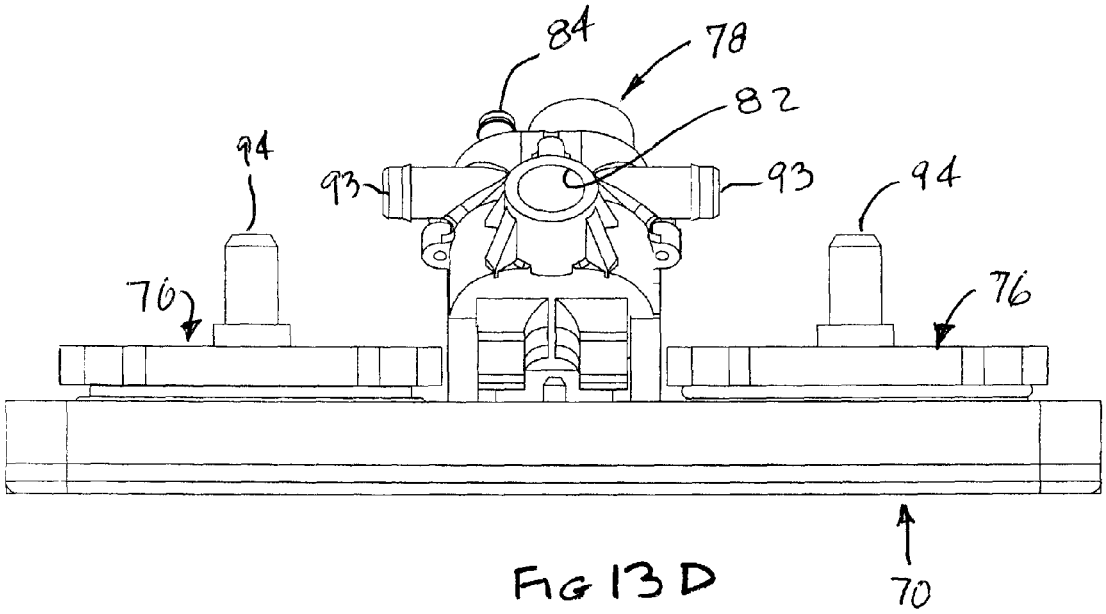
FIG. 13D is a rear elevation view of the assembly shown in FIG. 13.
Figure 13E:
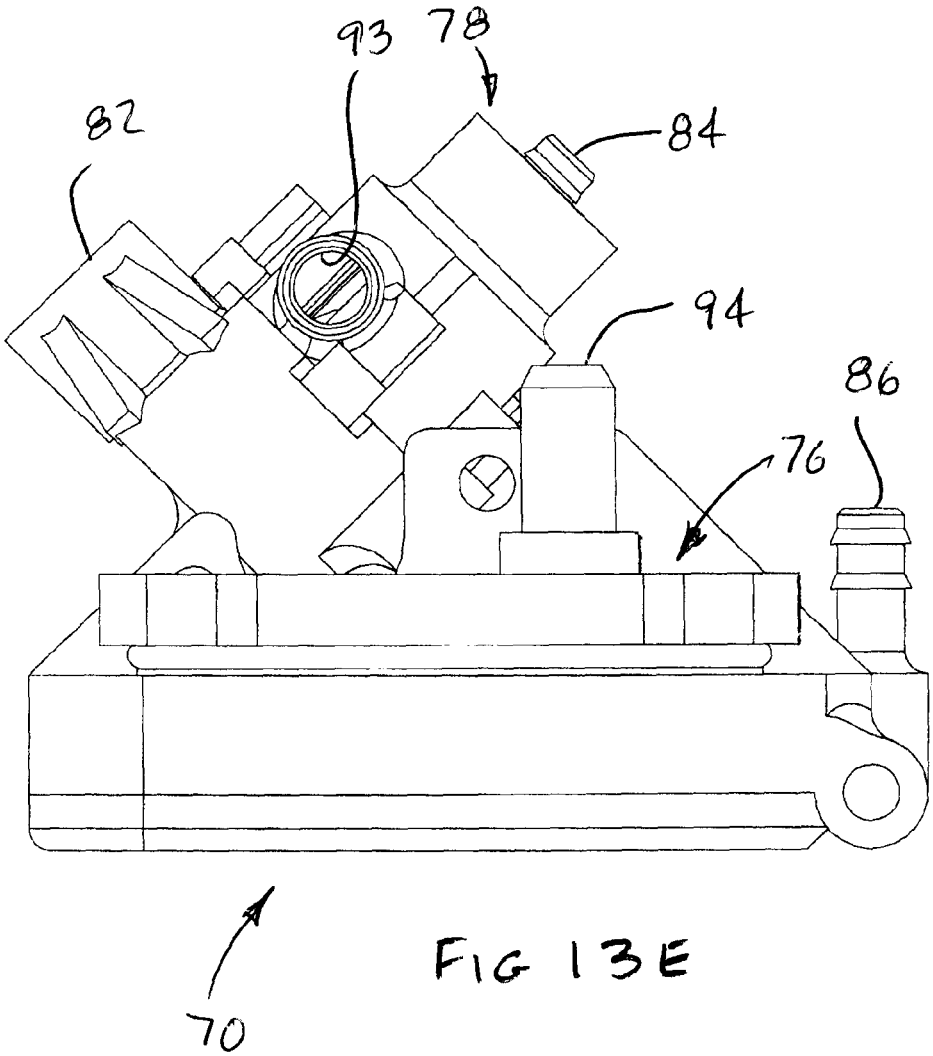
FIG. 13E is a right side elevation view of the assembly shown in FIG. 13.
Figure 13F:
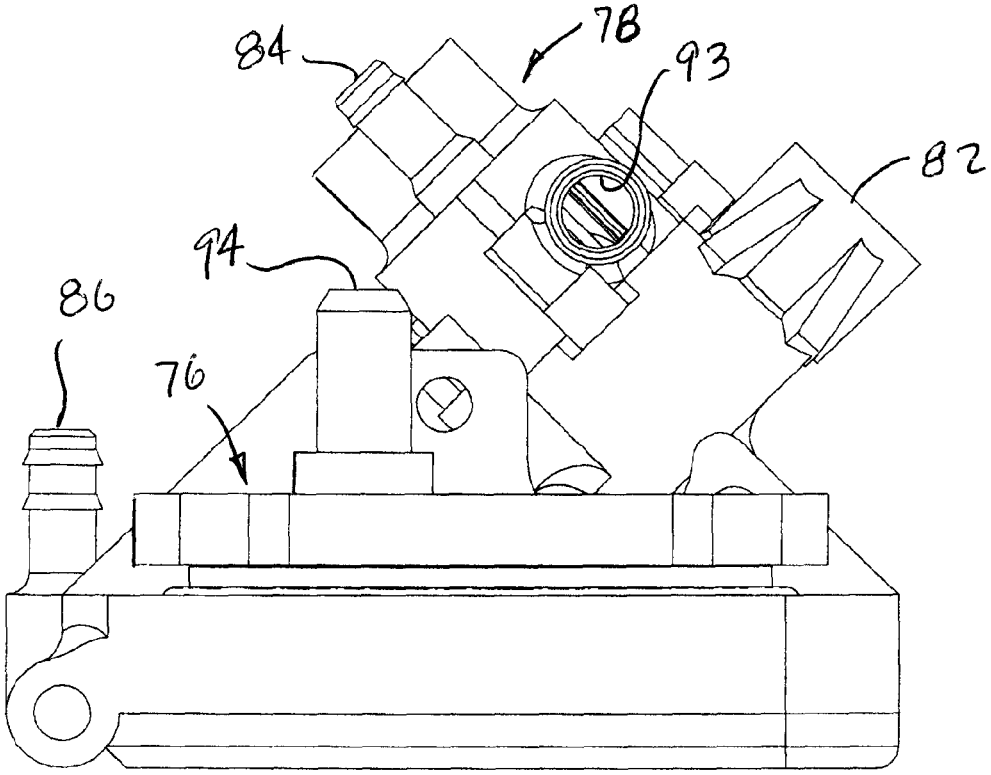
FIG. 13F is a left side elevation view of the assembly shown in FIG. 13.

Referring now to FIGS. 12-56, and most particularly to FIGS. 12-13F, a prototype brush head 70 may be seen. Prototype brush head 70 corresponds to concept brush head 18. Head 68 is connected to a hollow tube 72, which corresponds to tube 16. Head 70 has bristles 74 and a pair of water pulse delivery heads 76. A mode valve 78 controls the operation of the brush head and selectively delivers water to either a first set of nozzles 80, shown in FIG. 15 (corresponding to nozzle set 22) or to the water pulse deliver heads 76. Mode valve 78 has an input 82 receiving water from the tube 72 and first outlet 84 connected to a first nozzle manifold inlet 86 via tube 88. Tubes 90 and 92 connect, respectively, each of a pair of second outlets 93 of the mode valve 78 to each of the water pulse delivery head inlets 94.

Figure 14:
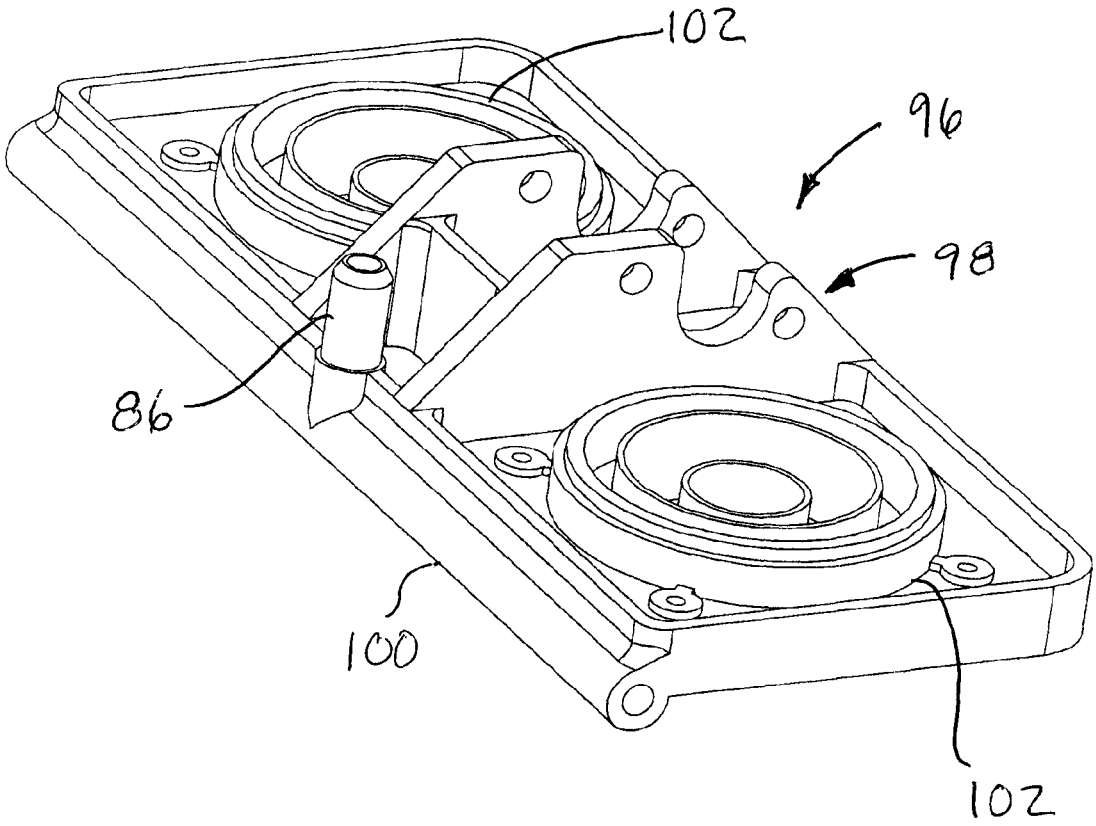
FIG. 14 is a first perspective view from above of a baseplate for the brush head useful in the practice of the present invention.
Figure 14A:
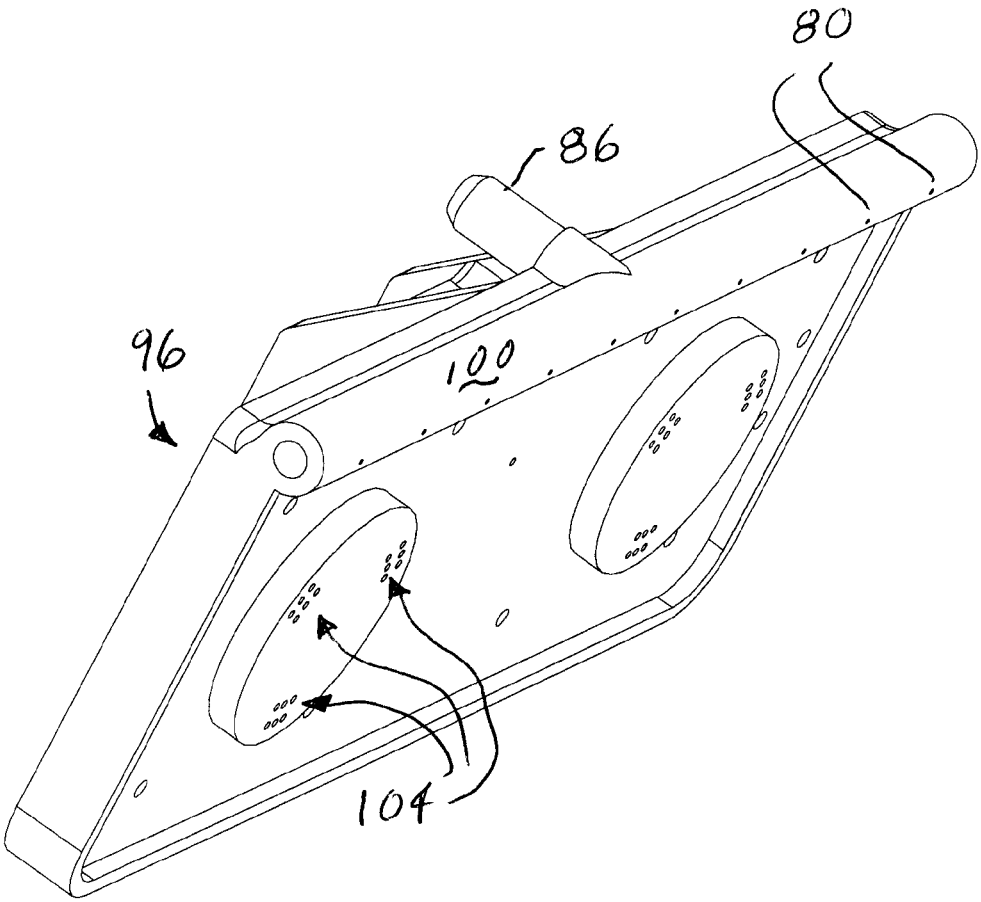
FIG. 14A is a second perspective view of the baseplate of FIG. 14.
Figure 15:
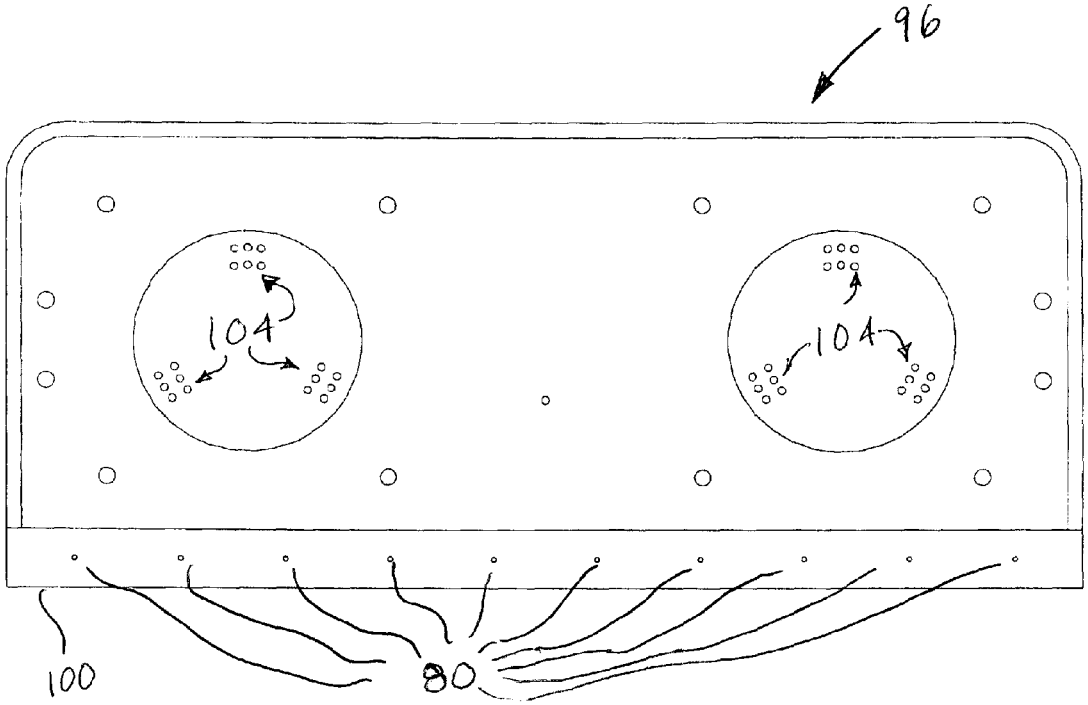
FIG. 15 is a bottom view of the baseplate of FIG. 14.
Figure 16:
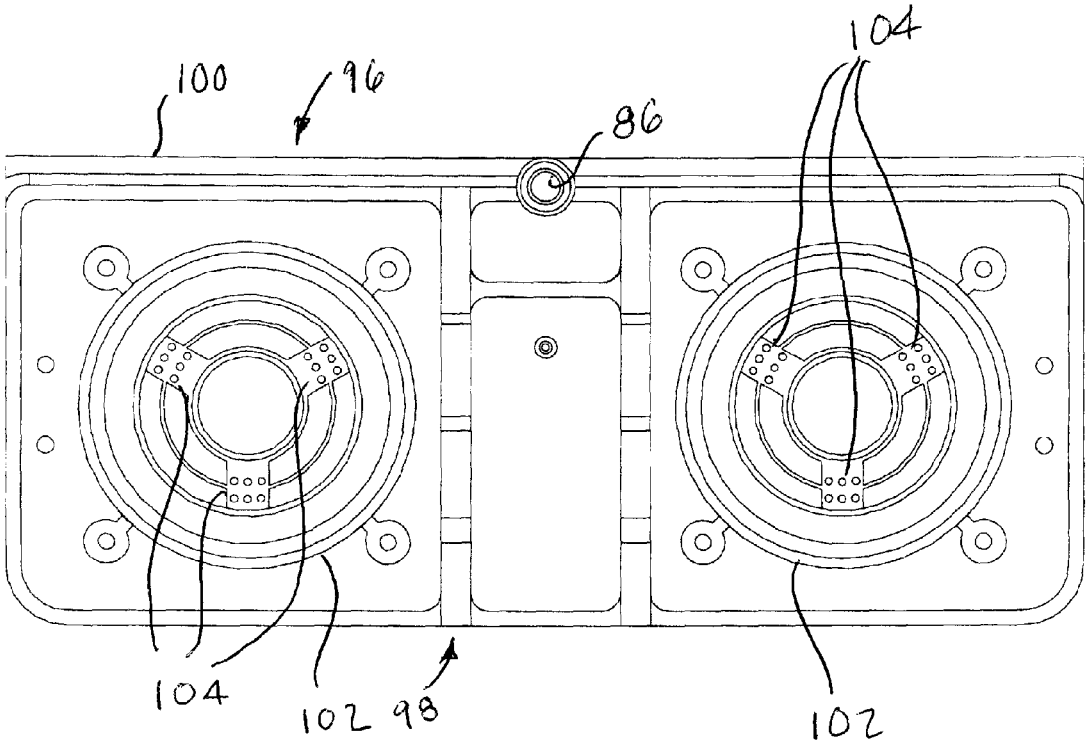
FIG. 16 is a top view of the baseplate of FIG. 14.

Referring now to FIGS. 14-16, various views of a baseplate 96 (corresponding to baseplate 28) may be seen. Baseplate 96 has a frame 98 for supporting the mode valve 78, and a manifold 100 which serves as a plenum or chamber between the manifold inlet 86 and the first set of nozzles 80. Baseplate 96 also has a pair of wells 102 for the water pulse delivery heads 76. Each well 102 has a second set of nozzles 104 arranged to emit water from the bottom of the baseplate 96 when water is delivered to the heads 76 by valve 78.

Figure 17:
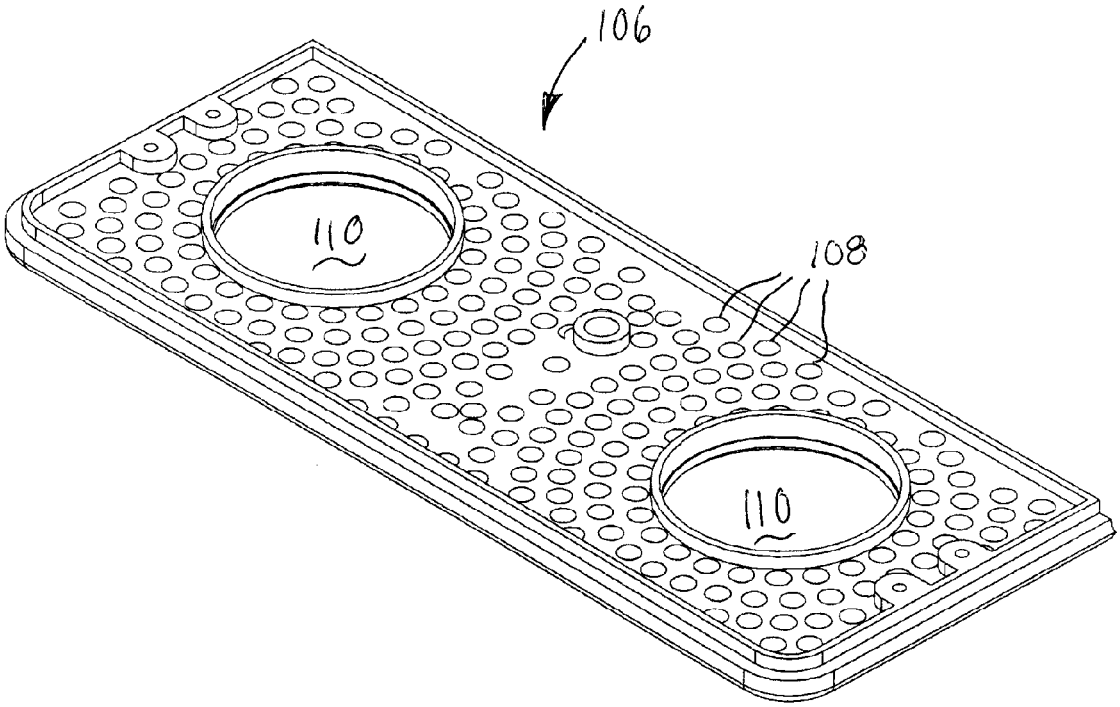
FIG. 17 is a perspective view of the bristle holder without the bristles from above.
Figure 18:
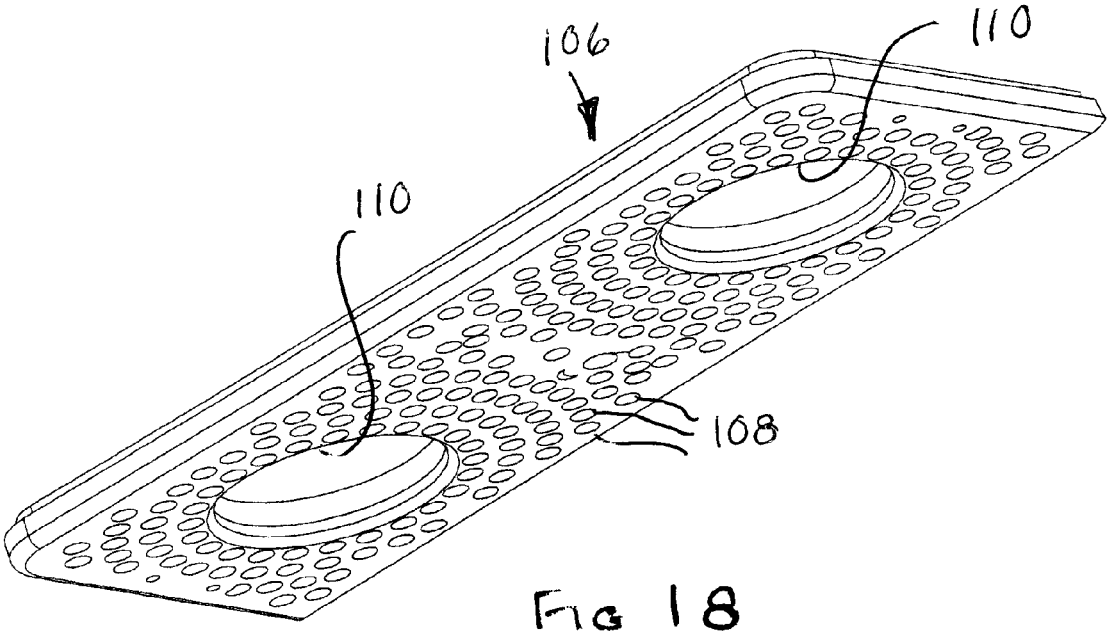
FIG. 18 is a perspective view of the bristle holder of FIG. 16 from below.

Referring now to FIGS. 17 and 18, a bristle holder 106 may be seen. It is to be understood that holder 106 has a large plurality of small apertures 108, and each of apertures 108 in bristle holder 106 receive and retain a tuft of bristles 74, as shown in FIG. 12. Holder 106 also has a pair of large apertures 110 to provide clearance for the spray emitted from nozzles 104.

Figure 19:
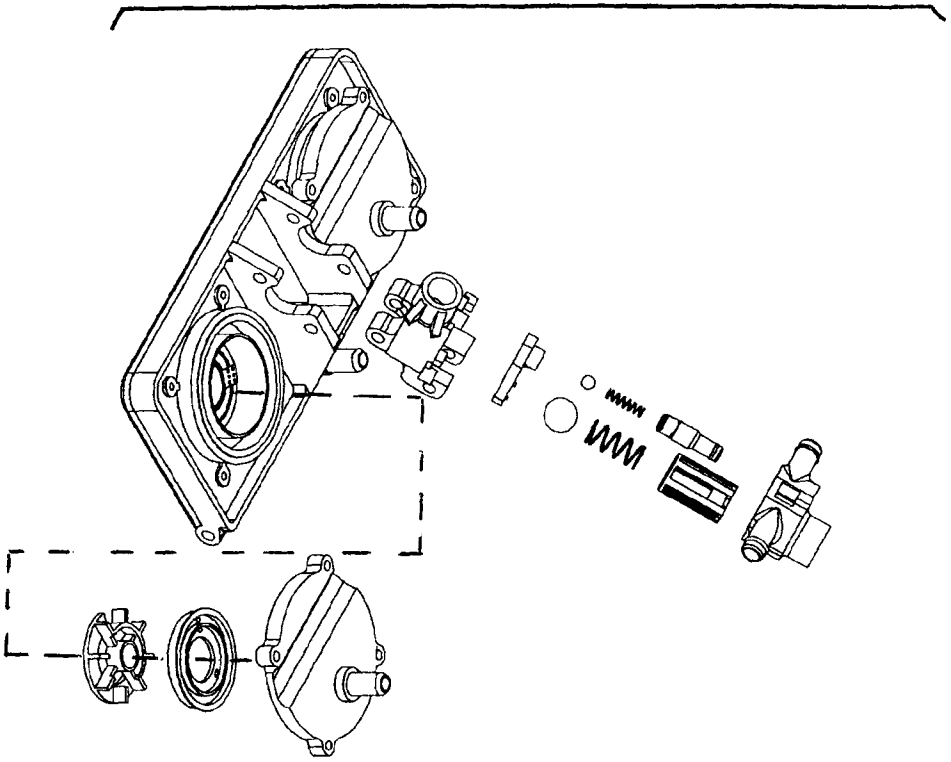
FIG. 19 is a partially exploded view of the assembly of FIG. 13.
Figure 20:
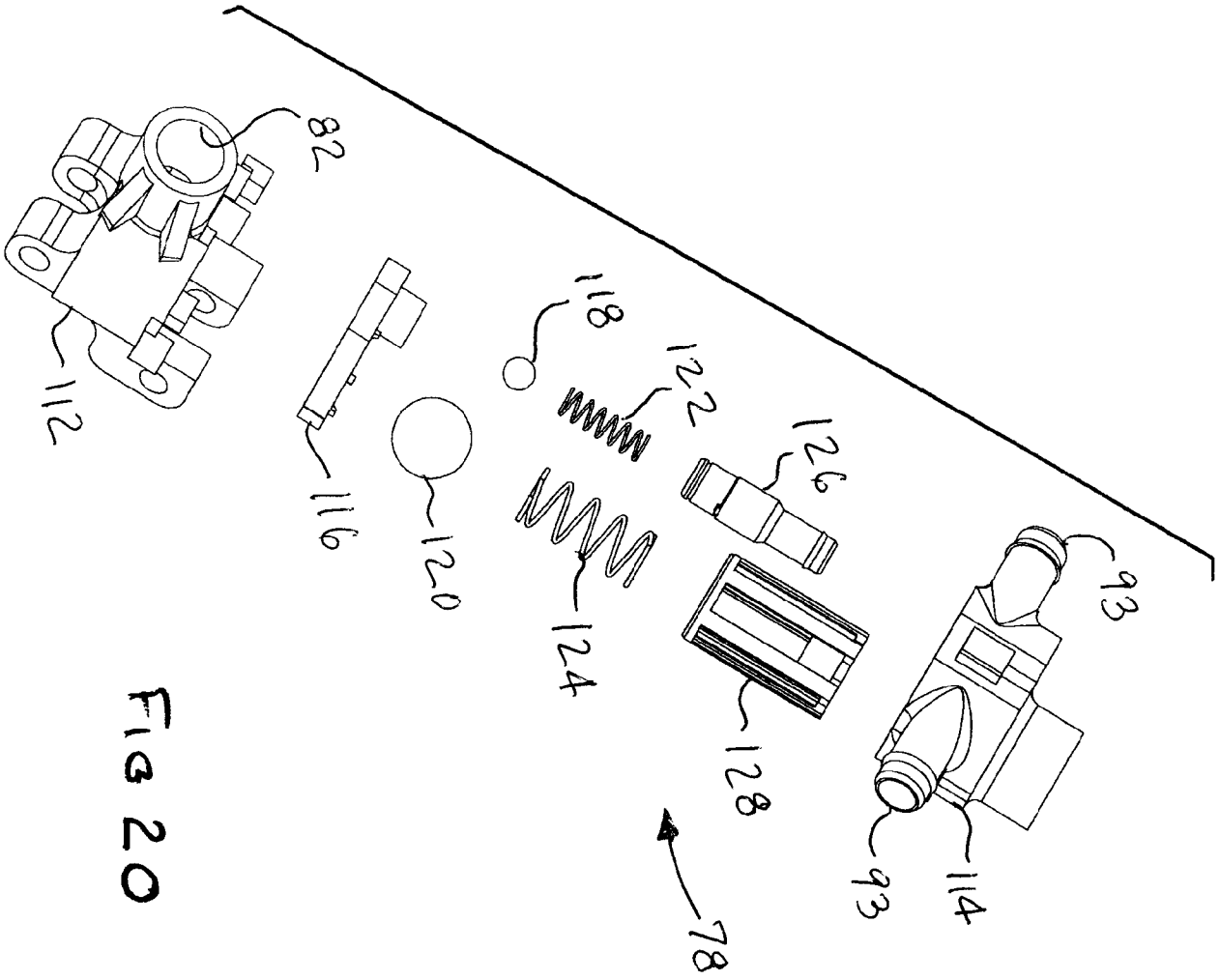
FIG. 20 is an enlarged view of certain parts from FIG. 19.
Figure 21:
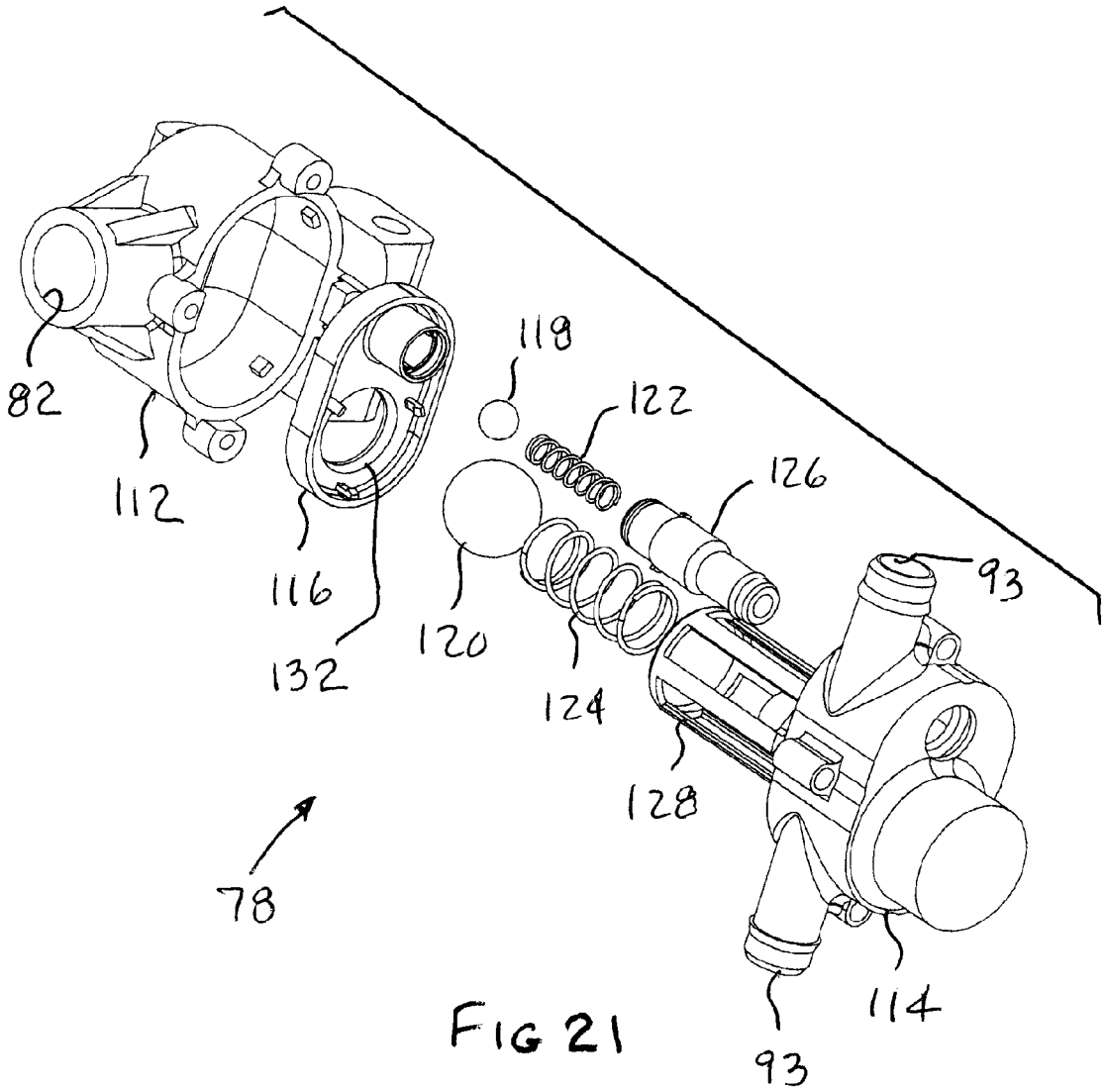
FIG. 21 is another view of the parts from FIG. 20.
Figure 22:
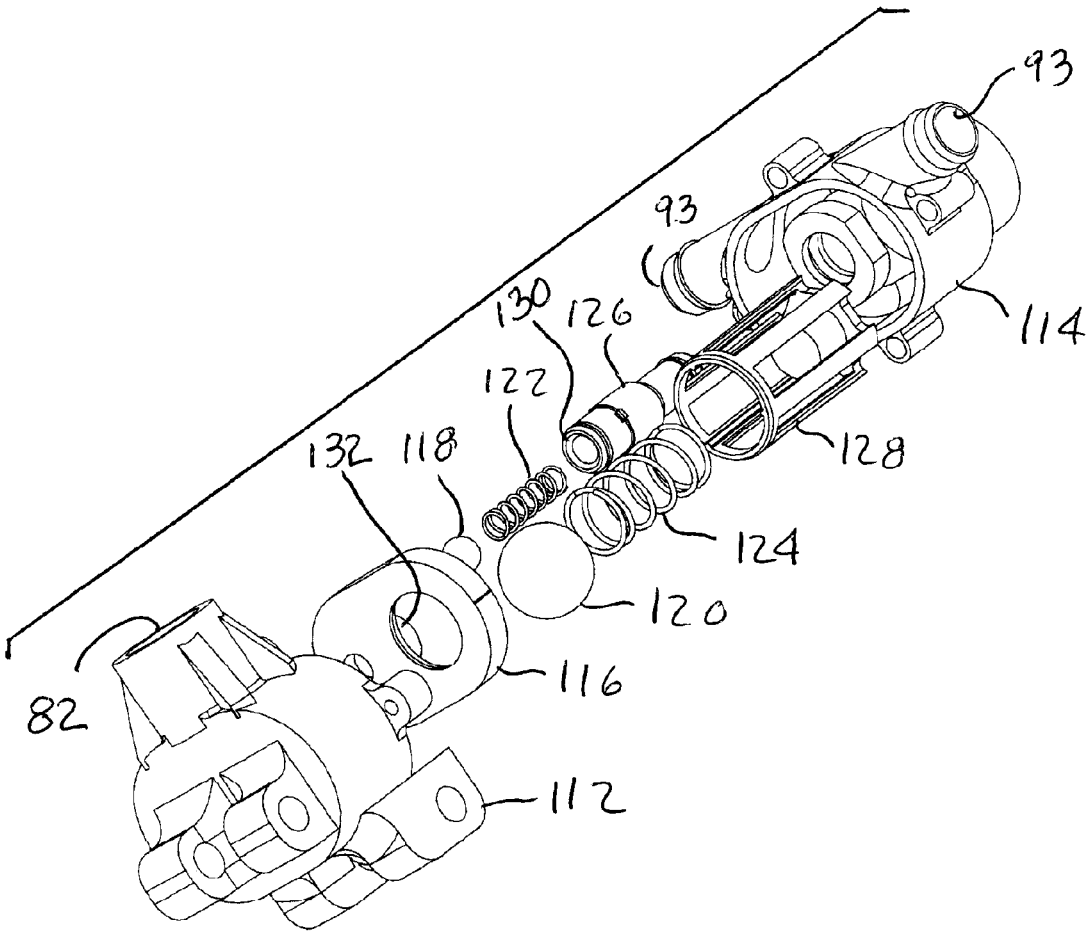
FIG. 22 is another view of the parts from FIG. 20.
Figure 23:
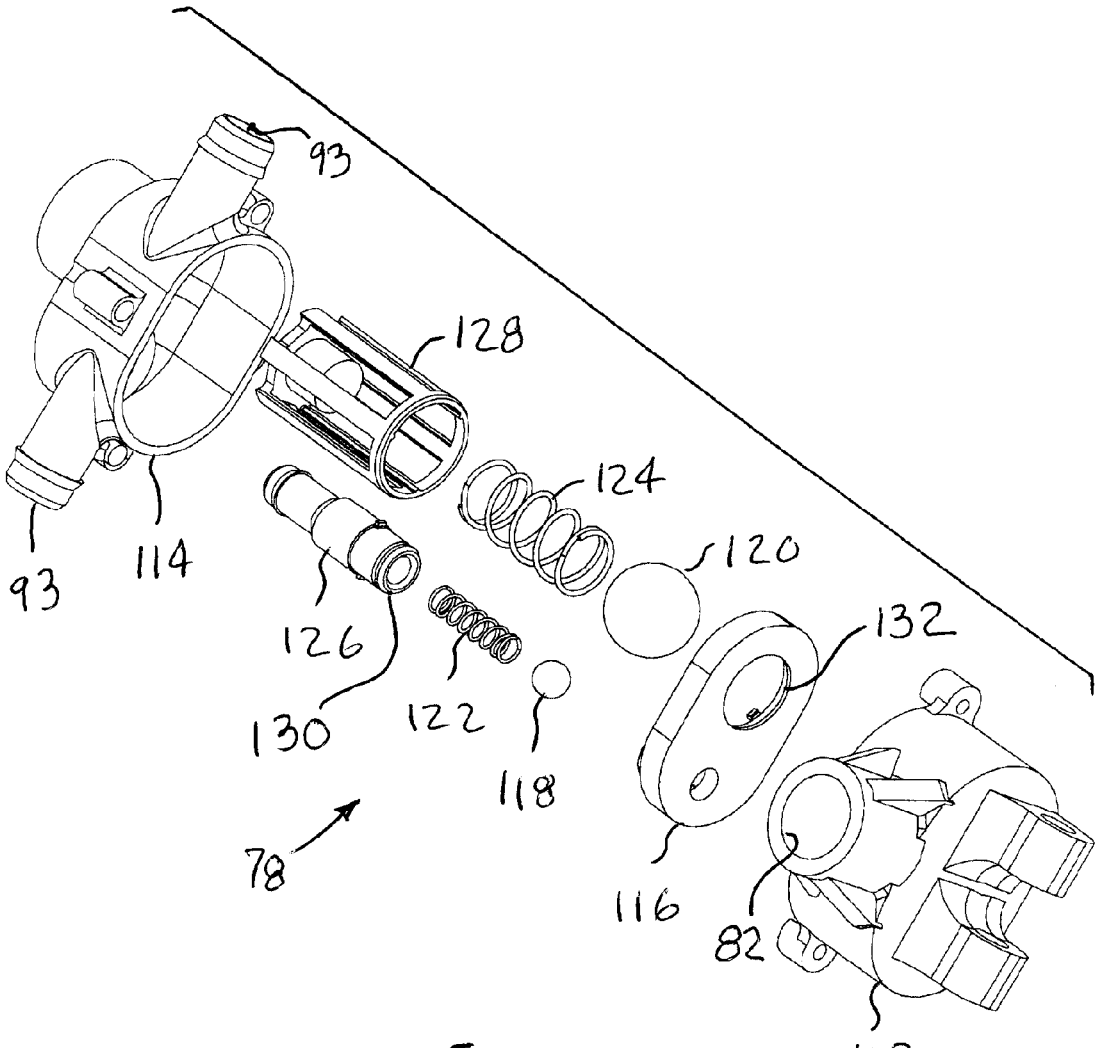
FIG. 23 is another view of the parts from FIG. 20.
Figure 24:
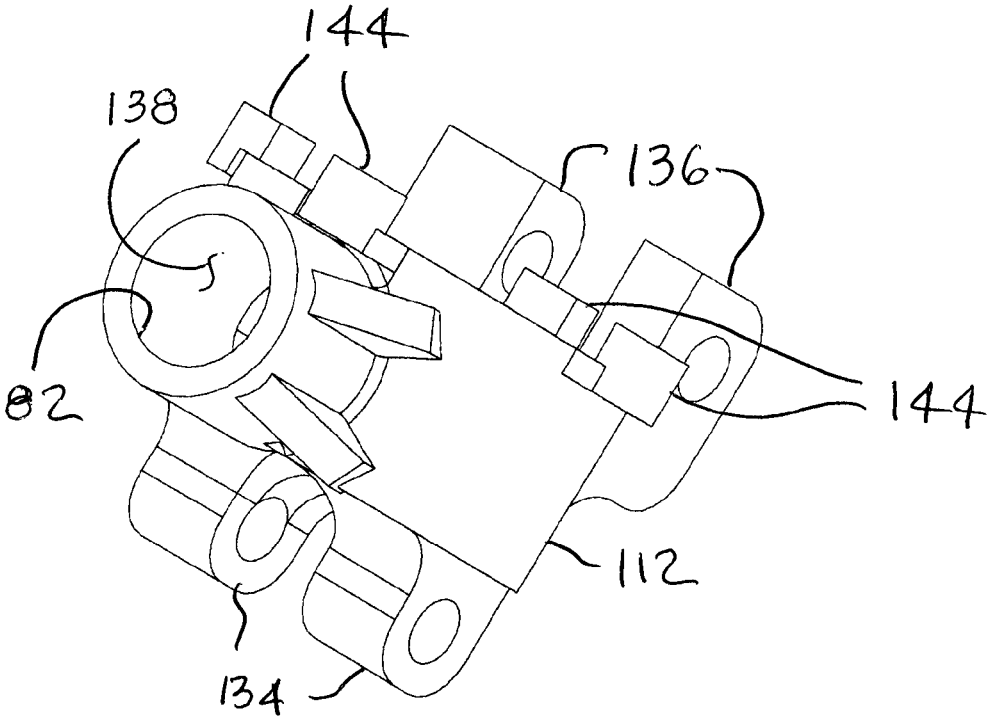
FIG. 24 is an enlarged perspective view of a pole end housing from FIG. 20.
Figure 25:
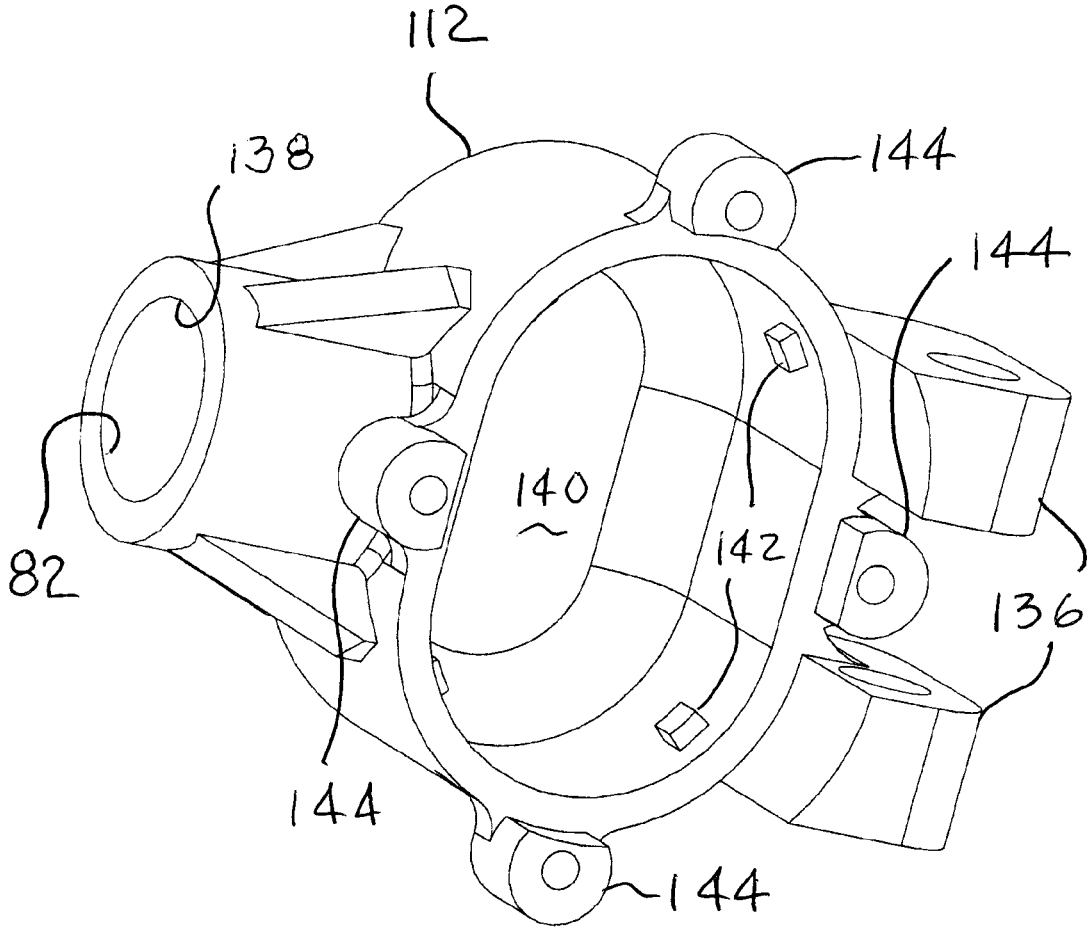
FIG. 25 is another perspective view of the pole end housing of FIG. 24.
Figure 26:
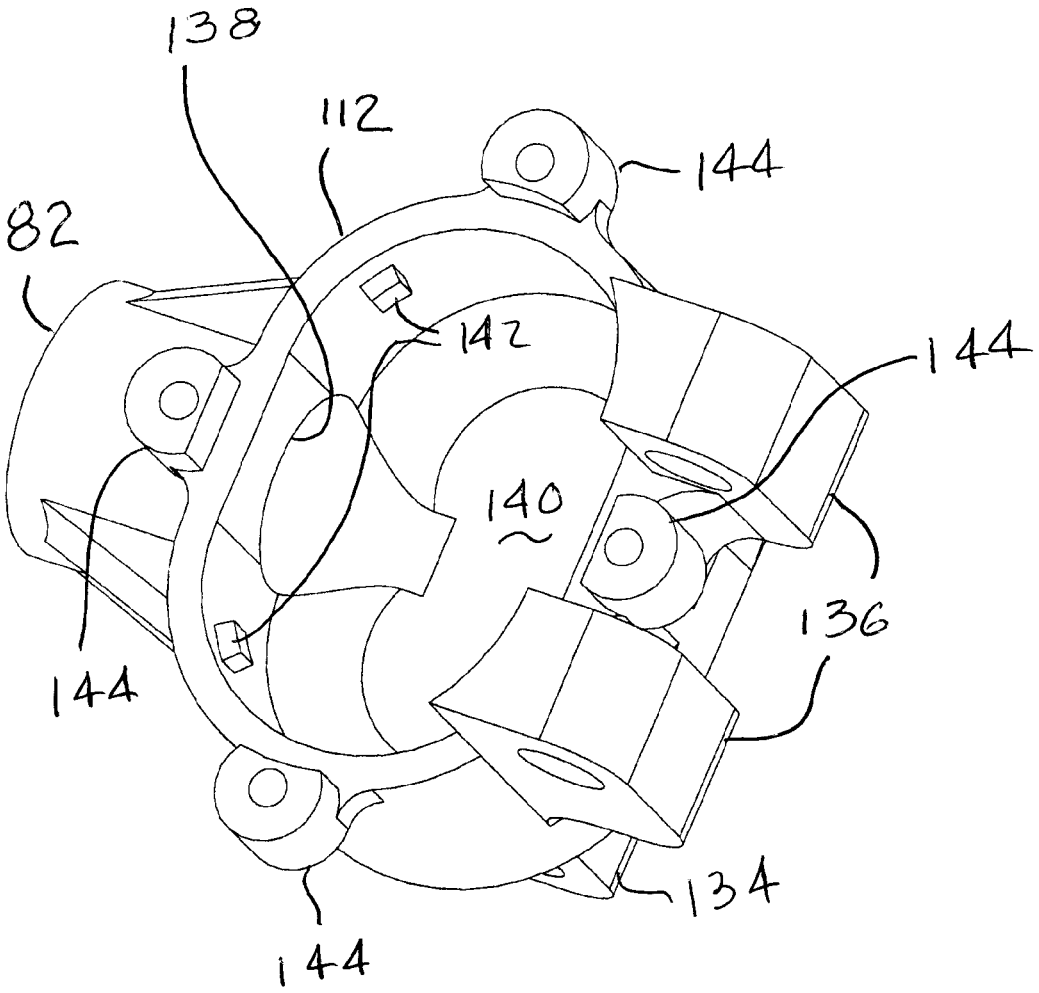
FIG. 26 is another perspective view of the pole end housing of FIG. 24.
Figure 27:
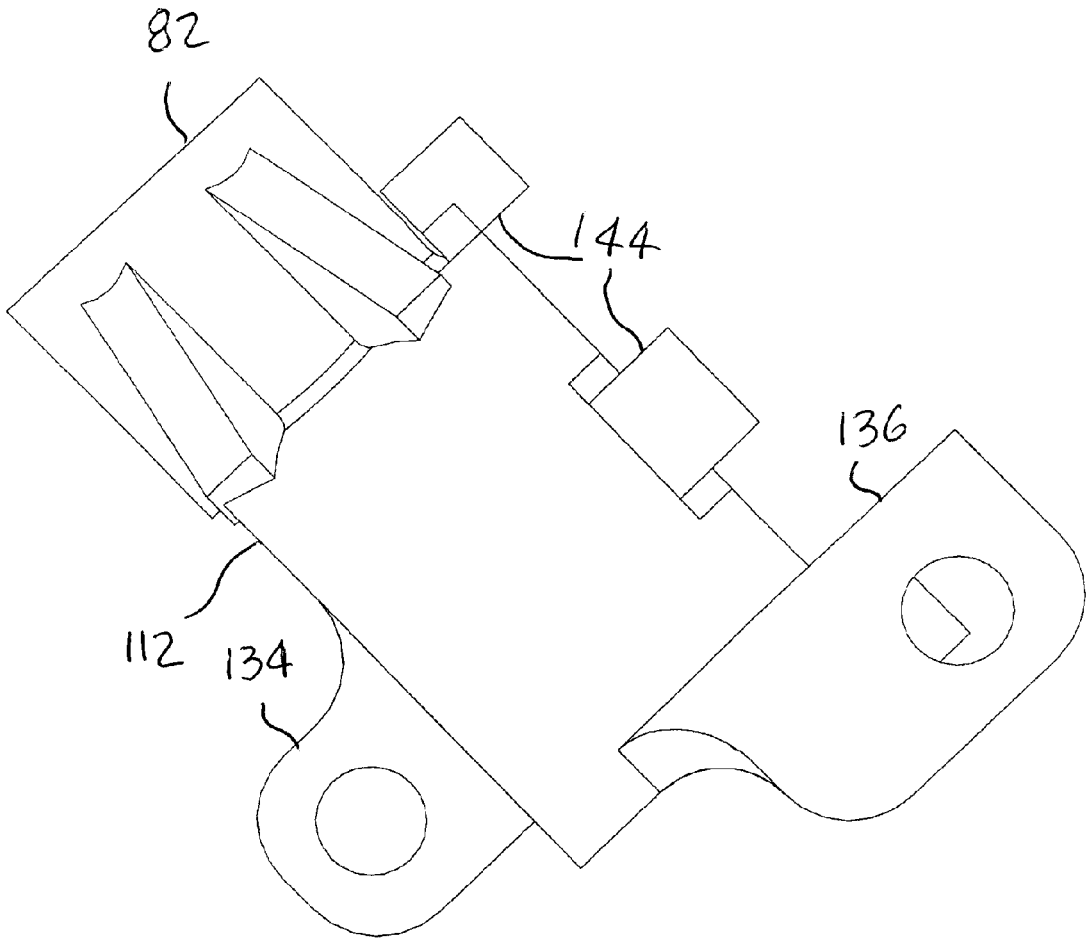
FIG. 27 is a side elevation view of the pole end housing of FIG. 24.
Figure 28:
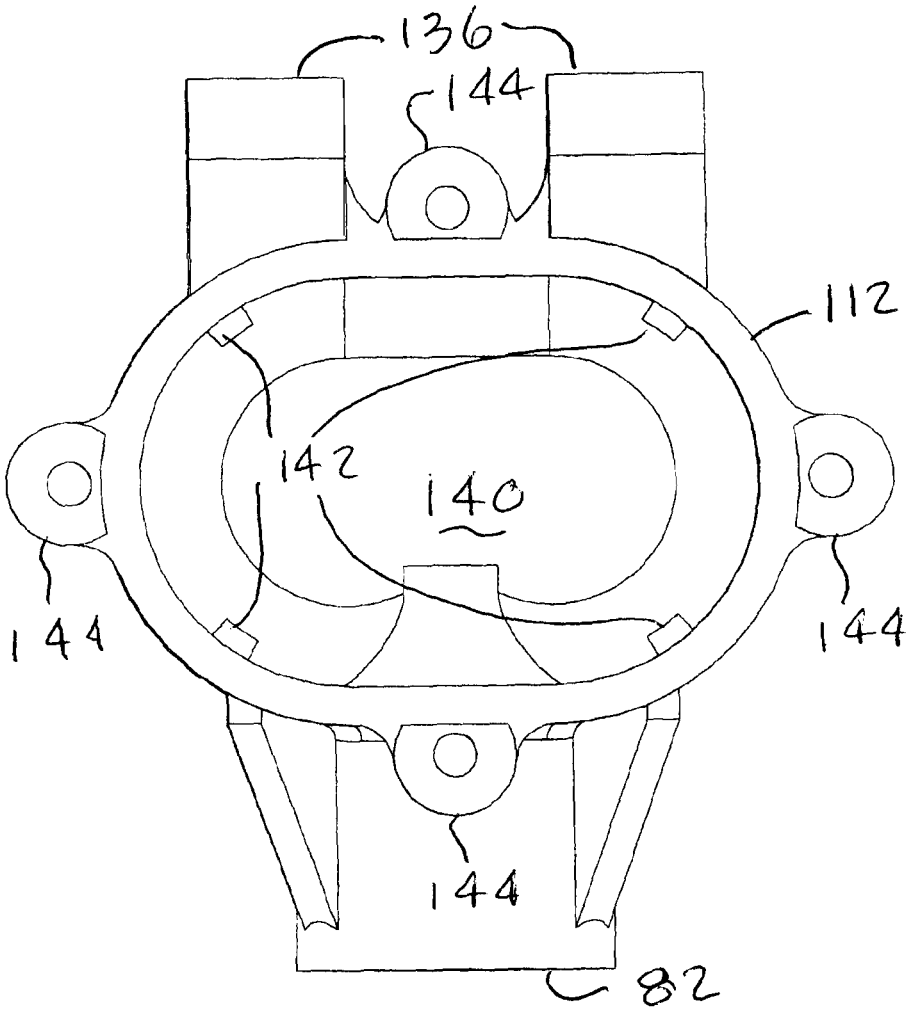
FIG. 28 is a top plan view of the pole end housing of FIG. 24.
Figure 29:
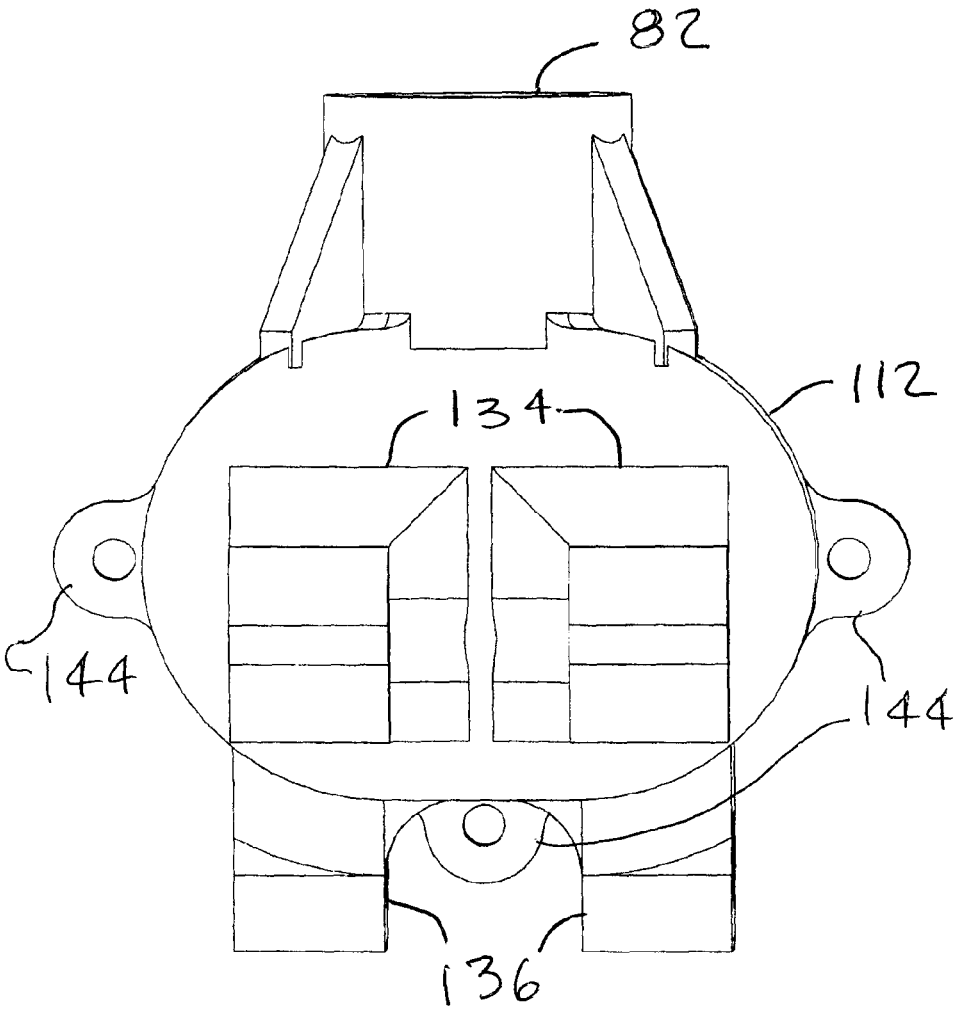
FIG. 29 is a bottom plan view of the pole end housing of FIG. 24.
Figure 30:
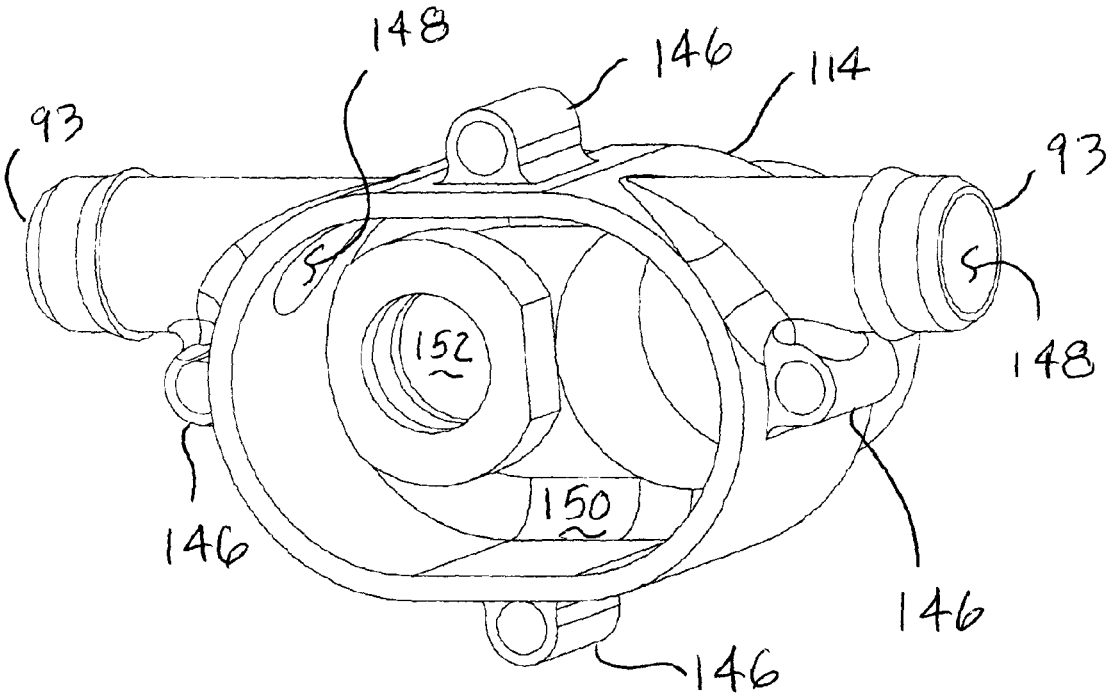
FIG. 30 is a first perspective view of an outlet housing from FIG. 20.
Figure 31:
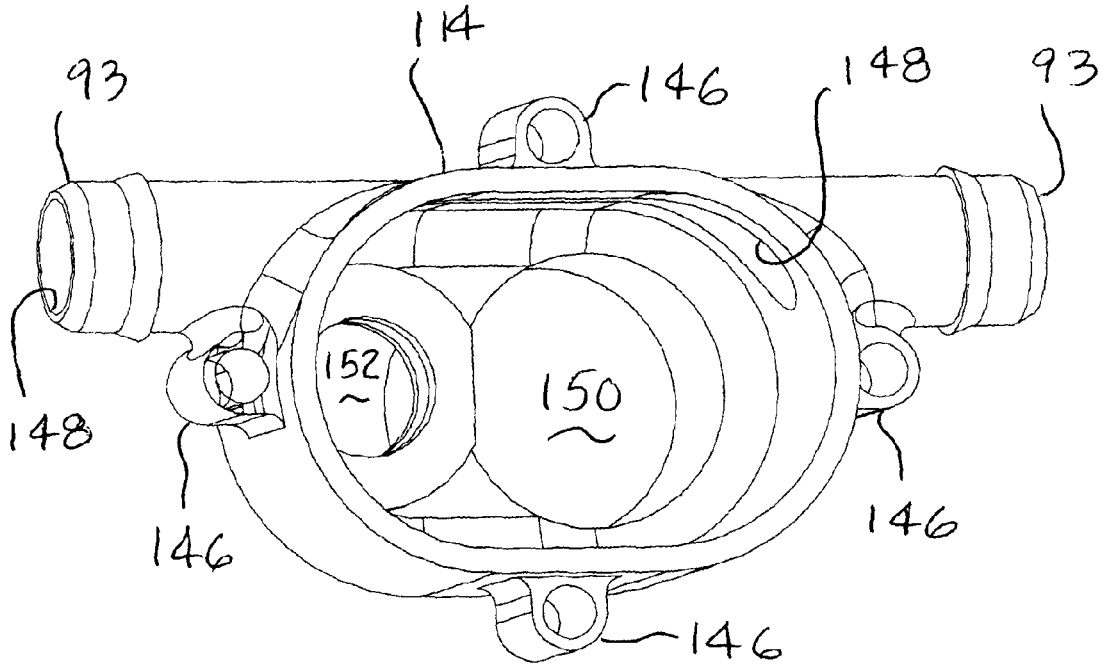
FIG. 31 is another perspective view of the outlet housing of FIG. 30.
Figure 32:
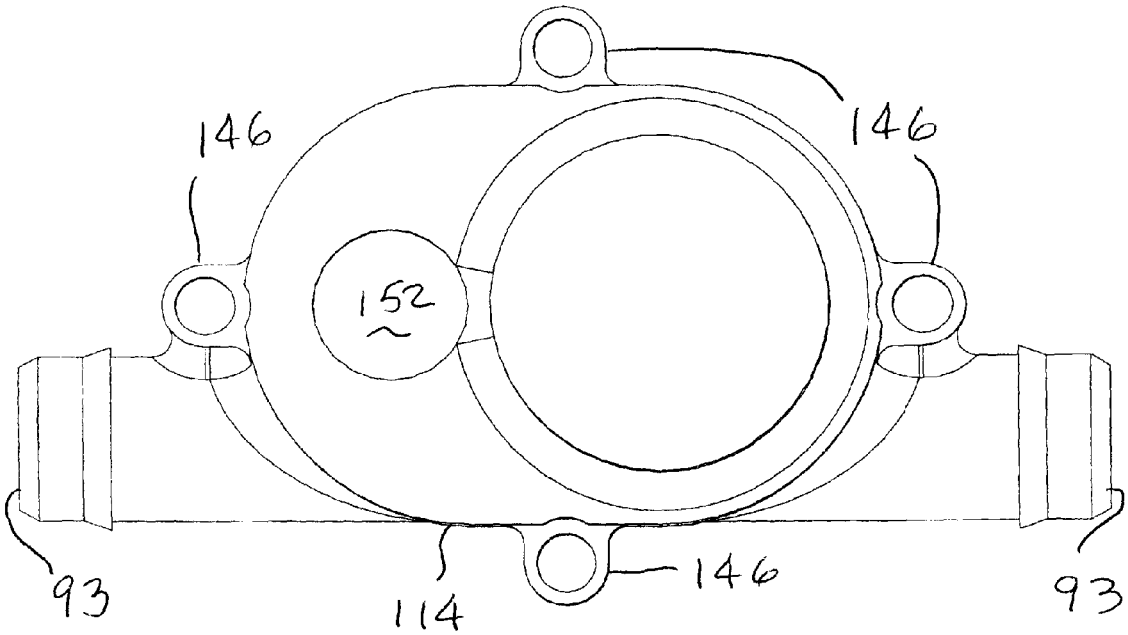
FIG. 32 is a top plan view of the outlet housing of FIG. 30.
Figure 33:
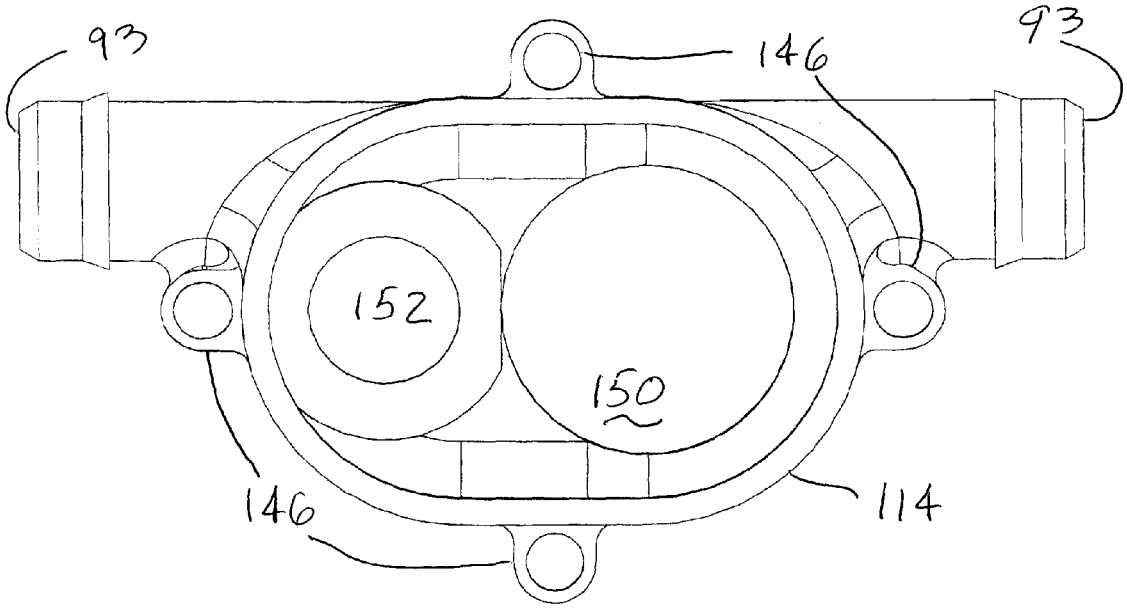
FIG. 33 is a bottom plan view of the outlet housing of FIG. 30.
Figure 34:
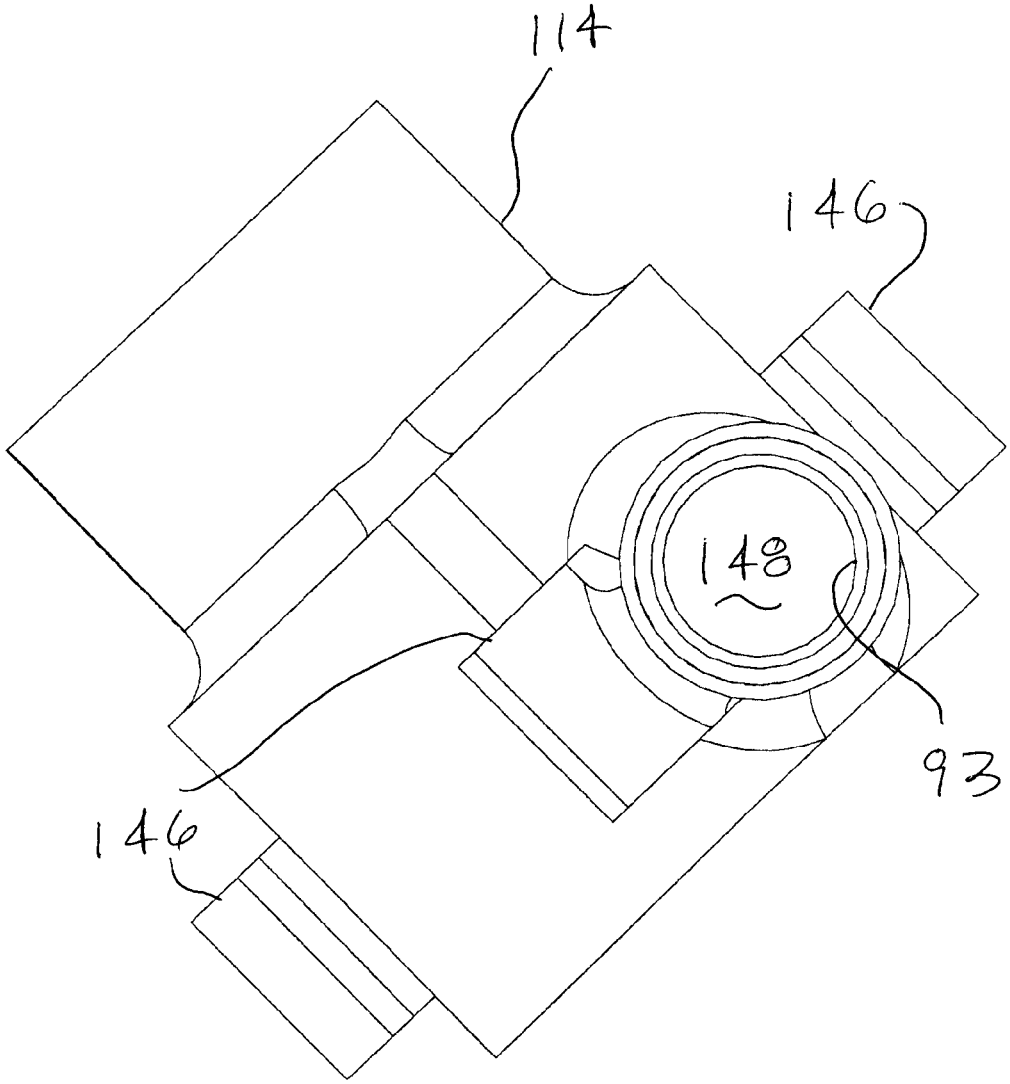
FIG. 34 is a side elevation view of the outlet housing of FIG. 30.

Referring now to FIG. 19, an exploded view of certain parts of the brush head 70 (including parts of water pulse delivery head 76 and the mode valve 78) may be seen. This Figure is provided to show the orientation and brush head environment of the parts of the delivery heads 76 and the mode valve 78.

Referring now to FIGS. 20-34, various aspects and details of the mode valve 78 may be seen. It is to be understood that in the various views, including FIG. 19, fasteners and seals such as O-rings are omitted or not exploded, for simplicity.

Referring now to FIGS. 20-23, various exploded perspective views of the parts of the mode valve 78 may be seen. Mode valve 78 may include a pole end housing 112 and an outlet housing 114 making up an enclosure for the mode valve 78. Mode valve 78 may also include an inlet plate 116, a first ball 118, a second ball 120, a first spring 122, a second spring 124, a spring holder 126, and a cage 128. It is to be understood that first ball 118, first spring 122 and spring holder 126 correspond to the first check valve 50 shown in FIG. 9. Similarly, inlet plate 116, second ball 120, second spring 124, and cage 128 correspond to the second check valve 52 also shown in FIG. 9. As will be shown in more detail and described further infra, spring holder 126 includes a first valve seat 130 for ball 118, and inlet plate 116 includes a second valve seat 132 for ball 120.

Referring now to FIGS. 24-29, details of the pole end housing 112 may be seen. Housing 112 may have first and second pairs of ears 134, 136 to secure housing 112 to the frame 98 on baseplate 96. A bore 138 provides fluid communication from input 82 to a chamber 140. A plurality of projections 142 provide support for the inlet plate 116 within chamber 140. A plurality of bosses 144 may be used to secure housings 112 and 114 together, using conventional fasteners, such as self-tapping screws (not shown).

Referring now to FIGS. 30-34, various details of the outlet housing 114 may be seen. Housing 114 may have bosses 146 located in alignment with bosses 144 when the housings 112 and 114 are brought together in assembling mode valve 78. Each of outlets 93 is fluidly coupled to a common bore 148 which provides fluid communication to a chamber 150 interior of housing 114. An aperture 152 allows the spring holder 126 to project out of housing 114 to form first outlet 84 for the mode valve 78 when parts are assembled.

Figure 35:
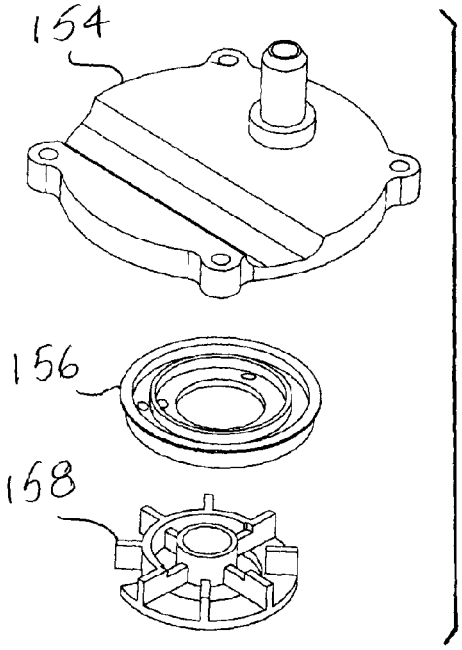
FIG. 35 is an enlarged view from above of a pulse cap, water diverter and rotor from FIG. 19.
Figure 36:
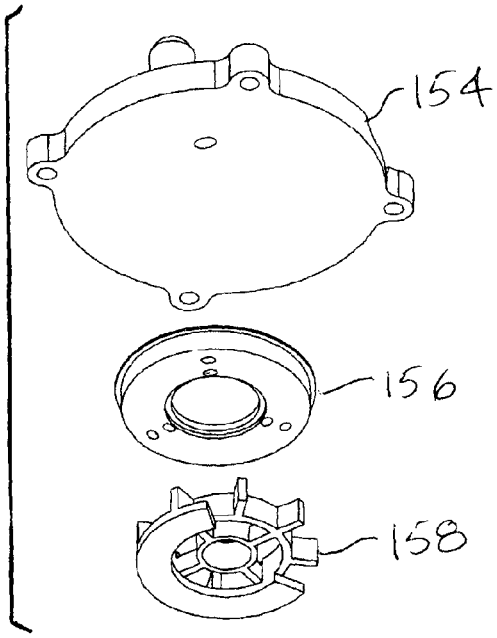
FIG. 36 is a view of the parts of FIG. 35 shown from below.
Figure 37:
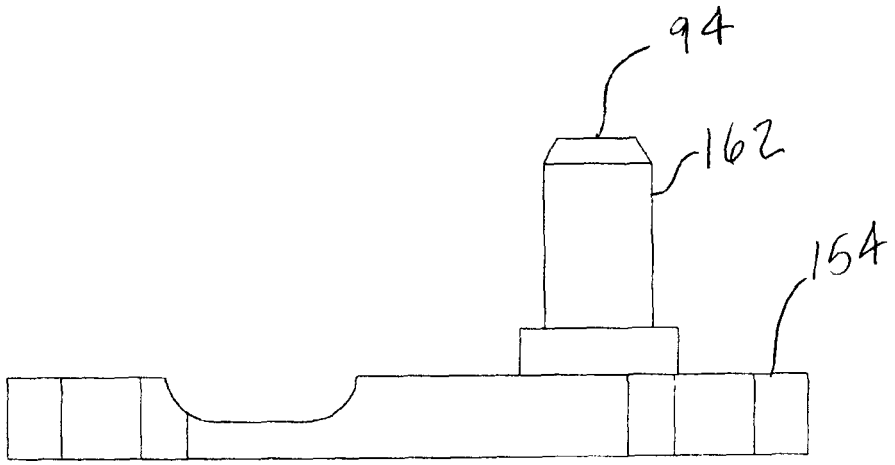
FIG. 37 is a side view of pulse cap useful in the practice of the present invention.
Figure 38:
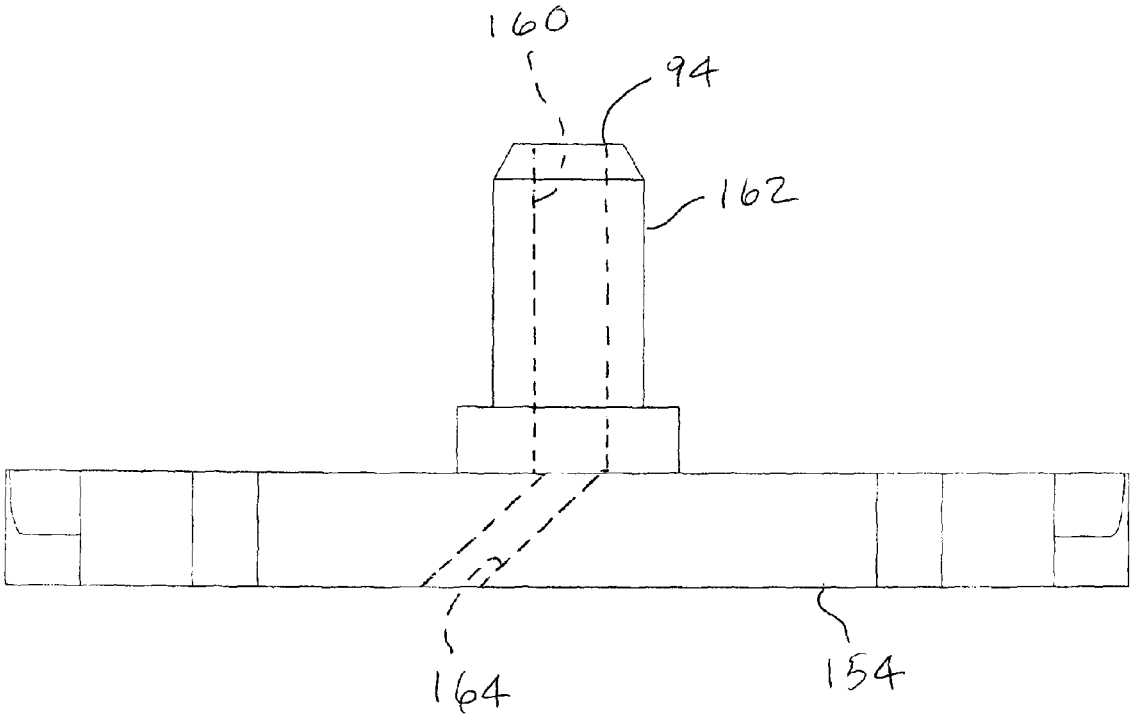
FIG. 38 is a front view of the pulse cap of FIG. 37.
Figure 39:
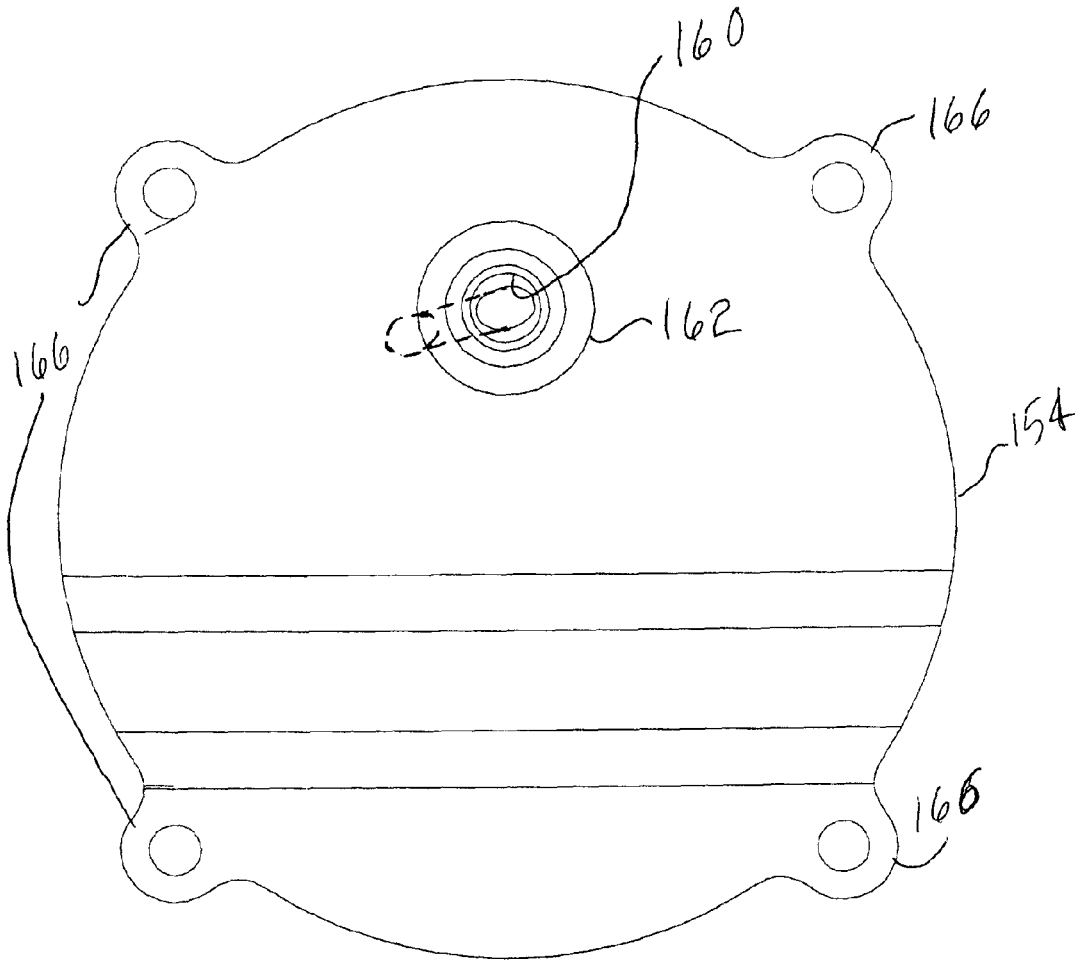
FIG. 39 is a top view of the pulse cap of FIG. 37.
Figure 40:
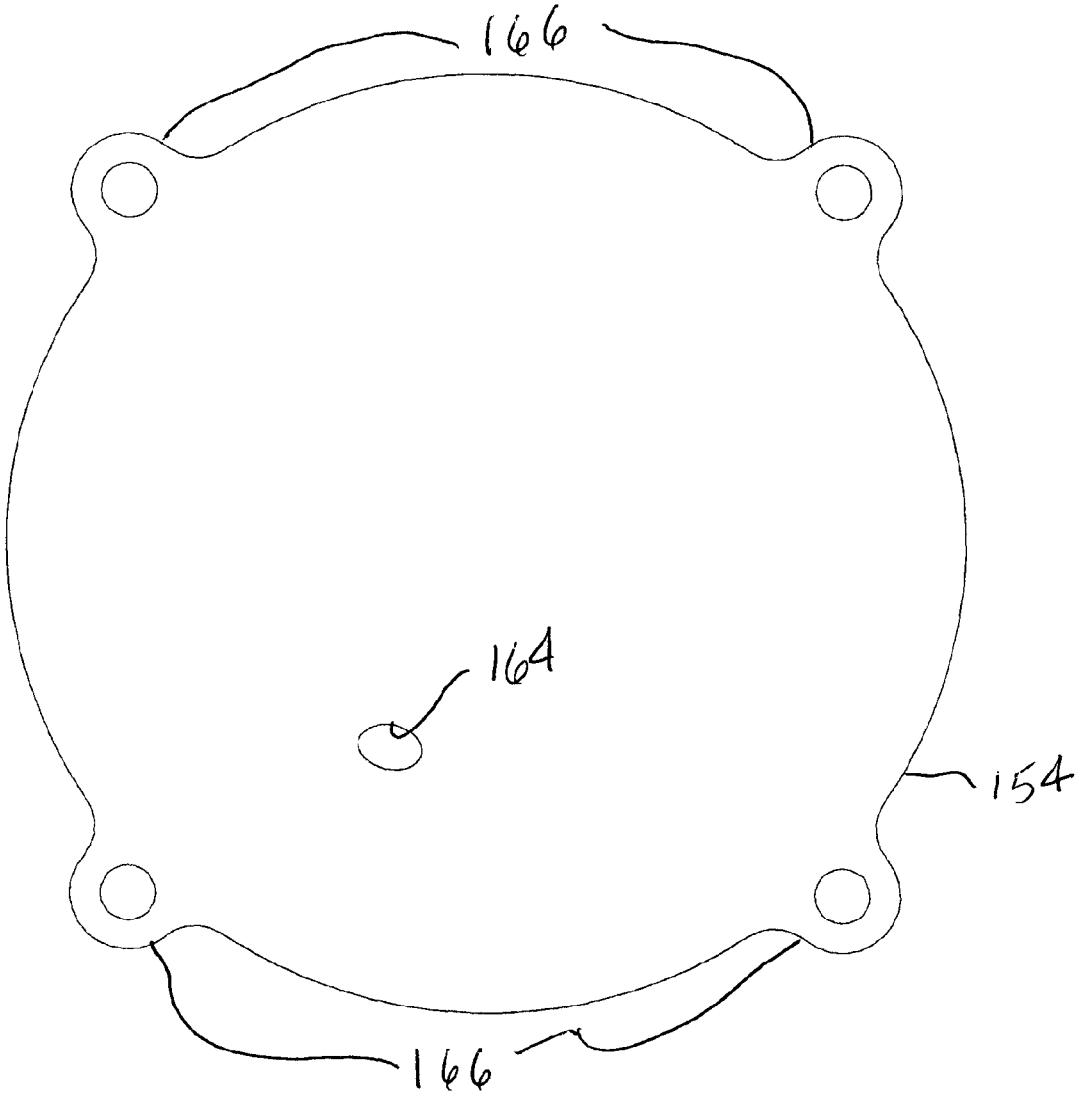
FIG. 40 is a bottom view of the pulse cap of FIG. 37.

Referring now to FIGS. 35 and 36, two perspective views of certain parts for the water delivery head 76 may be seen. FIG. 35 is an enlarged view of a pulse cap 154, a water diverter 156 and a rotor 158 from FIG. 19. Preferably, identical parts are used for both heads 76. FIG. 36 is an enlarged perspective view of these parts from below, to illustrate certain features thereof.

Referring now to FIGS. 37-40, enlarged view of the pulse cap 154 may be seen. Pulse cap 154 includes inlet 94 for its respective water delivery head 76. Inlet 94 preferably has an inlet bore 160 in a stem 162 and the bore 160 is in fluid communication with an angled exit bore 164. Cap 154 also may have a plurality of bosses 166 for attachment to the baseplate 96 using conventional fasteners, such as self tapping screws (not shown).

Figure 41:
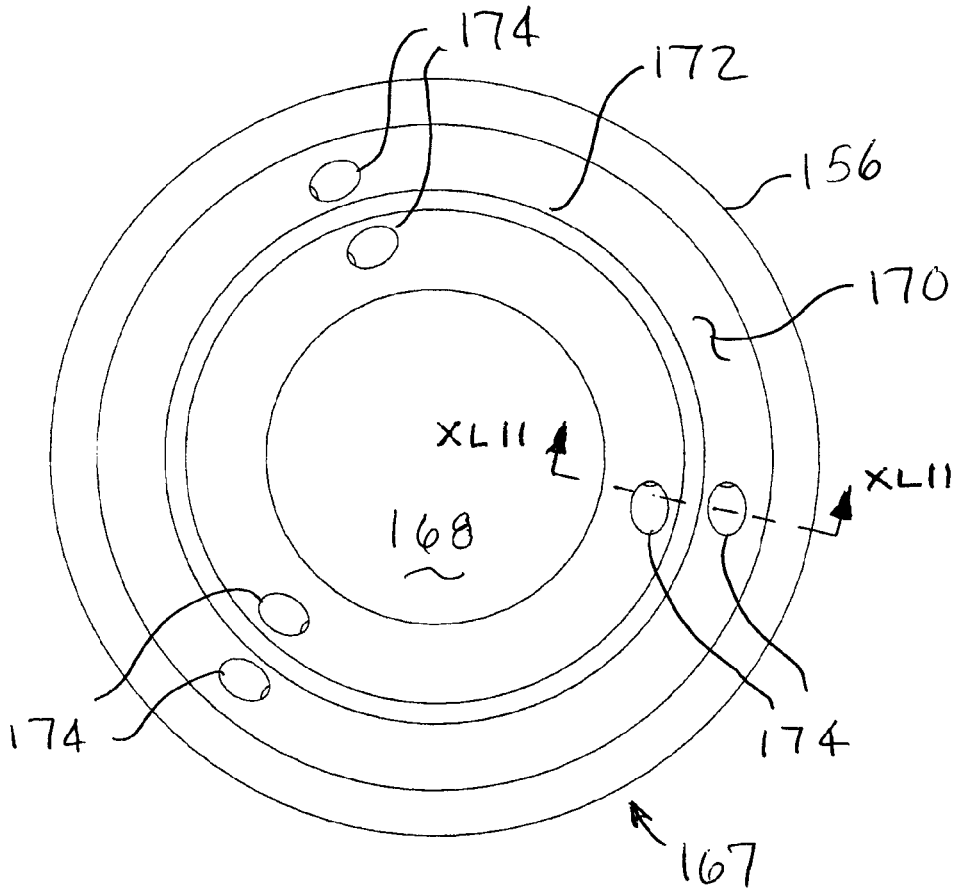
FIG. 41 is a top view of a water diverter useful in the practice of the present invention.
Figure 42:
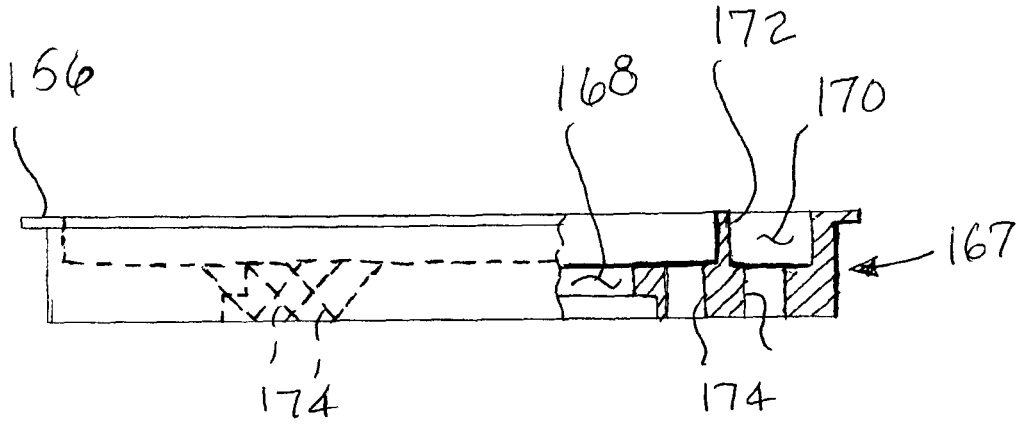
FIG. 42 is a side view, partially in section along line XLII-XLII of FIG. 41.
Figure 43:
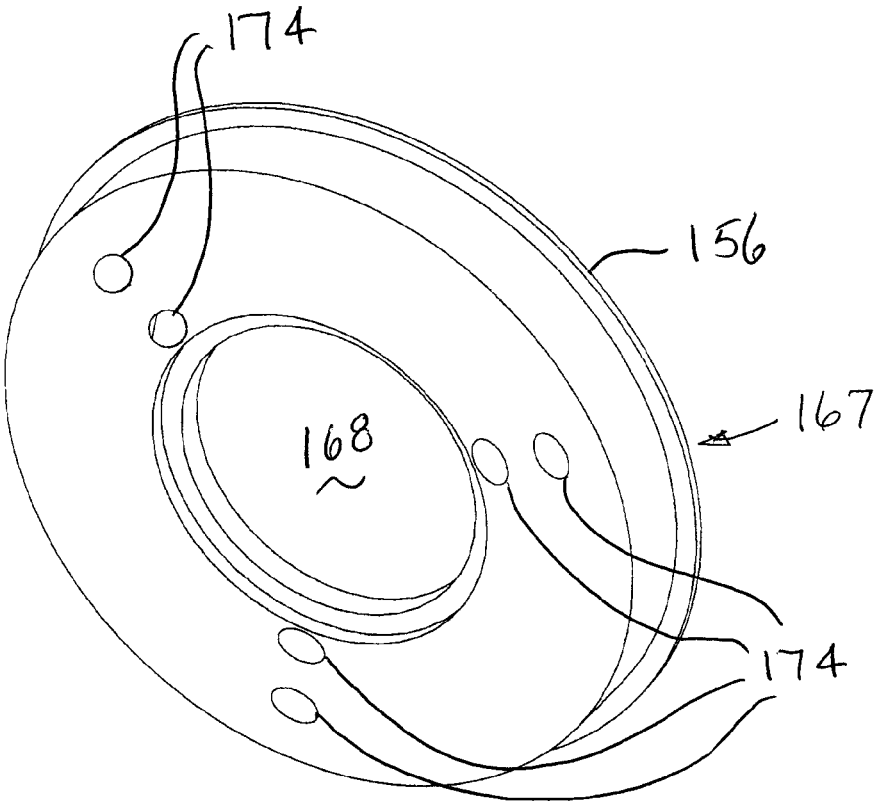
FIG. 43 is a perspective view of the water diverter from the bottom.

Referring now to FIGS. 41-43, various views of the water diverter 156 may be seen. Diverter 156 is generally in the form of an annular ring 167, with a central aperture 168 and has an annular recess 170 formed by an inner wall 172. Preferably three pair of angled outlet bores 174 extend through ring 167.

Figure 44:
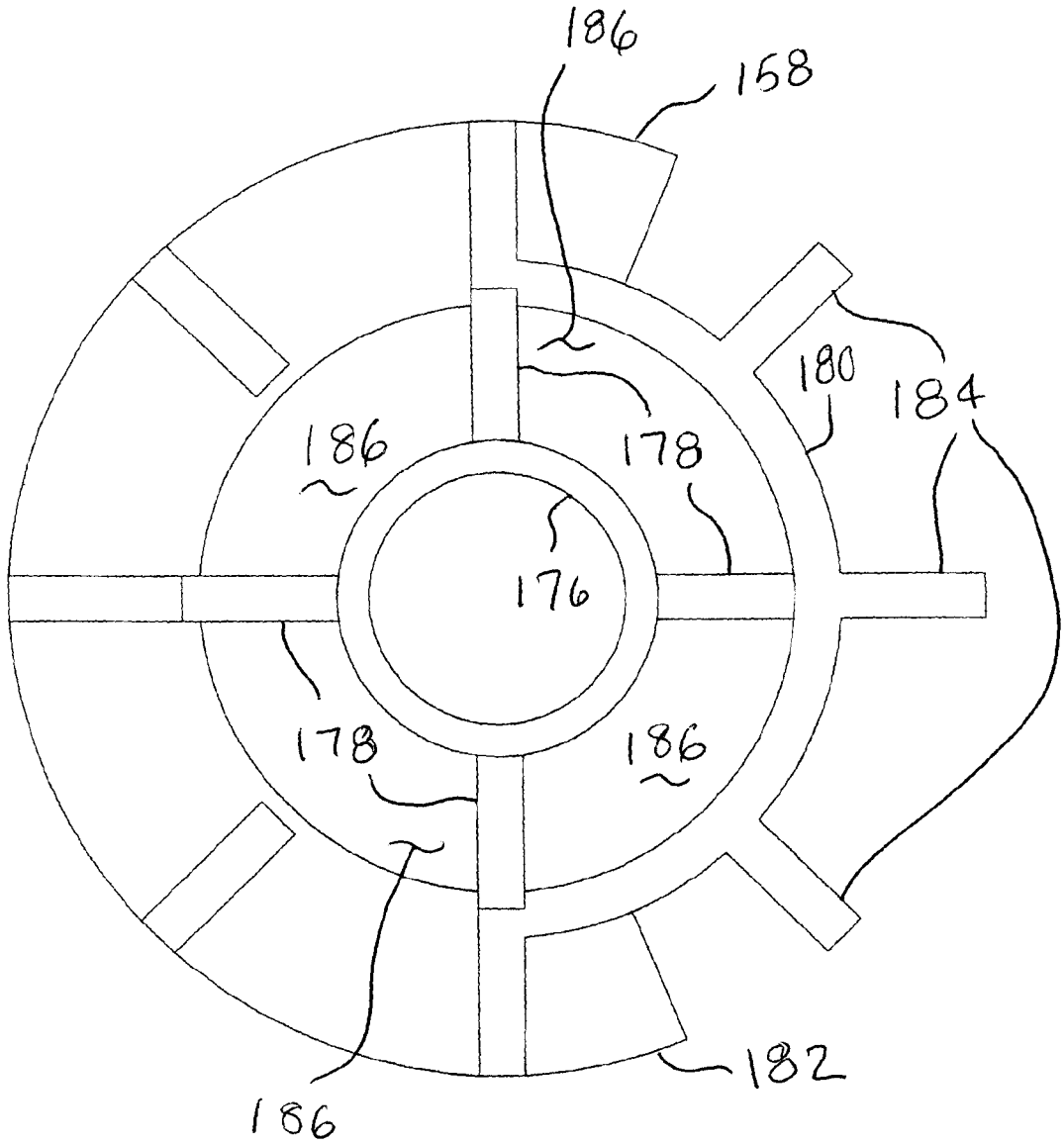
FIG. 44 is a top view of a rotor useful in the practice of the present invention.
Figure 45:
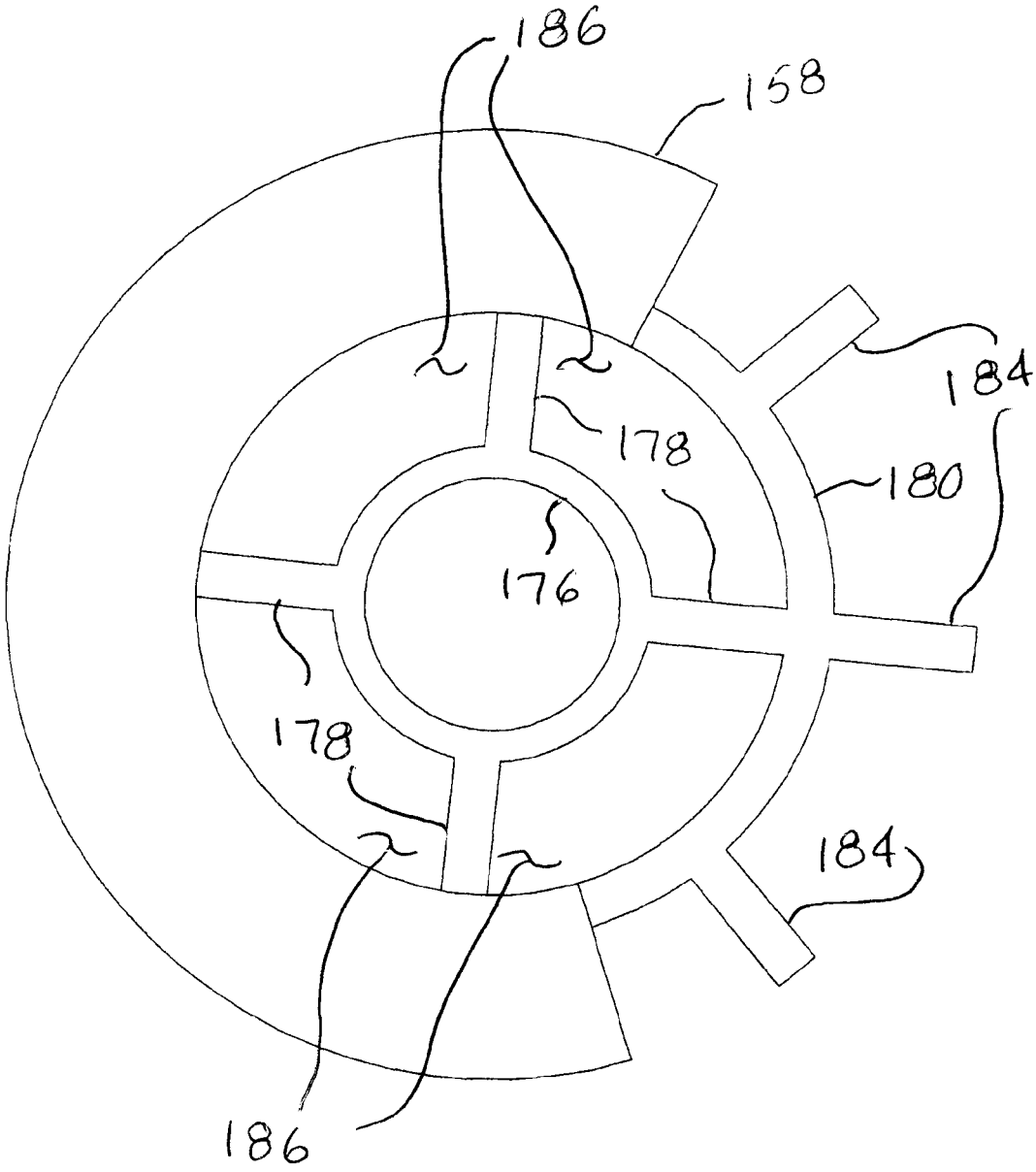
FIG. 45 is a bottom view of the rotor of FIG. 44.
Figure 46:
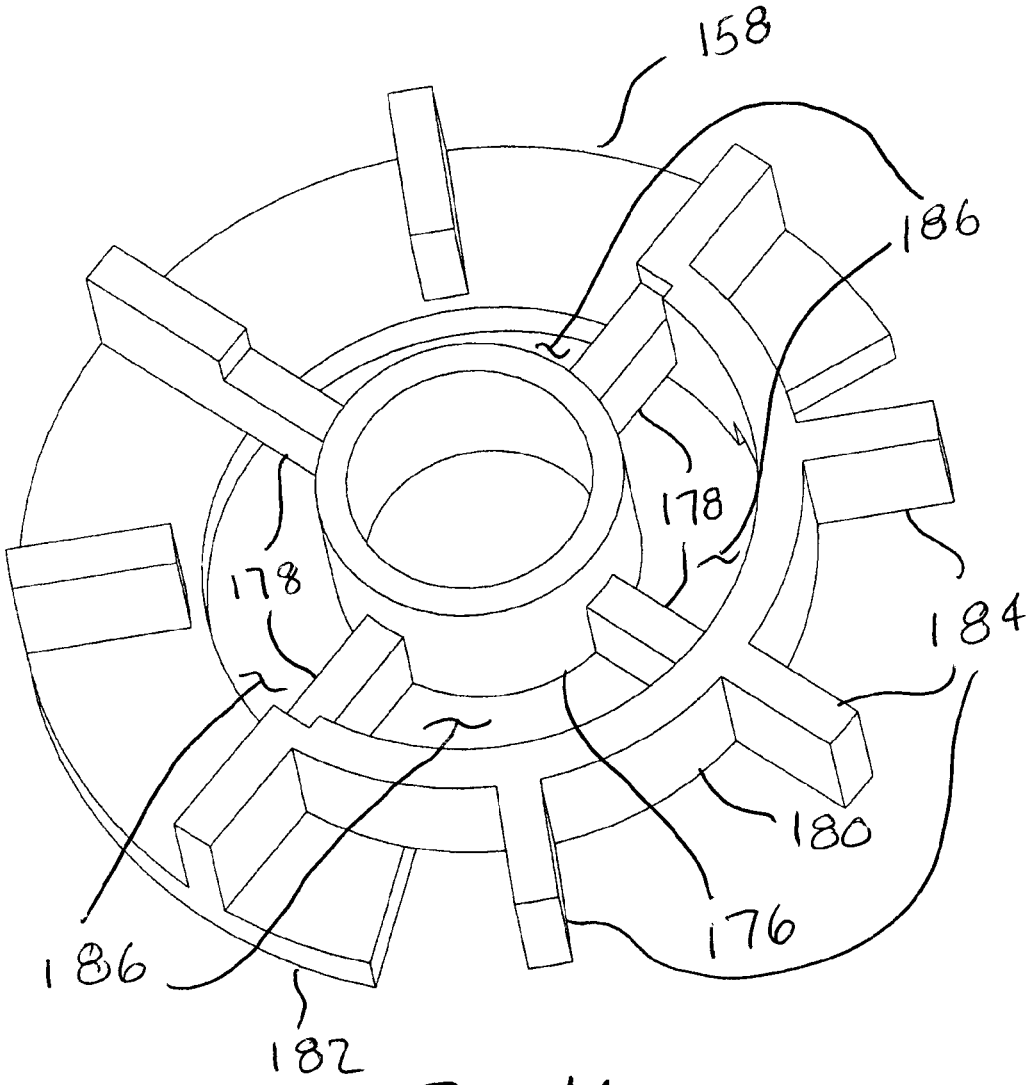
FIG. 46 is a perspective view of the rotor of FIG. 44.

Referring now to FIGS. 44-46, various views of the rotor 158 may be seen. Rotor 158 may have an inner ring 176 connected by radial arms 178 to a partial outer ring 180 and to a partial flange 182. Rotor 158 also has a plurality of vanes 184 and preferably has four apertures 186.

Figure 47:
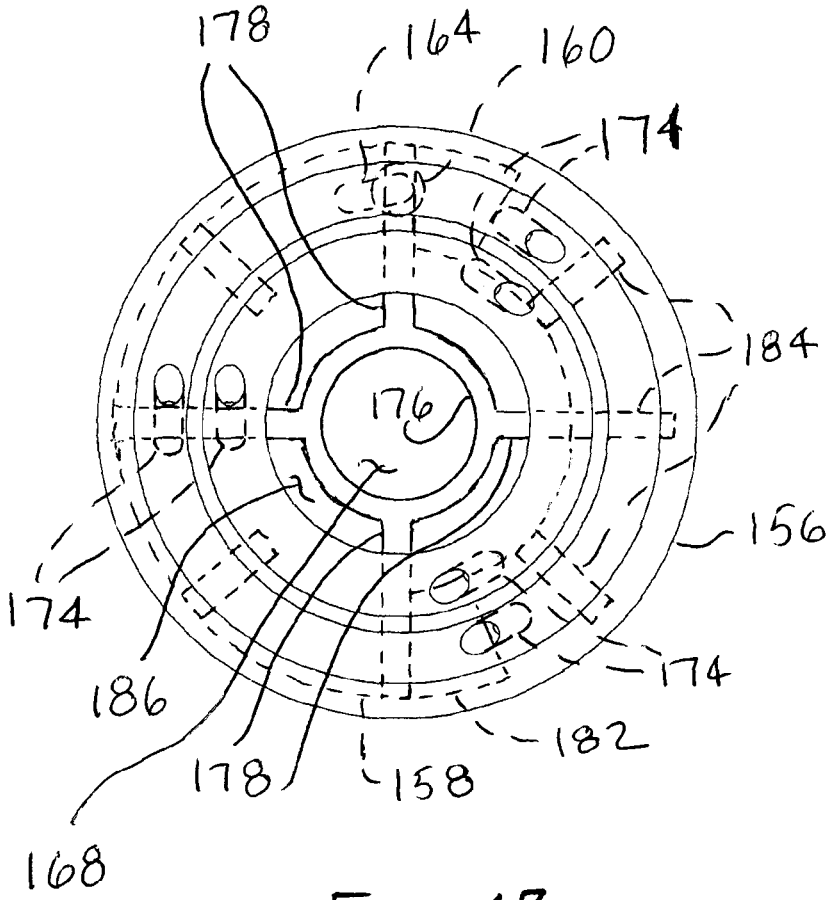
FIG. 47 is a composite top view of the water diverter and rotor and showing the flow path of the pulse cap.

Referring now to FIG. 47, a composite view of certain features of the pulse cap 154 and rotor 158 are shown with a top plan view of the water diverter 156. This Figure shows the relative location of the angled exit bore 164 of the pulse cap 154 with respect to the annular recess 170 of the water diverter 156 and the vanes 184 and partial flange 182 of the rotor 158.

Figure 48:
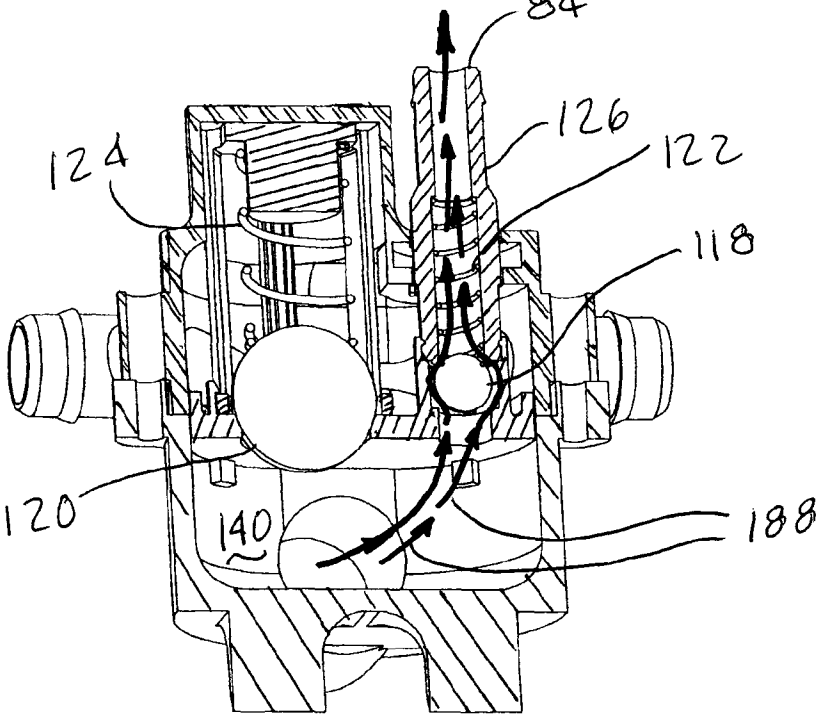
FIG. 48 is a perspective view in section of a valve useful in the practice of the present invention, shown in a first position.
Figure 49:
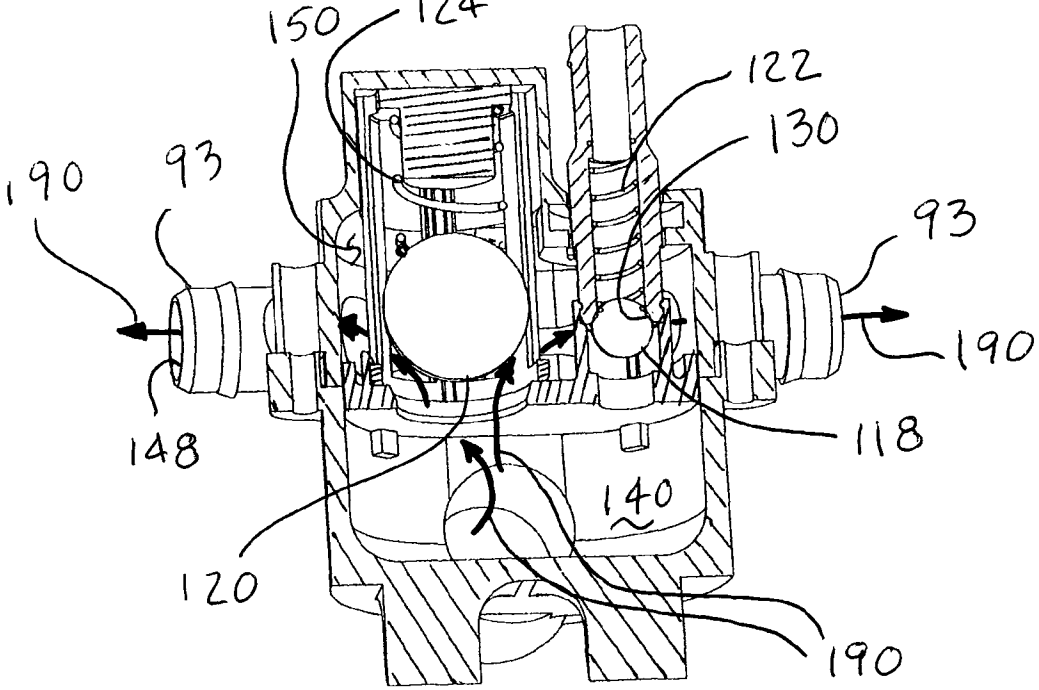
FIG. 49 is the valve of FIG. 48 shown in a second position.

Referring now to FIGS. 48 and 49, the operation of mode valve is illustrated. Referring first to FIG. 48, under conditions of low pressure in chamber 140, ball 120 will remain sealed against seat 132 due to the action of spring 124 urging ball 120 towards seat 132. Ball 118 will be urged away from seat 130 by spring 122. Liquid entering chamber 140 will flow past ball 118 and out through the spring retainer 126, exiting at first outlet 84, as indicated by arrows 188. This operation will result in flow to first spray nozzles 80 (FIG. 15) because outlet 84 is connected by tube 88 (shown in FIG. 12).

Referring now to FIG. 49, under conditions of relatively higher pressure in chamber 140, liquid entering chamber 140 will urge ball 118 against spring 122 to seal ball 118 against seat 130 in spring holder 126. The liquid will also urge ball 120 off seat 132, allowing the liquid to flow past ball 120 and into chamber 150, where it will then flow out of common bore 148 and exit the outlets 93 as indicated by arrows 190. This operation will result in flow to the two water pulse delivery heads 76 because outlets 93 are connected by tubes 90 and 92 to the respective inlets 94 of heads 76.

Figure 50:
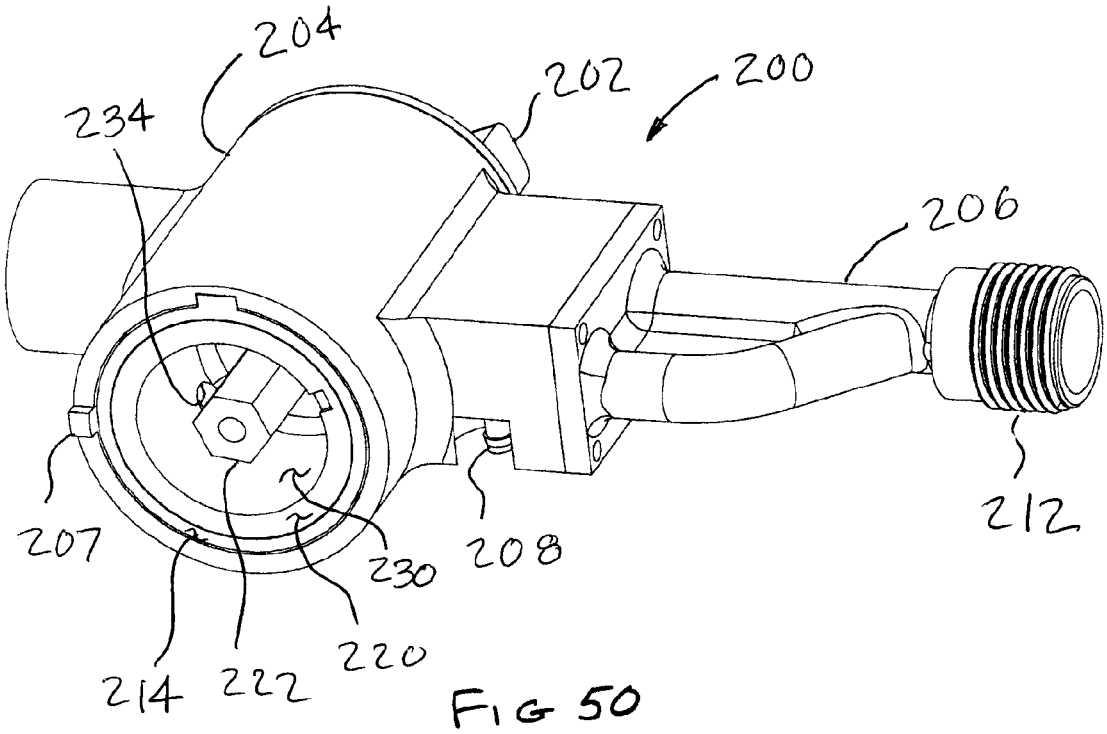
FIG. 50 is a first perspective view of a prototype remote control element useful in the practice of the present invention.
Figure 51:
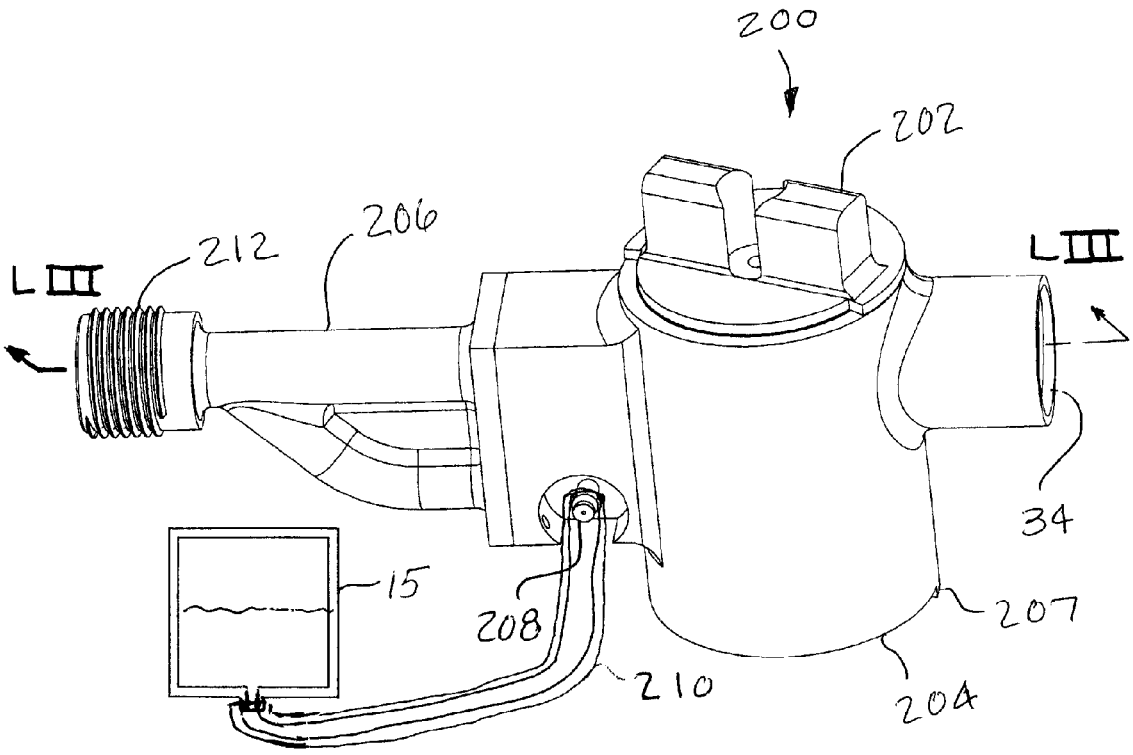
FIG. 51 is a second perspective view of the element of FIG. 50.
Figure 52:
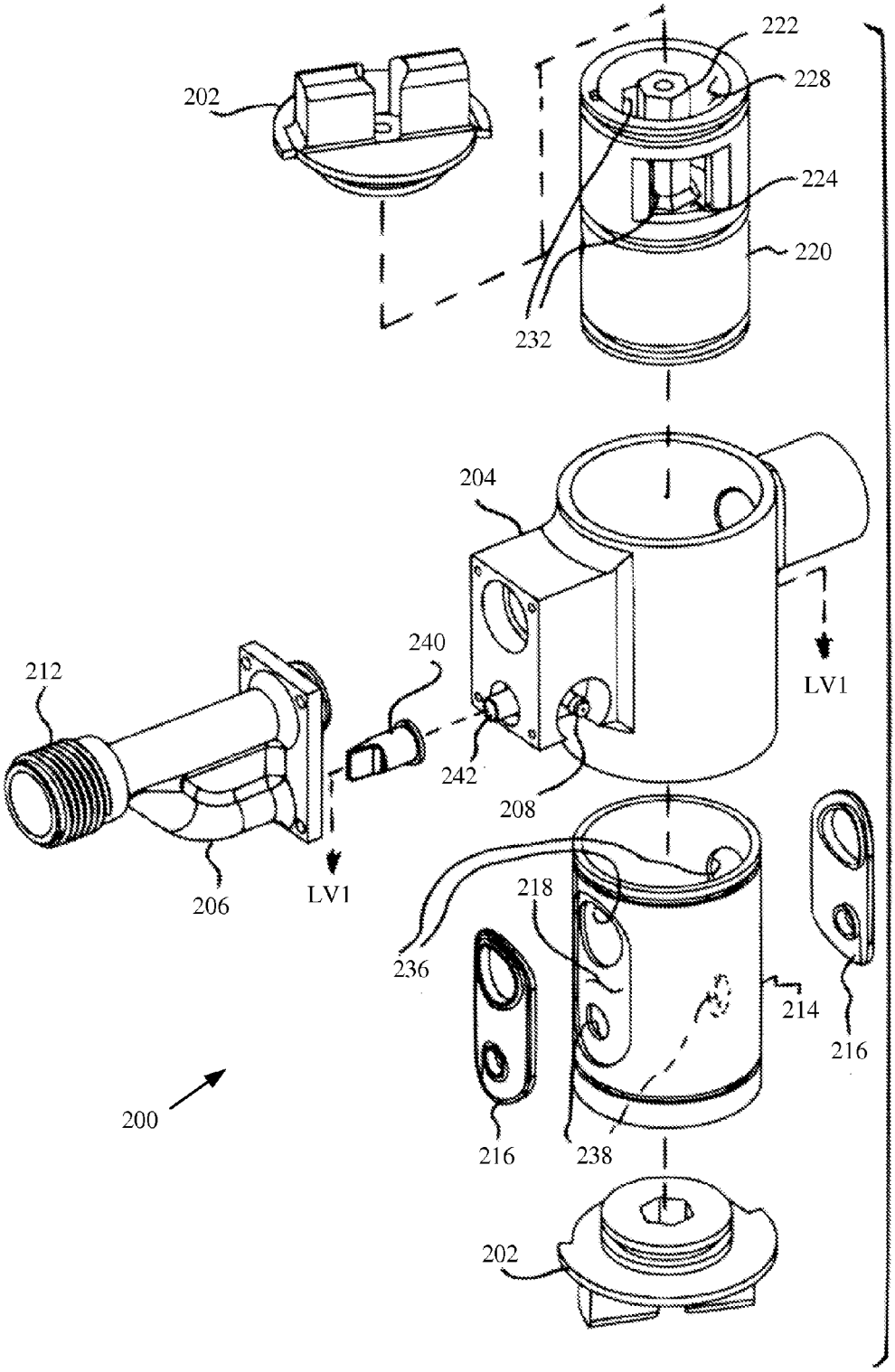
FIG. 52 is an exploded view of the parts of the remote control element of FIG. 50.

Referring now to FIGS. 50-52, various views of a prototype remote control element 200 may be seen. Element 200 corresponds to conceptual remote control element 14 in FIG. 10. In FIGS. 50 and 51, only one control knob 202 is shown, but, as may be seen in FIG. 52, a pair of identical control knobs 202 are preferably used with element 200. As with the prototype brush head assembly, various fasteners and seals such as O-rings have been omitted from the views of the element 200 for simplicity. Element 200 has a main housing 204 and a union 206. A stop 207 may be provided on one or both ends of housing 204 to limit the rotational travel of the knob 202. In FIG. 51, a schematic representation of the liquid cleaner reservoir 15 is shown, to illustrate that it is connected to a venture input 208 via a hose or tube 210. Threads 212 are provided on union 206 to couple element 200 to the hollow tube 16 connecting the element 200 with the brush head 70.

Referring now particularly to FIG. 52, an exploded view of the parts of the remote control element 200 may be seen. A valve stator 214 has a pair of gaskets 261 received in diametrically opposed recesses 218. Stator 214 is received in non-rotating relation to housing 204. A spool 220 is received in rotating relationship to the valve stator 214, and has one or two drive connections such as hexagon projection 222 for coupling to the respective control knob 202. Hexagon projections 222 extend axially from a solid centrally located radial wall 224 dividing spool 220 into two separate compartments 228, 230. Compartment 228 has a pair of diametrically opposed openings 232 and compartment 230 has a pair of diametrically opposed openings 234 offset angularly from the openings 232. Openings 232 are arranged to move in and out of registration with apertures 236 in stator 214 and openings 234 are arranged to move in and out of registration with apertures 238 in stator 214, as selected by a user moving control knob 202 angularly with respect to housing 204. A check valve 240 (which may be in the form of a duckbill valve) is located between main housing 204 and union 206 in a secondary flow path 242.

Figure 52A:
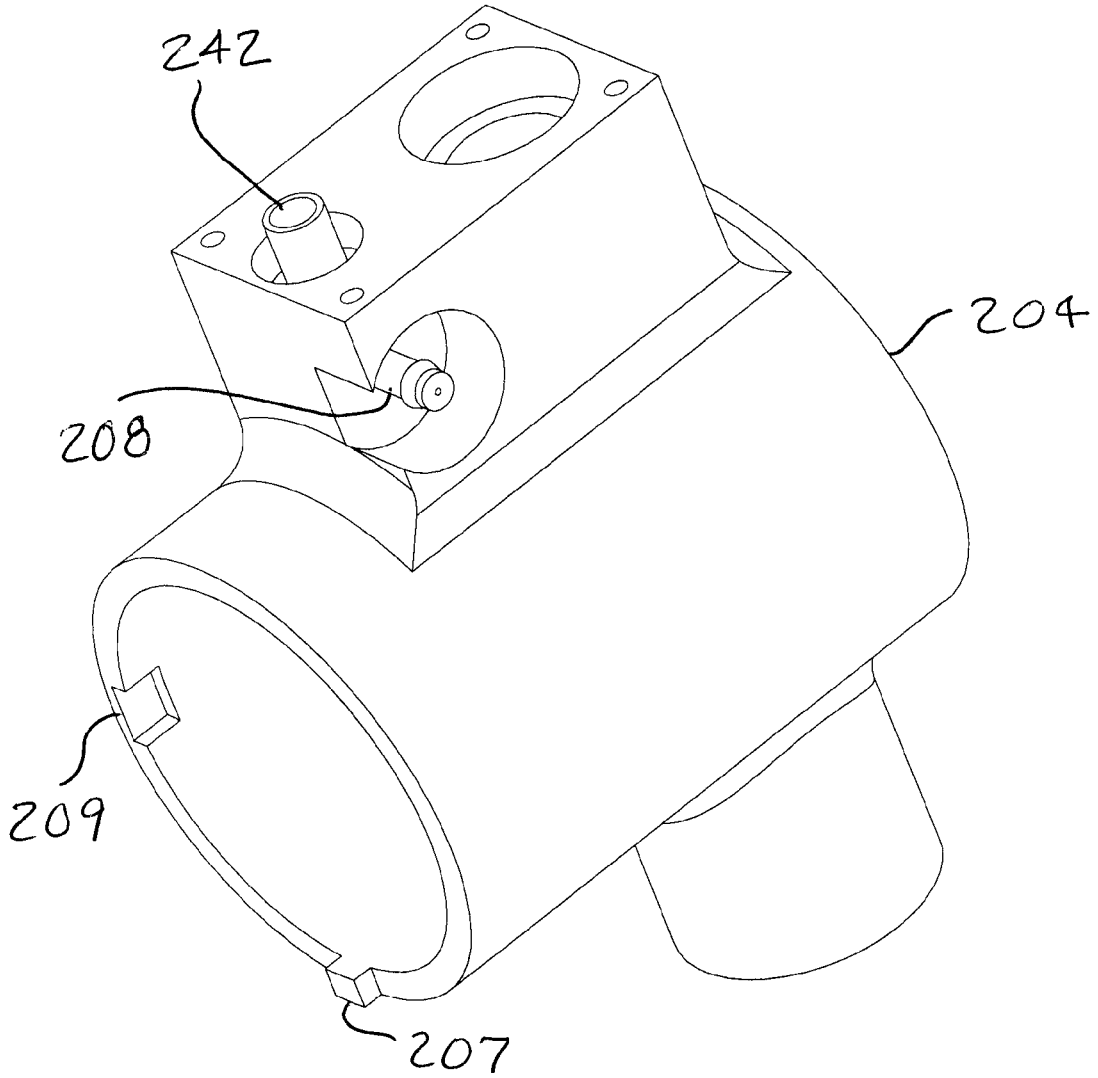
FIG. 52A is an enlarged second perspective view of a housing for the remote control element from FIG. 52.
Figure 52B:
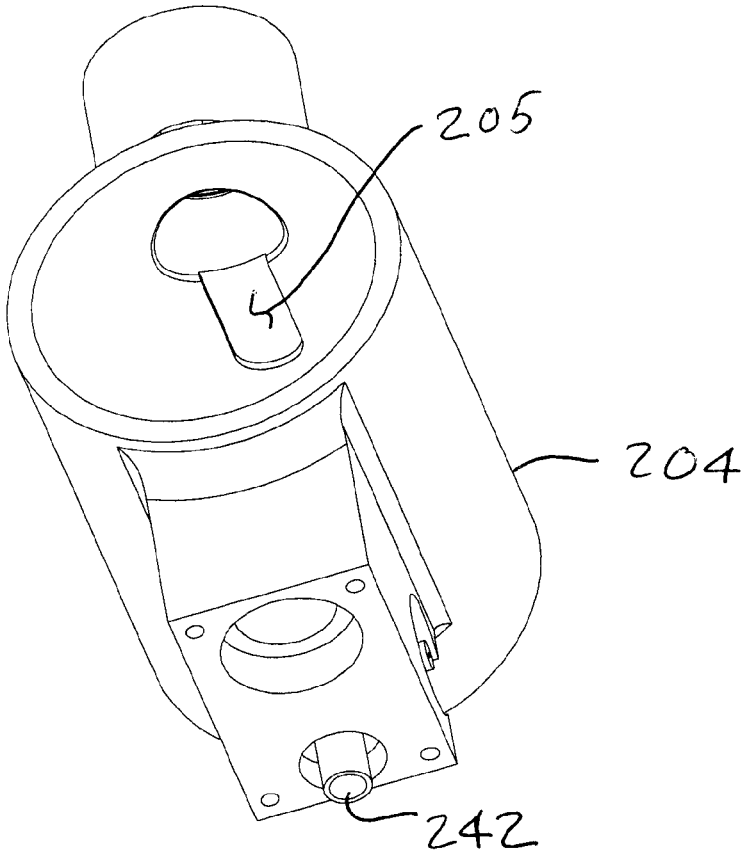
FIG. 52B is a third perspective view of the housing of FIG. 52A.
Figure 52C:
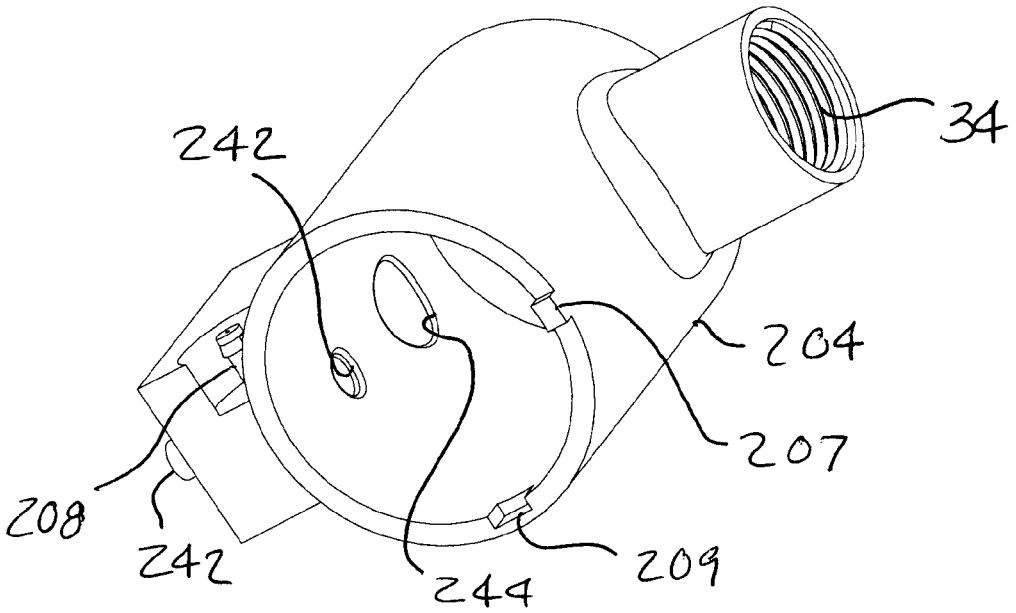
FIG. 52C is a fourth perspective view of the housing of FIG. 52A.

FIGS. 52A-52C show enlarged views of the housing 204 for the remote control element 200. Housing 204 has a relief 205 in an interior surface adjacent inlet opening 34 and extending to a region adjacent opening 234 in valve stator 214 is installed in the housing 204. As may be seen in FIG. 52C, there is no corresponding relief connecting the housing outlet ports for the primary and secondary flow paths 244, 242. A recess 209 may be formed in housing 204 to receive a projection 215 on valve stator 214 to prevent stator 214 from rotating when spool 220 is rotated in housing 204.

Figure 52D:
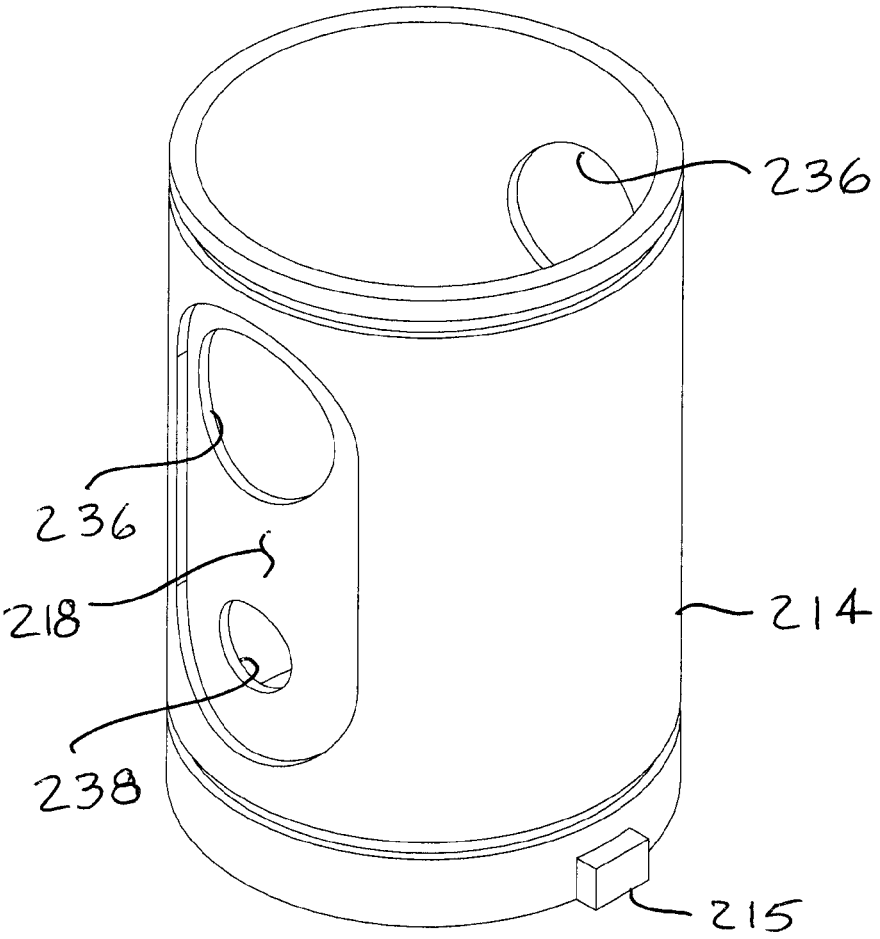
FIG. 52D is an enlarged perspective view of a valve stator for the remote control element of FIG. 52.
Figure 52E:
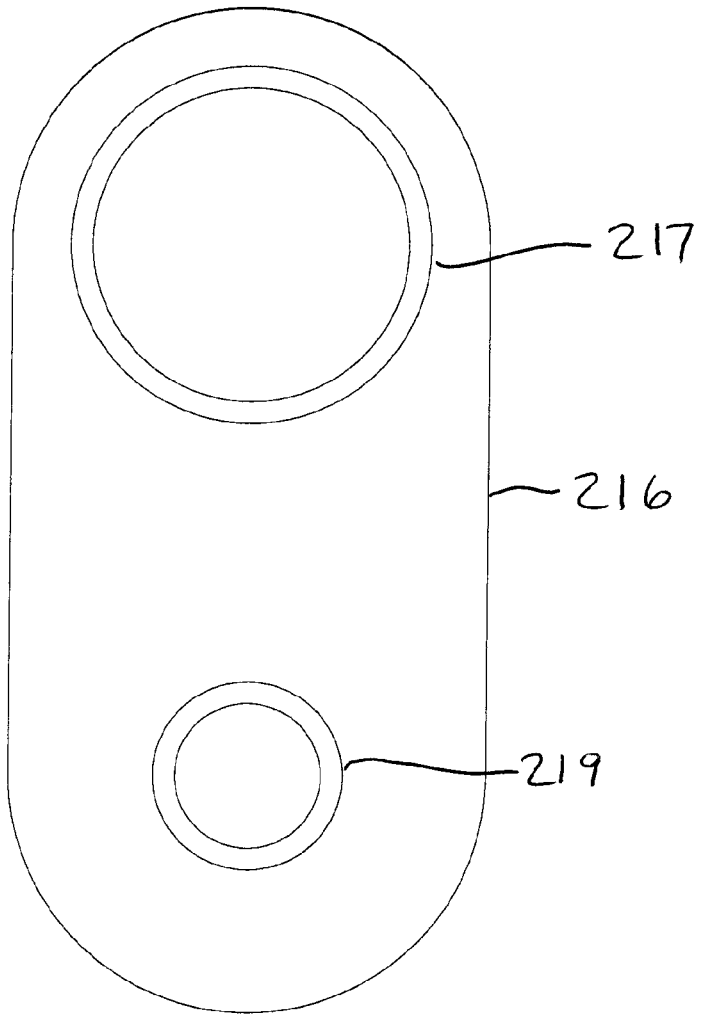
FIG. 52E is an enlarged rear view of a gasket for the remote control element of FIG. 52.
Figure 52F:
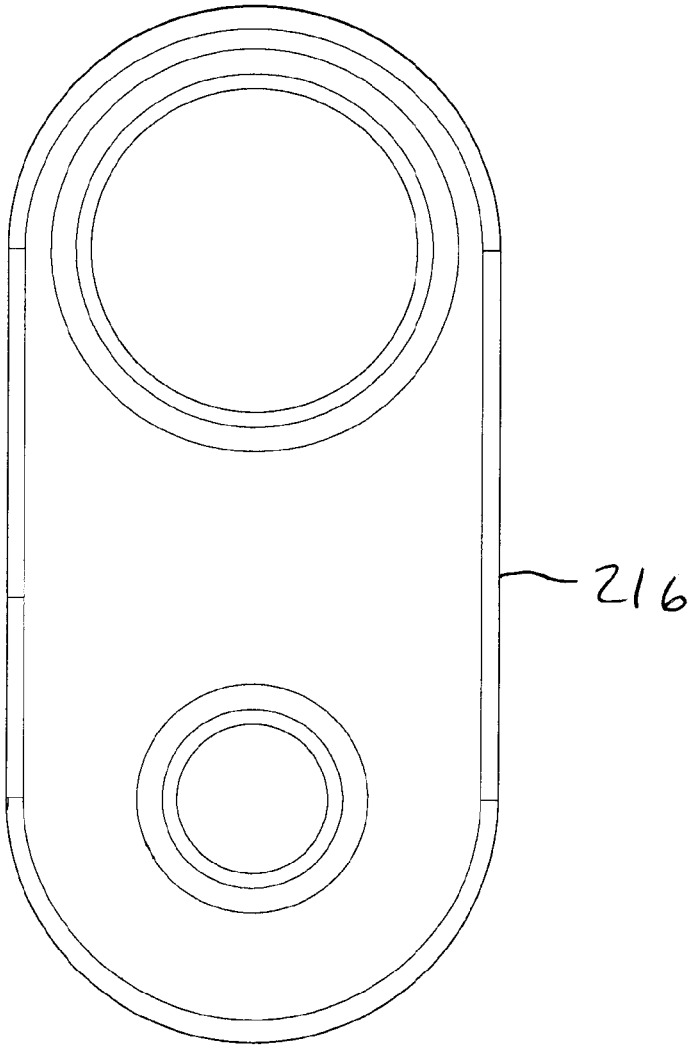
FIG. 52F is a front view of the gasket of FIG. 52E.
Figure 52G:
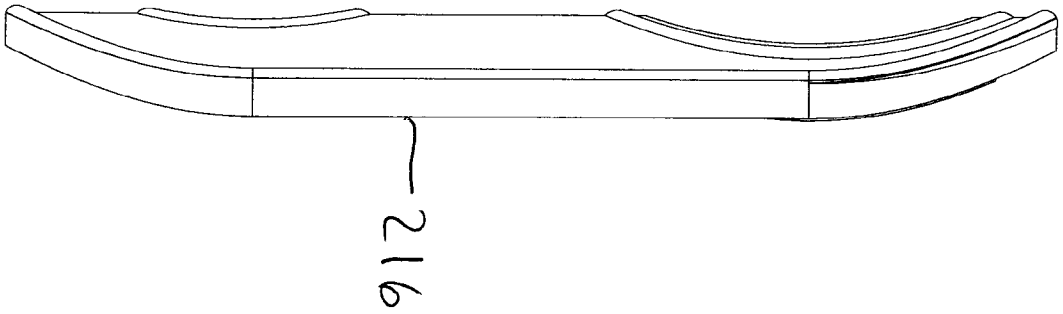
FIG. 52G is a side view of the gasket of FIG. 52E.
Figure 52H:
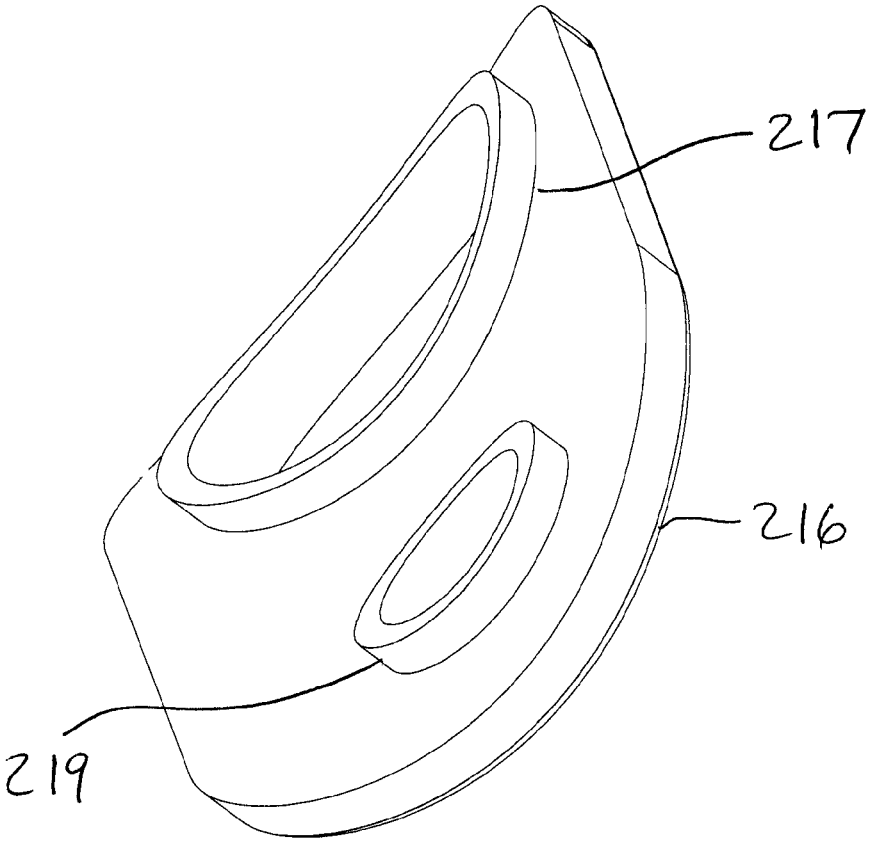
FIG. 52H is a perspective view of the gasket of FIG. 52E.

FIG. 52D shows an enlarged perspective view of the valve stator 214 rotated 180 degrees from the view shown in FIG. 52.

FIGS. 52E-52H show enlarged views of the gasket 216. It is to be understood that the two gaskets 216 are identical. Gasket 216 has a first projection 217 sized and positioned to nest within aperture 236 and a second projection sized and positioned to nest within aperture 238. Gaskets 216 may be used to seal the valve stator 214 against the housing 204. Optionally gaskets 216 may be omitted, if desired.

Figure 52I:
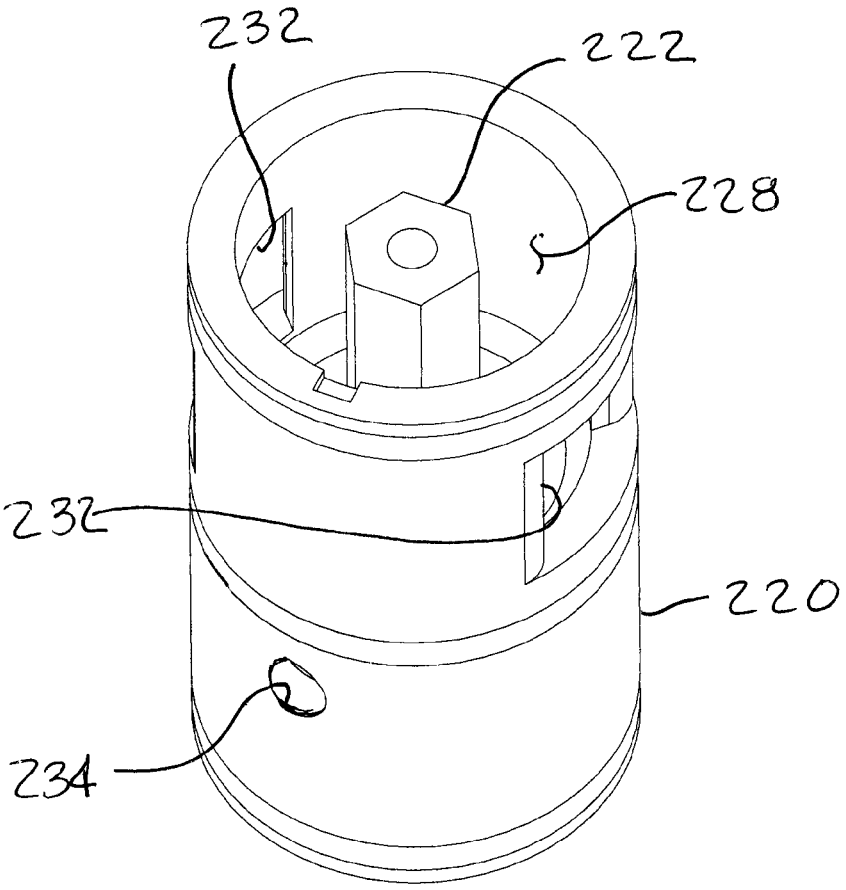
FIG. 52I is an enlarged perspective view of a spool for the remote control element of FIG. 52.
Figure 52J:
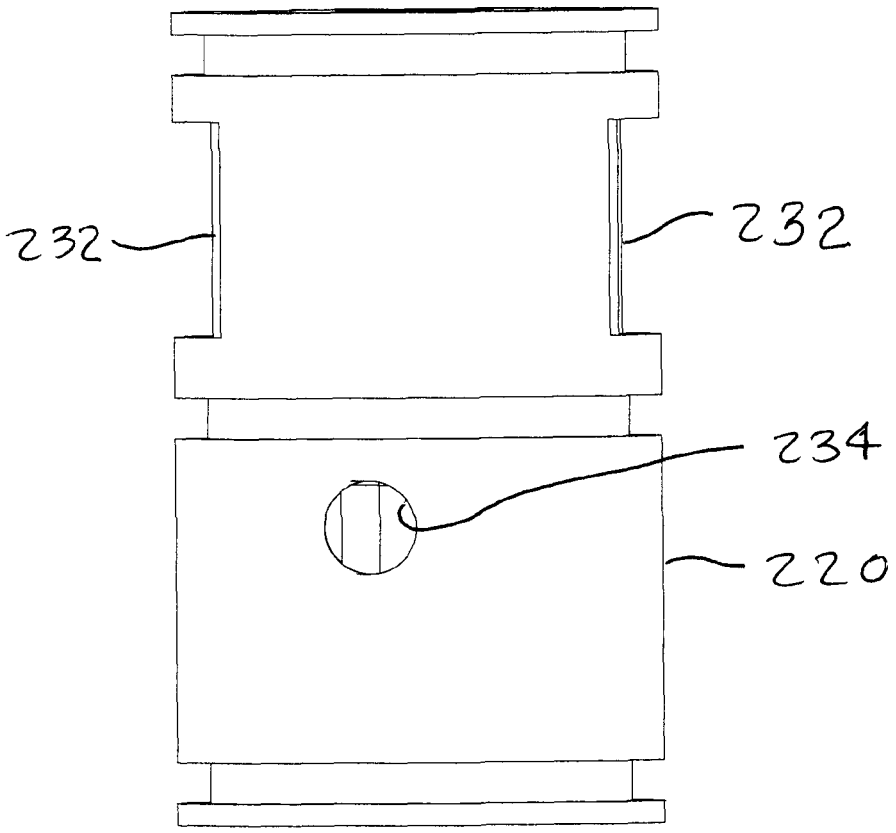
FIG. 52J is a first side elevation view of the spool of FIG. 52I.
Figure 52K:
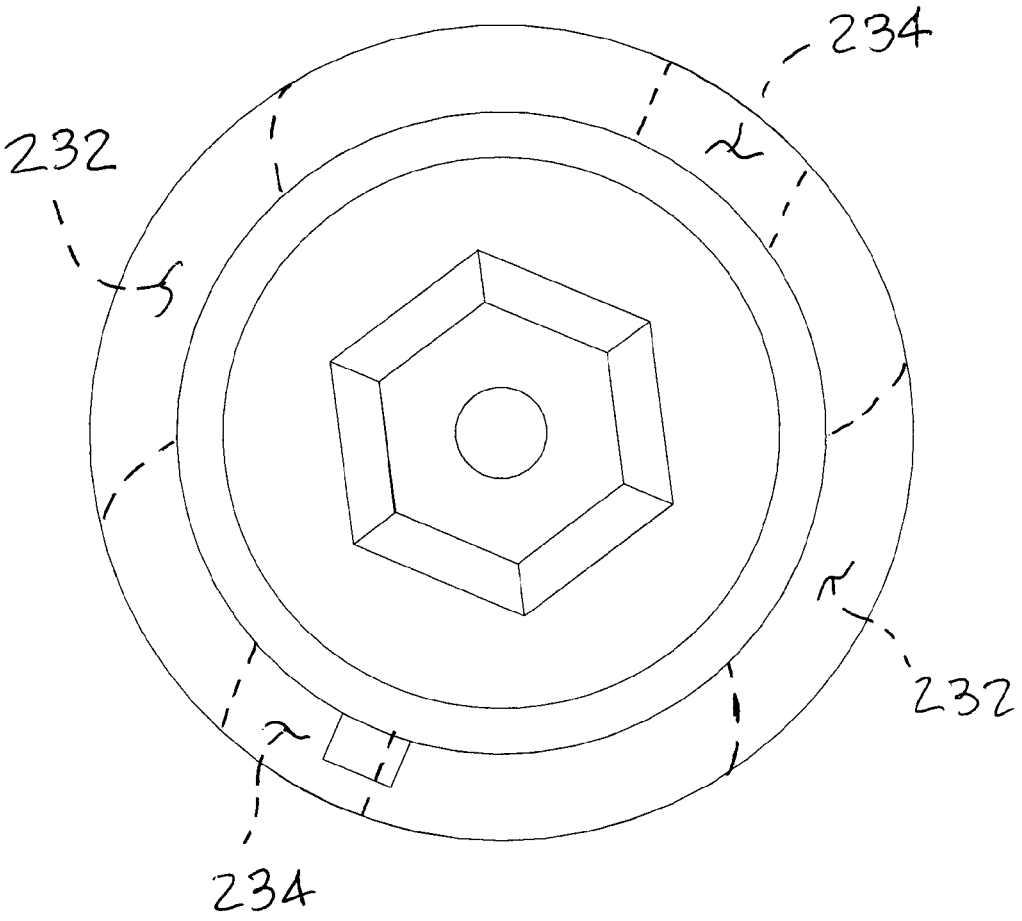
FIG. 52K is a second side elevation view of the spool of FIG. 52I.

Enlarged views of the spool 220 may be seen in FIGS. 52I-52K, which illustrate that the spool has compartment 228 in fluid communication with diametrically opposed openings 232, and a separate compartment 230 in fluid communication with openings 234. FIG. 52K shows a top plan view of the spool with the relative orientation of the openings 232 and 234 shown in dashed lines.

Figure 53:
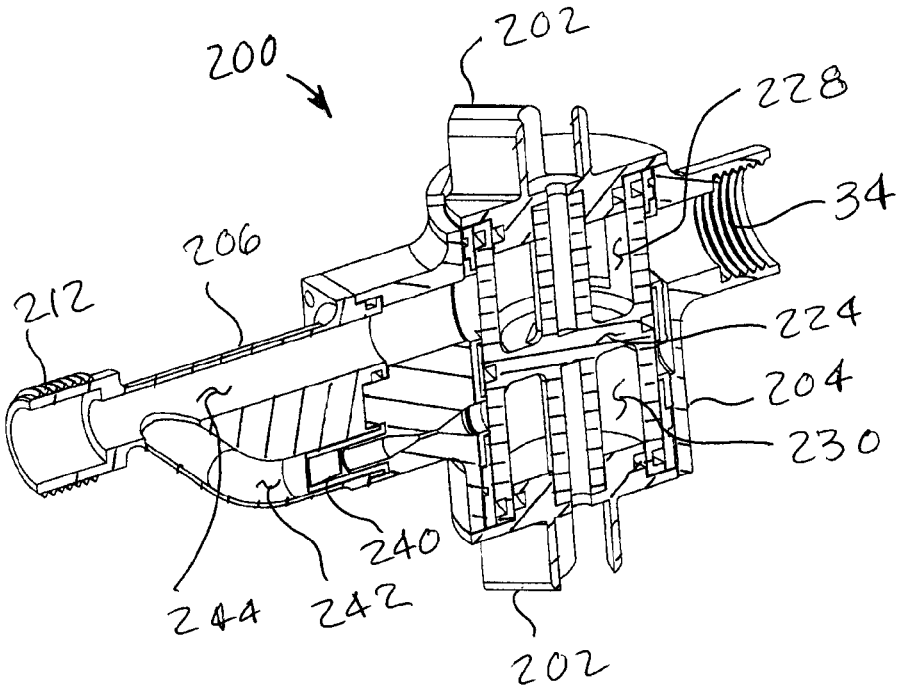
FIG. 53 is a section view taken along line LIII-LIII of FIG. 51, with parts in a first position.

Referring now also to FIG. 53, the remote control element 200 is shown in section with parts positioned in a CLOSED condition in which no liquid flow from input 34 to output 212 is permitted, either through the secondary flow path 242 or a primary flow path 244.

Figure 54:
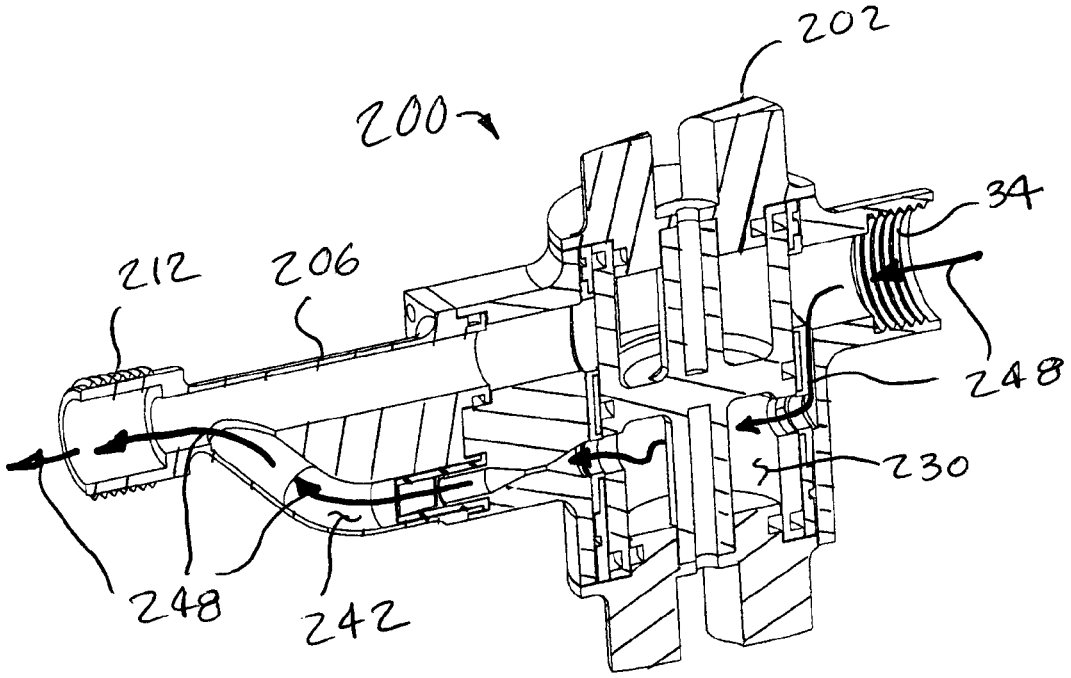
FIG. 54 is a section view taken along line LIII-LIII of FIG. 51, with parts in a second position.
Figure 56:
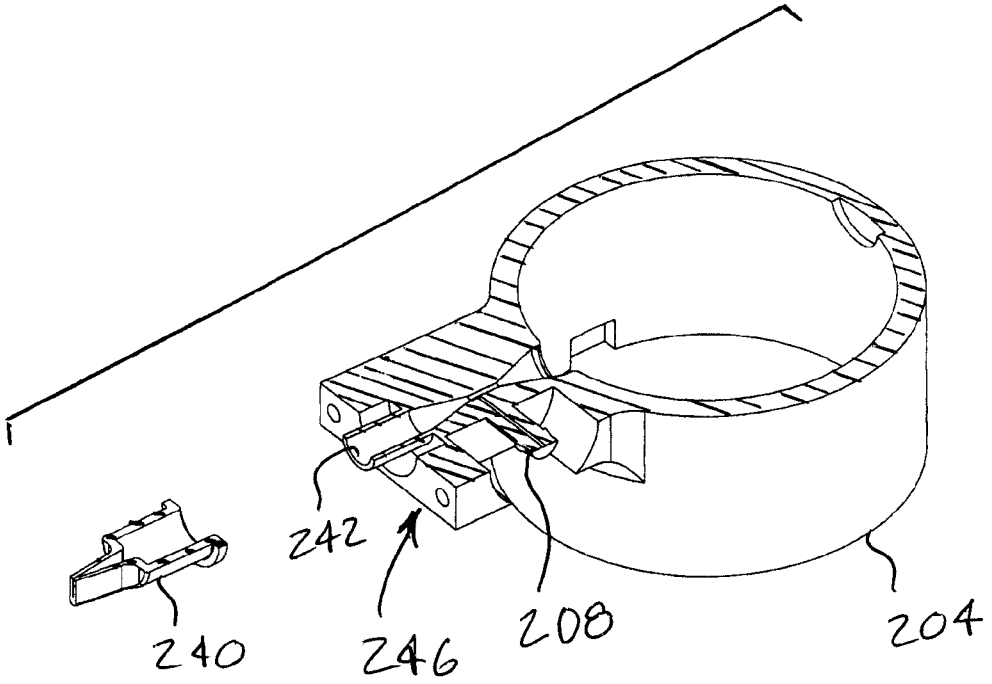
FIG. 56 is a section view of a housing and check valve, taken along line LVI-LVI of FIG. 52.

Referring now to FIG. 54, the remote control element 200 is shown in section with parts positioned in a SOAK/SPRAY condition in which liquid flow from input 34 to output 212 is permitted only through the secondary flow path 242. As a result, the liquid exits output 212 in a relatively low pressure condition. In addition, liquid cleaner present in reservoir 15 is drawn into the secondary flow path 242 and delivered with the low pressure water to the brush head 70, where the solution of water and liquid cleaner is directed by mode valve 78 to be emitted from spray nozzles 80. The relief 205 in housing 204 adjacent the gasket 216 provides a restriction in the secondary flow path 242 to provide the relatively low pressure condition for liquid delivered through element 200 when parts are as shown in FIG. 54. FIG. 56 shows a section view of the housing 204 and check valve 240 to better illustrate the action of siphoning liquid cleaner at venturi structure 246. The flow through the secondary flow path 242 is illustrated by arrow 248 in FIG. 54. With parts in the position shown in FIG. 54, flow is permitted through compartment 230 because openings 234 in spool 220 are in registration with apertures 238 in stator 214, and flow is blocked from passing through compartment 228 because openings 232 in spool 220 are out of registration with apertures 236 in the stator 214.

Figure 55:
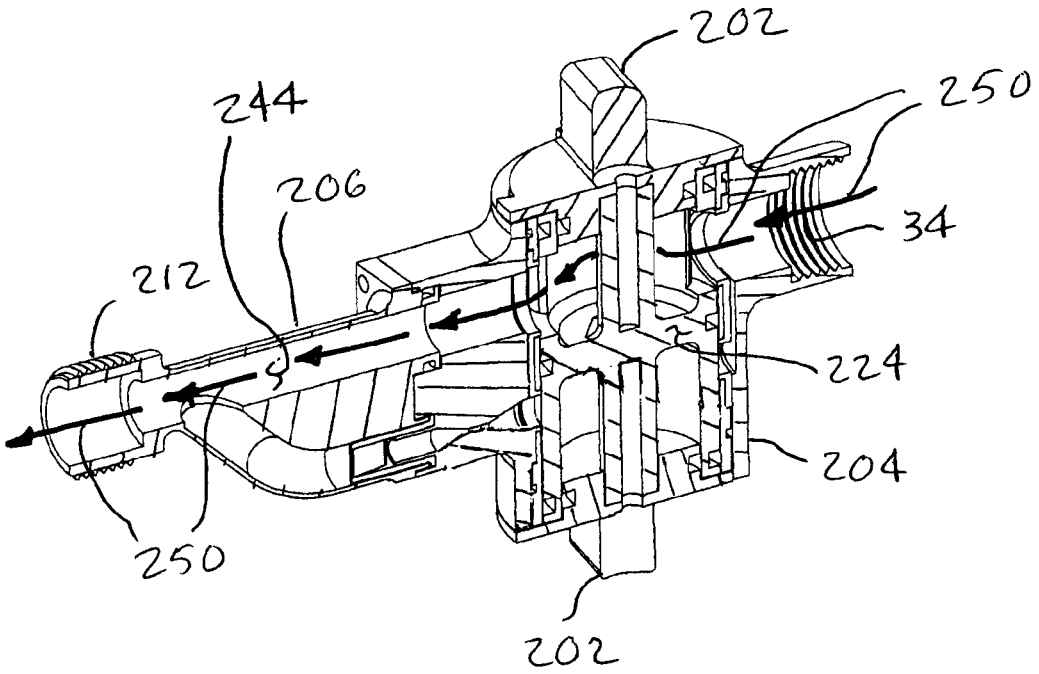
FIG. 55 is a section view taken along line LIII-LIII of FIG. 51, with parts in a third position.

Turning now to FIG. 55, the remote control element 200 is shown with parts positioned in a SCRUB position in which liquid flow from input 34 to output 212 is permitted only through primary flow path 244, as indicated by arrows 250. In this condition, liquid (typically water) exits output 212 in a relatively high pressure condition, causing mode valve 78 to deliver the liquid only to the water pulse delivery heads 76. With parts in the position shown in FIG. 55, flow is permitted through compartment 228 because openings 232 in spool 220 are in registration with apertures 236 in stator 214, and flow is blocked from passing through compartment 230 because openings 234 in spool 220 are out of registration with apertures 238 in the stator 214.

Operation of the present invention is as follows. Initially, the remote control element may be positioned to the CLOSED condition corresponding to FIG. 53. Liquid cleaner is preferably added to reservoir 15, and the tool 10 is connected to a water source such as a garden hose at fitting or inlet 34. Water pressure is applied to the garden hose 32, for example, by opening a bib faucet on a residence as illustrated in FIG. 3. The spool 220 of the remote control element 200 is then moved to the SOAK/SPRAY condition as shown in FIG. 54, delivering a solution of water and liquid cleaner to the brush head 70 via hollow tube 16. Because the liquid is delivered at relatively low pressure, the mode valve will have parts shown in the position illustrated in FIG. 48. The liquid will be delivered to the manifold 100 and emitted from spray nozzles 80. The SOAK operation illustrated in FIGS. 3 and 3A may then be carried out by a user. At this time, the flow is as shown in the hydraulic schematic of FIG. 7.

Once the surface to be treated has been completely sprayed during this mode, the spool 220 of the remote control element may be positioned to the SCRUB condition as shown in FIG. 55. Liquid (usually water) will be delivered from the garden hose 32 through inlet 34, along primary flow path 244 in element 200 and through tube 16 at a relatively high pressure to the brush head 70. The relatively high pressure will automatically switch operation from delivering liquid to the spray nozzles 80 to the 76, causing water to be emitted in pulses through nozzles 104 because rotation of the rotors 158 will cause cyclic covering and uncovering of nozzles 104 during operation of the water pulse delivery heads 76. Switching flow in the brush head will be accomplished by mode valve 78 moving to position its internal parts to the condition shown in FIG. 49. At this time, the user may perform the SCRUB operation illustrated in FIGS. 4 and 4A using the bristles and pulsing water jets to clean the surface being treated.

Once the SCRUB operation is completed, the user may perform the rinse operation illustrated in FIGS. 5 and 5A, by removing the tube 16 from the remote control element 200, for example by separating the tube 16 from element 200 at threads 212. Alternatively, another form of connection may be used as is illustrated in FIG. 8.

The invention may thus be seen to be apparatus and method for switching between operating modes at a distal brush head by controlling the pressure of liquid delivered by a remote control element proximal of the user without requiring any separate hydraulic, pneumatic, mechanical or electrical path to control the operational mode of the brush head. Other aspects of the invention include features shown or described above.

The invention may include the overall concept of a paint preparation tool shown and described for cleaning exterior surfaces prior to painting. The tool includes an elongated tube connecting a proximal handle with a remote control element and a distal brush head. The handle may be detachable from the tube (pole) to provide a rinse spray function. The head may include relatively stiff bristles for scrubbing and forward spray nozzles for spraying cleaner and may further include dual pulsating wash heads to deliver pulsating water.

In operation, the present invention may include a first phase to soak or wet the surface with cleaner. During the soak phase a back and forth motion may be used to apply the cleaner using the forward spray nozzles. The present invention may further include a second phase to scrub the surface to remove dirt. During the scrub phase, a back and forth motion may be used. The bristles and pulsing water jets may be used in this phase. The invention may optionally include a third phase to rinse (remove) the cleaner and any dirt loosened by the scrub phase using a higher pressure spray by removing the pole from the handle and using a built in fan nozzle.

In another aspect the invention may include a first spring loaded valve in an OPEN condition at low pressure to allow the liquid cleaner (delivered at low pressure) to be sprayed out the front of the brush head. This valve moves to a CLOSED condition when operation is switched to "water only" (no cleaner), with the water delivered to the brush head at higher pressure. The invention may also include a second spring loaded valve in a CLOSED condition at low pressure (because of the spring force) to prevent cleaner from being delivered through the pulse jets. The second valve moves to an OPEN condition under the higher pressure when water only is delivered to the brush head, allowing the water to flow to the pulse jet outlets.

The invention may also include a selector on the handle to permit a user to switch between the low pressure liquid cleaner delivery and the higher pressure water-only delivery, and may include an OFF position, and also may include more than one "higher pressure" setting for water-only delivery.

In another aspect, the present invention may also include a "pulse jet" mechanism in a surface cleaning tool having a nozzle delivering water at one or more paddles on a rotatable paddle wheel which has a segment removed allowing selective water flow through the mechanism when the removed segment is aligned with fluid flow passages.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations, together with all equivalents thereof.

The invention claimed is:

1. A cleaning apparatus comprising:
- an elongated tube having a first end and a second end;
- a proximal handle at the first end of the elongated tube;
- a remote control element having a plurality of positions;
- a primary flow path through the elongated tube from the first end to the second end; and
- a distal brush head at the second end of the elongated tube having a plurality of cleaning elements and a mode valve having a plurality of valves connected to the primary flow path, the mode valve configured to:
  - deliver a first liquid, with a first pressure, received from the primary flow path, through a first valve from the plurality of valves and out a first set of cleaning elements from the plurality of cleaning elements in response to the remote control element entering a first position from the plurality of positions, and
  - deliver a second liquid, with a second pressure, received from the primary flow path, through a second valve from the plurality of valves and out a second set of cleaning elements from the plurality of cleaning elements in response to the remote control element enter a second position from the plurality of positions.

2. The cleaning apparatus of claim 1, wherein the proximal handle is detachable from the tube and separately operable to provide a rinse spray from the proximal handle.

3. The cleaning apparatus of claim 1, wherein the plurality of cleaning elements on the distal brush head include forward spray nozzles for spraying cleaner at a surface to be cleaned.

4. The cleaning apparatus of claim 1, wherein the plurality of cleaning elements on the distal brush head include dual pulsating wash heads to deliver pulsating fluid to a surface to be cleaned.

5. The cleaning apparatus of claim 1, wherein the proximal handle comprises:
- a connection for receiving a flow of water to the cleaning apparatus; and
- a reservoir for a liquid cleaner.

6. The cleaning apparatus of claim 5, wherein the first liquid is a combination of water from the flow of water and a liquid cleaner from the reservoir and the first valve is movable to an OPEN condition at the first pressure of the combination, received from the primary flow path to allow the combination delivered at the first pressure to be sprayed out the distal brush head, and movable to a CLOSED condition when the remote control element enters the second position, with the water delivered to the distal brush head at the second pressure that is higher than the first pressure.

7. The cleaning apparatus of claim 6, and further comprising a selector located at the proximal handle for controlling a pressure of the flow of water leaving the proximal handle.

8. The cleaning apparatus of claim 7, wherein the second valve is movable to a CLOSED condition when the water is at the first pressure to block the cleaner from being delivered out the second set of cleaning elements, and to an OPEN condition when the water is at the second pressure to permit only the water to be delivered out the second set of cleaning elements.

9. The cleaning apparatus of claim 7 wherein the selector on the proximal handle further includes at least one of:

an OFF position to block the flow of water and cleaner; and at least one additional pressure setting for water-only delivery at a pressure that is higher than the second fluid pressure.

10. The cleaning apparatus of claim 1, wherein the cleaning elements on the brush head include a mechanism having a nozzle with at least one fluid flow passage directing water at one or more paddles on at least one rotatable paddle wheel having at least one aperture therethrough to allow selective water flow through the mechanism when the at least one aperture is aligned with the at least one fluid flow passage and to at least partially block water flow through the mechanism when the at least one aperture is not aligned with the at least one fluid flow passage.

11. The cleaning apparatus of claim 1, wherein there is a continuous spraying of the first liquid out the first set of cleaning elements when the first liquid delivered is at the first pressure and there is a pulsed spraying of the second liquid out the second set cleaning elements when the second liquid delivered is at the second pressure.

12. A tool for cleaning exterior surfaces prior to painting, the tool comprising:

an elongated tube;

a proximal handle having a remote control element connected by an elongated tube to a distal brush head, the distal brush head having a mode valve; and wherein the mode valve is fluidically coupled to and actuated in response to, fluid pressure changes in the elongated tube; and wherein the distal brush head is configured to operate in a first operating mode when the fluid provided to the distal brush head is below a threshold pressure and a second operating mode when the fluid provided to the distal brush head is above the threshold pressure, and wherein the second operating mode provides a different cleaning function from the first operating mode, and wherein the first operating mode comprises a first mode valve position and wherein the second operating mode comprises a second mode valve position.

13. The tool of claim 12 wherein the proximal handle is detachable from the elongated tube and separately operable to provide a rinse spray from the proximal handle.

14. The tool of claim 12 wherein the distal brush head includes bristles for scrubbing and forward spray nozzles for spraying cleaner at a surface to be cleaned.

15. The tool of claim 14, the distal brush head further comprising dual pulsating wash heads to deliver pulsating water to the surface to be cleaned.

16. The tool of claim 12, wherein the remote control element at the proximal handle is configured to control a pressure of fluid provided to the distal brush head.

17. The tool of claim 12, the mode valve configured to switch between the first operating mode and the second opera ng mode as a function of a pressure of fluid provided to the distal brush head.

18. The tool of claim 17, wherein the first operating mode comprises continuous spraying of the fluid from the distal brush head and the second operating mode comprises pulse spraying of fluid from the distal brush head.

* * * * *